US009760030B2

(12) United States Patent
Sekiya et al.

(10) Patent No.: US 9,760,030 B2
(45) Date of Patent: Sep. 12, 2017

(54) ELECTROPHOTOGRAPHIC PHOTOSENSITIVE MEMBER, PROCESS CARTRIDGE, AND ELECTROPHOTOGRAPHIC APPARATUS

(71) Applicant: CANON KABUSHIKI KAISHA, Tokyo (JP)

(72) Inventors: Michiyo Sekiya, Atami (JP); Kunihiko Sekido, Suntou-gun (JP); Kei Tagami, Yokohama (JP); Masashi Nishi, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/886,361

(22) Filed: Oct. 19, 2015

(65) Prior Publication Data

US 2016/0116853 A1 Apr. 28, 2016

(30) Foreign Application Priority Data

Oct. 24, 2014 (JP) ..... 2014-217358
Mar. 30, 2015 (JP) ..... 2015-069755
Oct. 8, 2015 (JP) ..... 2015-200570

(51) Int. Cl.
*G03G 5/14* (2006.01)
*G03G 5/06* (2006.01)
*G03G 5/047* (2006.01)

(52) U.S. Cl.
CPC ..... *G03G 5/142* (2013.01); *G03G 5/047* (2013.01); *G03G 5/065* (2013.01); *G03G 5/0607* (2013.01);

(Continued)

(58) Field of Classification Search
CPC .... G03G 5/142; G03G 5/0648; G03G 5/0657; G03G 5/065; G03G 5/0651; G03G 5/0675
See application file for complete search history.

(56) References Cited

U.S. PATENT DOCUMENTS 4,442,193 A 4/1984 Chen et al.
4,562,132 A 12/1985 Ong et al.
(Continued)

FOREIGN PATENT DOCUMENTS

JP 1-206349 A 8/1989
JP 5-279582 A 10/1993
(Continued)

OTHER PUBLICATIONS

Journal of Society of Electrophotography of Japan, vol. 22, No. 1, 1983, pp. 69-76.

(Continued)

*Primary Examiner* — Christopher Rodee
(74) *Attorney, Agent, or Firm* — Fitzpatrick Cella Harper and Scinto

(57) ABSTRACT

An electrophotographic photosensitive member includes a laminated body, the laminated body including a support, an undercoat layer, and a charge generating layer. The undercoat layer includes a polymerized product of a composition including an electron transport material represented by formula (1), a cross-linking agent, and a thermoplastic resin having a polymerizable functional group, the laminated body satisfying expressions (2) and (3)

$$Z^1—X—Z^2 \quad (1)$$

$$0.20 \leq |Vd2-Vd1| \leq 2.0 \quad (2)$$

$$\tau \leq 10 \quad (3)$$

(Continued)

in which $Z^1$ and $Z^2$ are groups having electron transport property, X is a linker, Vd2 and Vd1 are surface potentials of the charge generating layer after charging and τ is transit time based on a change rate of the surface of the charge generating layer, each as defined in the specification.

24 Claims, 6 Drawing Sheets

(52) U.S. Cl.
CPC ..... *G03G 5/0609* (2013.01); *G03G 5/0648* (2013.01); *G03G 5/0651* (2013.01); *G03G 5/0657* (2013.01); *G03G 5/0675* (2013.01); *G03G 5/0696* (2013.01)

(56) References Cited

U.S. PATENT DOCUMENTS 4,992,349 A 2/1991 Chen et al.
5,468,583 A 11/1995 Gruenbaum et al.
5,604,061 A 2/1997 Sekido et al.
5,863,688 A 1/1999 Watanabe et al.
6,228,546 B1 5/2001 Kashizaki et al.
6,294,301 B1 * 9/2001 Sorriero ..... C08G 73/1082 430/64
6,593,046 B2 * 7/2003 Sorriero ..... C08G 73/1082 430/64
6,794,102 B2 * 9/2004 Bender ..... G03G 5/0661 430/56
6,866,977 B2 * 3/2005 Sorriero ..... C08G 73/1082 430/64
7,449,268 B2 * 11/2008 Bender ..... C07D 209/48 430/58.3
7,541,124 B2 * 6/2009 Molaire ..... G03G 5/056 430/123.4
7,871,747 B2 1/2011 Shimoyama et al.
8,343,699 B2 1/2013 Nagasaka et al.
8,546,050 B2 10/2013 Maruyama et al.
8,632,931 B2 * 1/2014 Sekido ..... G03G 5/0532 399/159
8,795,936 B2 8/2014 Sekido et al.
8,940,465 B2 1/2015 Sekido et al.
9,063,505 B2 6/2015 Sekiya et al.
9,069,267 B2 * 6/2015 Kaku ..... G03G 5/043
9,207,550 B2 12/2015 Okuda et al.
2007/0026332 A1 * 2/2007 Ferrar ..... G03G 5/102 430/64
2011/0268472 A1 * 11/2011 Sekido ..... G03G 5/0571 399/111
2014/0004456 A1 * 1/2014 Okuda ..... G03G 15/00 430/56
2014/0377703 A1 12/2014 Ogaki et al.
2015/0185630 A1 * 7/2015 Ito ..... G03G 5/0575 430/56
2015/0185632 A1 7/2015 Sekido et al.
2015/0185633 A1 7/2015 Tagami et al.
2015/0185634 A1 7/2015 Sekiya et al.
2015/0185636 A1 7/2015 Sekiya et al.
2015/0185637 A1 7/2015 Nishi et al.
2015/0185638 A1 7/2015 Nakamura et al.
2015/0277247 A1 10/2015 Sekiya et al.
2016/0115163 A1 * 4/2016 Nishi ..... G03G 5/142 399/111

FOREIGN PATENT DOCUMENTS

JP 7-70038 A 3/1995
JP 9-151157 A 6/1997
JP 2003-330209 A 11/2003
JP 2006-251554 A 9/2006
JP 2007-108670 A 4/2007
JP 2007-148294 A 6/2007
JP 2008-250082 A 10/2008
JP 2010-145506 A 7/2010
JP 2014-29480 A 2/2014

OTHER PUBLICATIONS

Jones, et al., "Cyanonaphthalene Diimide Semiconductors for Air-Stable, Flexible, and Optically Transparent n-Channel Field-Effect Transistors", Chemistry of Materials, vol. 19, No. 11, May 29, 2007, pp. 2703-2705.
Callahan, et al., "Syntheses of Phencyclone Analogues. Applications for NMR Studies of Hindered Rotations and Magnetic Anisotropy in Crowded Diels-Alder Adducts", Chem. Educator, vol. 6, 2001, pp. 227-234.
Kato, et al., "Nitration of Phenanthrenequinone", Journal of Synthetic Organic Chemistry, Japan, vol. 15, 1957, pp. 29-32.
Kato, et al., "Syntheses of Amino-phenanthrenequinones by the Reduction of Nitro Compounds", Journal of Synthetic Organic Chemistry, Japan, vol. 15, 1957, pp. 32-34.
Yamada, et al., "Synthesis and Properties of Diamino-Substituted Dipyrido [3,2-a: 2',3'-c]phenazine", Bulletin of the Chemical Society of Japan, vol. 65, No. 4, 1992, pp. 1006-1011.
Qian, et al., "4-Amino-1, 8-dicyanonaphthalene derivatives as novel fluorophore and fluorescence switches: efficient synthesis and fluorescence enhancement induced by transition metal ions and protons", Tetrahedron Letters, vol. 43, 2002, pp. 2991-2994.
Xiao, et al., "Novel highly efficient fluoroionophores with a peri-effect and strong electron-donating receptors: TICT-promoted PET and signaling response to transition metal cations with low background emission", Tetrahedron Letters, vol. 44, 2003, pp. 2087-2091.
Miyamura, et al., "Polymer Incarcerated Gold Catalyzed Aerobic Oxidation of Hydroquinones and Their Derivatives", Chemistry Letters, vol. 37, No. 3, 2008, pp. 360-361.
Okada, et al., "Synthesis and Properties of a Novel Electron Transporting Compound, 3, 3'-dialky1-4,4'- bisnaphthylquinone (DBNQ)", PPCI/Japan Hardcopy '98 Papers, 1998, pp. 207-210.
Jones, et al., "Tuning Orbital Energetics in Arylene Diimide Semiconductors. Materials Design for Ambient Stability of n-Type Charge Transport", J. Am. Chem. Soc., vol. 129, 2007, pp. 15259-15278.
Bulletin of Tokai Women's Junior College, vol. 7, pp. 1-11, 1980.
Fujiyama, et al., "Development of New Electron Transport Material with High Drift Mobility", Journal of the Imaging Society of Japan, vol. 45, No. 6, 2006, pp. 521-525.
Yamashita, et al. (eds.), "Crosslinking Agent Handbook", Taiseisha, Ltd., 1981, pp. 536-605.

* cited by examiner

ELECTROPHOTOGRAPHIC PHOTOSENSITIVE MEMBER, PROCESS CARTRIDGE, AND ELECTROPHOTOGRAPHIC APPARATUS

BACKGROUND OF THE INVENTION

Field of the Invention

The present invention relates to an electrophotographic photosensitive member, and a process cartridge and an electrophotographic apparatus each including the electrophotographic photosensitive member.

Description of the Related Art

An electrophotographic photosensitive member containing an organic photoconductive material (hereinafter referred to as "charge generating material") is currently a major electrophotographic photosensitive member to be used for a process cartridge or an electrophotographic apparatus. The electrophotographic photosensitive member generally includes a support and a photosensitive layer (charge generating layer and hole transporting layer) formed on the support. In addition, an undercoat layer is formed between the support and the photosensitive layer in many cases.

A charge generating material having additionally high sensitivity has been used in recent years. However, as the sensitivity of the charge generating material rises, an amount of charge to be generated increases and hence the charge is liable to reside in the photosensitive layer. Consequently, a positive ghost is liable to occur. As a technology of suppressing such positive ghost, in Japanese Patent Application Laid-Open No. 2014-029480, there is a disclosure that the undercoat layer contains a polymerized product (cured product) obtained by polymerizing a composition containing an electron transport material, a cross-linking agent, and a resin. Further, in Japanese Patent Application Laid-Open Nos. 2007-148294 and 2008-250082, there is disclosed a technology involving incorporating an electron transport material into the undercoat layer. There is also disclosed a technology involving curing the undercoat layer so that, when the electron transport material is incorporated into the undercoat layer, the electron transport material is not eluted into a solvent in an application liquid for a photosensitive layer during the formation of a photosensitive layer serving as an upper layer of the undercoat layer.

SUMMARY OF THE INVENTION

The undercoat layer in the related art currently satisfies required image quality.

In recent years, there is a demand for a further increase in image quality, and as an effective method, there is given thinning of a hole transporting layer. This is because, when the hole transporting layer is thinned, the diffusion of charge during the formation of an electrostatic latent image can be suppressed.

Investigations made by the inventors of the present invention have found that, in the case where the hole transporting layer is thinned and the undercoat layer of Japanese Patent Application Laid-Open No. 2014-029480 is used, the occurrence of an image defect such as a black dot can be suppressed although a phenomenon of an increase in dark attenuation is observed. However, the investigations have found that a phenomenon of a significant decrease in sensitivity may be caused as the hole transporting layer is thinned, and thus the image quality is susceptible to improvement.

Further, the inventors of the present invention have made investigations regarding the reduction in positive ghost, and as a result, have found that, in the technology disclosed in Japanese Patent Application Laid-Open Nos. 2007-148294 and 2008-250082, the suppression (reduction) of the positive ghost, in particular, a fluctuation of a positive ghost level before and after continuous image output is still susceptible to improvement.

An object of the present invention is to provide an electrophotographic photosensitive member in which the occurrence of an image defect such as a black dot is suppressed and the sensitivity is increased even when a hole transporting layer is thinned, and a process cartridge and an electrophotographic apparatus each including the electrophotographic photosensitive member. Another object of the present invention is to provide an electrophotographic photosensitive member in which a positive ghost is suppressed, and a process cartridge and an electrophotographic apparatus each including the electrophotographic photosensitive member.

According to a first embodiment of the present invention, there is provided an electrophotographic photosensitive member, including:

a laminated body; and a hole transporting layer on the laminated body, in which:

the laminated body includes:

a support;

an undercoat layer having a thickness of d1 (μm), on the support; and a charge generating layer having a thickness of d2 (μm), on the undercoat layer, and the hole transporting layer has a thickness of 15 μm or less;

the undercoat layer includes a polymerized product of a composition including an electron transport material represented by the following formula (1), a cross-linking agent, and a thermoplastic resin having a polymerizable functional group:

$$Z^1—X—Z^2 \quad (1)$$

in the formula (1):

$Z^1$ and $Z^2$ each represent a group having an electron transport property;

X represents a linking group, and the linking group is a substituted or unsubstituted alkylene group, a substituted or unsubstituted arylene group, a substituted or unsubstituted heterocyclic group, or a group derived by substituting one of methylene groups in a main chain of the substituted or unsubstituted alkylene group with $R^1$, the $R^1$ representing an oxygen atom, a sulfur atom, $SO_2$, $NR^2$, CO, or a substituted or unsubstituted arylene group, the $R^2$ representing a hydrogen atom, an alkyl group, or an aryl group; and at least one of $Z^1$, $Z^2$, and X has a polymerizable functional group, and the polymerizable functional group is a hydroxyl group, a thiol group, an amino group, a carboxyl group, or a methoxy group;

the laminated body satisfies the following expressions (2) and (4):

$$0.20 \leq |Vd2 - Vd1| \leq 2.0 \quad (2)$$

$$Vd1 = -100 \times (d1 + d2) \quad (4)$$

in which Vd1 represents a potential of a surface of the charge generating layer after 1.0 second from charging of the charge generating layer by corona charging, and Vd2 represents a potential of the surface of the charge generating layer after 0.80 second from the charging of the charge generating layer by the corona charging; and $\tau$ satisfies the following expression (3):

$$\tau \leq 10 \quad (3)$$

in the expression (3), $\tau$ represents transit time (ms) determined based on a time change rate of the potential of the surface of the charge generating layer after the surface of the charge generating layer which has a potential of Vd1 (V) is exposed to light, the light having an intensity adjusted so that the potential of the surface of the charge generating layer after 0.04 second from the exposure decays by 20% with respect to Vd1 (V).

According to a second embodiment of the present invention, there is provided an electrophotographic photosensitive member, including:

a support;

an undercoat layer on the support; and a photosensitive layer on the undercoat layer, in which the undercoat layer includes a polymerized product of one of the following (i) and (ii):

(i): a polymerized product of a compound represented by the following formula (11); and (ii): a polymerized product of a composition containing the compound represented by the formula (11) and a cross-linking agent:

(11)

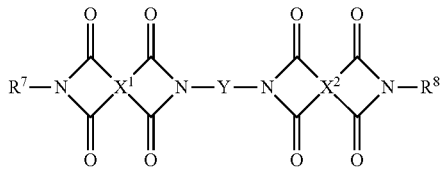

in the formula (11), $X^1$ and $X^2$ each independently represent a residue obtained by removing four carboxyl groups from a substituted or unsubstituted aromatic tetracarboxylic acid, and when the residue has a substituent, the substituent is a halogen atom, a cyano group, a nitro group, a substituted or unsubstituted alkyl group, or a substituted or unsubstituted aryl group;

Y represents a substituted or unsubstituted alkylene group having a polymerizable functional group or a substituted or unsubstituted arylene group having a polymerizable functional group; and $R^7$ and $R^8$ each independently represent a substituted or unsubstituted alkyl group, a group derived by substituting one of methylene groups of the substituted or unsubstituted alkyl group with an oxygen atom, a group derived by substituting one of the methylene groups of the substituted or unsubstituted alkyl group with a sulfur atom, a group derived by substituting one of the methylene groups of the substituted or unsubstituted alkyl group with $NR^9$, a substituted or unsubstituted aryl group, a substituted or unsubstituted heterocyclic group, or an alkoxycarbonyl group, and $R^7$ and $R^8$ may each have a polymerizable functional group, provided that the oxygen atom, the sulfur atom, and the $NR^9$ are free from being directly bonded to nitrogen atoms to which $R^7$ and $R^8$ are bonded.

The present invention also relates to a process cartridge, including: the electrophotographic photosensitive member; and at least one unit selected from the group consisting of a charging unit, a developing unit, and a cleaning unit, the process cartridge integrally supporting the electrophotographic photosensitive member and the at least one unit, the process cartridge being removably mounted onto an electrophotographic apparatus.

The present invention also relates to an electrophotographic apparatus, including: the electrophotographic photosensitive member; a charging unit; an exposing unit; a developing unit; and a transferring unit.

According to the first embodiment of the present invention, the electrophotographic photosensitive member in which the occurrence of an image defect such as a black dot is suppressed and the sensitivity is increased even when the hole transporting layer is thinned, and the process cartridge and the electrophotographic apparatus each including the electrophotographic photosensitive member can be provided.

According to the second embodiment of the present invention, the electrophotographic photosensitive member in which a positive ghost is suppressed, and the process cartridge and the electrophotographic apparatus each including the electrophotographic photosensitive member can be provided.

Further features of the present invention will become apparent from the following description of exemplary embodiments with reference to the attached drawings.

DESCRIPTION OF THE EMBODIMENTS

Figure 1:
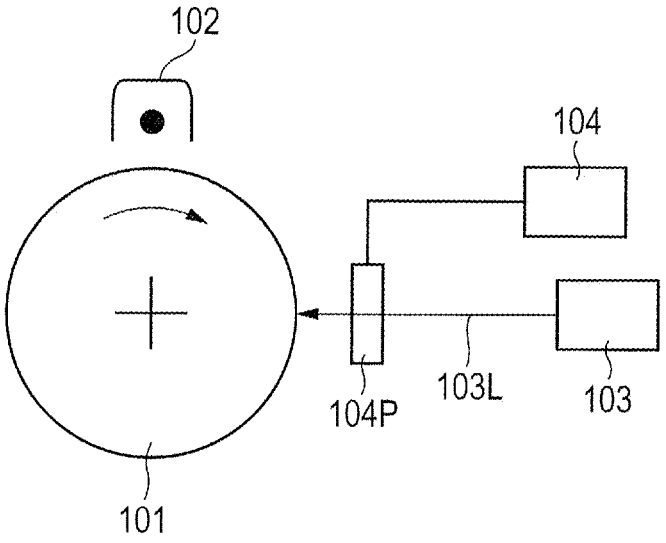
FIG. 1 is a view for illustrating an example of a schematic configuration of a determination device for performing a determination method of the present invention.

Preferred embodiments of the present invention will now be described in detail in accordance with the accompanying drawings.

An electrophotographic photosensitive member according to a first embodiment of the present invention includes a laminated body, and a hole transporting layer on the laminated body. The laminated body includes a support, an undercoat layer on the support, and a charge generating layer on the undercoat layer. The undercoat layer has a thickness of d1 (μm), the charge generating layer has a thickness of d2 (μm), and the hole transporting layer has a thickness of 15 μm or less.

In addition, the undercoat layer includes a polymerized product of a composition including an electron transport material represented by the formula (1), a cross-linking agent, and a thermoplastic resin having a polymerizable functional group.

$$Z^1—X—Z^2 \quad (1)$$

(In the formula (1), $Z^1$ and $Z^2$ each represent a group having an electron transport property.

X represents a linking group, and the linking group is a substituted or unsubstituted alkylene group, a substituted or unsubstituted arylene group, a substituted or unsubstituted heterocyclic group, or a group derived by substituting one of methylene groups in a main chain of the substituted or unsubstituted alkylene group with $R^1$. $R^1$ represents an oxygen atom, a sulfur atom, $SO_2$, $NR^2$, CO, or a substituted or unsubstituted arylene group. $R^2$ represents a hydrogen atom, an alkyl group, or an aryl group.

At least one of $Z^1$, $Z^2$, and X has a polymerizable functional group, and the polymerizable functional group is a hydroxyl group, a thiol group, an amino group, a carboxyl group, or a methoxy group.)

In addition, the electrophotographic photosensitive member has a feature in that the laminated body satisfies the following expressions (2) and (4):

$$0.20 \leq |Vd2 - Vd1| \leq 2.0 \quad (2)$$

$$Vd1 = -100 \times (d1 + d2) \quad (4)$$

in which Vd1 represents a potential of a surface of the charge generating layer after 1.0 second from charging of the charge generating layer by corona charging, and Vd2 represents a potential of the surface of the charge generating layer after 0.80 second from the charging of the charge generating layer by the corona charging.

Further, the electrophotographic photosensitive member also has a feature in that τ satisfies the following expression (3).

$$\tau \leq 10 \quad (3)$$

τ represents transit time (ms) determined based on a time change rate of the potential of the surface of the charge generating layer after the surface of the charge generating layer which has a potential of Vd1 (V) is exposed to light, the light having an intensity adjusted so that the potential of the surface of the charge generating layer after 0.04 second from the exposure decays by 20% with respect to Vd1 (V).

The inventors of the present invention have assumed the reason why a decrease in sensitivity is suppressed while the occurrence of a black dot is suppressed by incorporating the above-mentioned polymerized product into the undercoat layer and causing the laminated body to satisfy the expressions (2) and (3) when the thickness of the hole transporting layer is reduced as follows.

In the case of the electrophotographic photosensitive member including the support, and the undercoat layer, the charge generating layer, and the hole transporting layer which are formed on the support in the stated order, in a part irradiated with exposure light (image exposure light), holes are injected into the hole transporting layer and electrons are injected into the undercoat layer among charges (holes and electrons) generated in the charge generating layer. Then, the electrons injected into the undercoat layer are considered to be further transferred to the support. Thus, the intensity of an electric field applied to the undercoat layer, the charge generating layer, and the hole transporting layer is increased by thinning the hole transporting layer. In the undercoat layer that contains the polymerized product of the composition including the electron transport material having a polymerizable functional group, the cross-linking agent, and the resin disclosed in Japanese Patent Application Laid-Open No. 2014-029480, a uniform film is formed, and hence an image defect such as a black dot does not occur. However, as the hole transporting layer is thinned, the intensity of the electric field increases, and a phenomenon of a significant decrease in sensitivity occurs in some cases. In particular, such phenomenon tends to occur remarkably when the hole transporting layer has a thickness of 15 μm or less.

Figure 5:
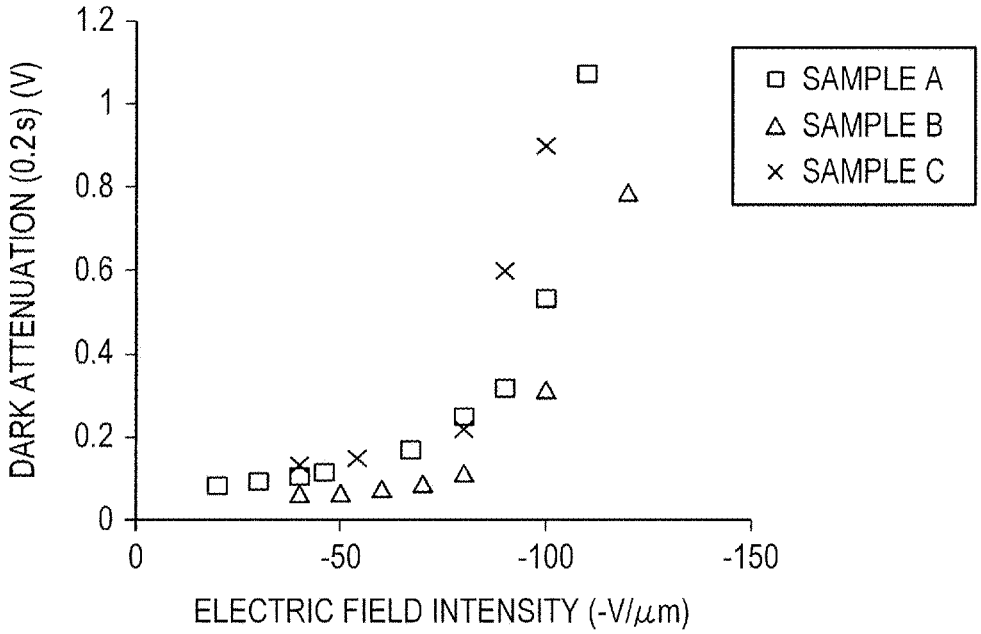
FIG. 5 is a graph for showing the expression (4).
Figure 6:
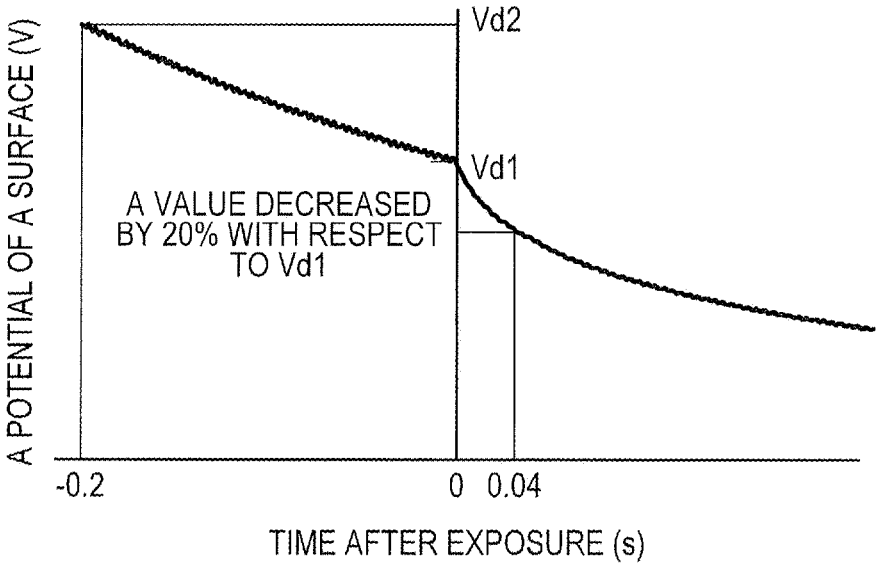
FIG. 6 is a graph for showing a comparative example in which a related-art electrophotographic photosensitive member is subjected to measurement by the determination method of the present invention.

When the time change rate of the potential of a surface is observed in the case where the electric field per unit thickness is increased as in the expression (4), dark attenuation increases as shown in FIG. 5. The inventors of the present invention have considered that the increase in dark attenuation influences the attenuation after exposure. As the reason why the sensitivity is decreased due to the large dark attenuation, the inventors of the present invention have assumed that the influence of heat carriers generated in the charge generating layer becomes nonnegligible to inhibit the transfer of optical carriers. Meanwhile, the inventors of the present invention have assumed that the undercoat layer having a decrease in sensitivity suppressed even under the generation of the heat carriers is obtained by satisfying the expressions (2) and (3).

Further, the inventors of the present invention have assumed the reason why the expressions (2) and (3) can be satisfied by virtue of the undercoat layer containing the polymerized product of the composition including the electron transport material represented by the formula (1), the cross-linking agent, and the thermoplastic resin having a polymerizable functional group as follows. As one factor for inhibiting the transfer of electrons, there is known the formation of a deep trap between adjacent molecules of an electron transfer material (electron transport material). A large amount of the heat carriers enter the trap under a high electric field to exist in the undercoat layer. That is, it is considered that the heat carriers having entered the trap in the undercoat layer inhibit the transfer of the optical carriers. Then, it is considered that the trap is derived from a resin or an impurity not having an electron transfer function, and hence how a site having an electron transfer function and a site not having an electron transfer function are formed in the undercoat layer is important for the presence of the trap and the transfer of electrons in the presence of the trap. Thus, the inventors of the present invention have considered that, by virtue of the configuration of the undercoat layer of the present invention, the formation of the polymerized product and the structurally appropriate distance between the adjacent molecules of the electron transport material can prevent the heat carriers from entering the trap and suppress the inhibition of the transfer of electrons even in the presence of the trap.

Now, the configuration of the undercoat layer and the expressions (2) and (3) are described. First, a determination method of determining whether or not the electrophotographic photosensitive member satisfies the expressions (2)

and (3) of the present invention (hereinafter sometimes referred to as "determination method of the present invention") is described.

It is sufficient that the temperature and humidity conditions for performing the determination method of the present invention be under an environment in which an electrophotographic apparatus including the electrophotographic photosensitive member is used. The temperature and humidity conditions are preferably under an ordinary temperature and ordinary humidity environment (23±3° C., 50±2% RH).

The above-mentioned measurement method is performed through use of the laminated body including the support, the undercoat layer on the support, and the charge generating layer on the undercoat layer.

In the case where the undercoat layer contains the electron transport material, when the charge generating layer and the hole transporting layer each serving as an upper layer are formed by applying an application liquid for a charge generating layer and an application liquid for a hole transporting layer, the electron transport material may be eluted out. In such electrophotographic photosensitive member, the electron transport material is eluted, and hence it is considered that the original transfer of electrons in the undercoat layer cannot be sufficiently evaluated.

Thus, it is necessary that the charge generating layer and the hole transporting layer be formed on the undercoat layer, then the hole transporting layer be peeled to obtain a laminated body including the undercoat layer and the charge generating layer, and the laminated body be subjected to determination.

Further, a black dot is liable to occur in undercoat layers having low uniformity such as an undercoat layer containing an electron transport material as a pigment and an undercoat layer in which metal oxide particles are dispersed. The undercoat layer in which a black dot occurs as described above may not be charged to Vd1 in the determination method of the present invention. Based on this, it is considered that a black dot can be suppressed when the laminated body after the peeling of the hole transporting layer can be charged to Vd1.

Therefore, it is preferred that the hole transporting layer be peeled from the electrophotographic photosensitive member including the laminated body and the hole transporting layer on the laminated body and the resultant be subjected to determination. As a method of peeling the hole transporting layer, there are given, for example, a method involving immersing the electrophotographic photosensitive member in a solvent which dissolves the hole transporting layer and is unlikely to dissolve the undercoat layer and the charge generating layer, to thereby peel the hole transporting layer and a method involving grinding the hole transporting layer.

As the solvent which dissolves the hole transporting layer and is unlikely to dissolve the undercoat layer and the charge generating layer, it is preferred to use a solvent to be used for the application liquid for a hole transporting layer. The kind of the solvent is described later. The electrophotographic photosensitive member is immersed in the solvent to dissolve the hole transporting layer, followed by being dried, and thus the above-mentioned laminated body can be obtained. It can be confirmed that the hole transporting layer has been peeled, for example, based on the fact that a resin component of the hole transporting layer is not observed by an attenuated total reflection method (ATR method) in a FTIR measurement method.

Figure 8:
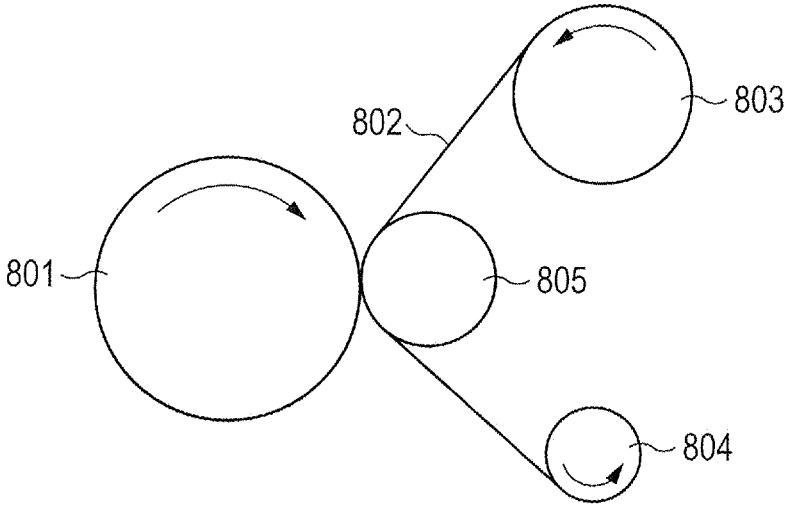
FIG. 8 is a schematic sectional view of a grinding device.

Further, the method involving grinding the hole transporting layer is performed, for example, through use of a wrapping tape (C2000, manufactured by Fujifilm Corporation) in a drum grinding device. A schematic sectional view of the grinding device is illustrated in FIG. 8. A wrapping tape 802 is fed from a feed roller 803 to be taken up by a take-up roller 804 and is moved at a constant speed. The wrapping tape 802 is pressed with a rubber roller 805 to grind an electrophotographic photosensitive member 801. An entire surface of the electrophotographic photosensitive member 801 can be uniformly ground within a short period of time by vibrating the rubber roller 805. In this case, it is preferred to: successively measure the thickness so as to prevent the hole transporting layer from being ground excessively to grind the charge generating layer; and perform the measurement at a site where the hole transporting layer is entirely eliminated while observing the surface of the electrophotographic photosensitive member. Further, it has been confirmed that when the thickness of the charge generating layer is 0.10 μm or more after the grinding is performed to the charge generating layer, substantially the same value is obtained in the above-mentioned measurement method as compared to the case where the charge generating layer is not ground. Therefore, even when the charge generating layer as well as the hole transporting layer is ground, in the case where the thickness of the charge generating layer is 0.10 μm or more, the above-mentioned measurement method can be used.

FIG. 1 is a view for illustrating an example of a schematic configuration of a determination device for performing the determination method of the present invention. A cylindrical laminated body 101 is driven to rotate in the arrow direction and is stopped at a position of a transparent probe 104P that transmits pulse light 103L. At the time of the stop, the potential of a surface of the laminated body 101 is started to be measured with a potentiometer 104 which measures the potential of a surface of the charge generating layer of the laminated body 101 and the transparent probe 104P. After that, the pulse light (image exposure light) 103L oscillated from a device configured to oscillate pulse laser light (image exposure oscillation device) 103 passes through the transparent probe 104P to expose the laminated body 101 to light, and thus the time change rate of the potential of the surface of the charge generating layer is measured.

Figure 2:
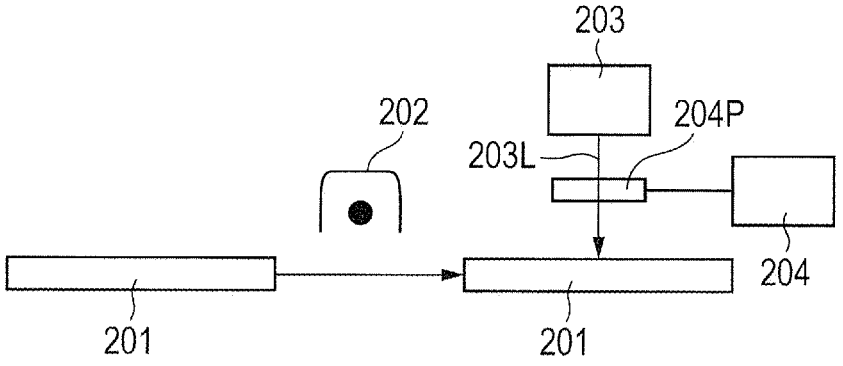
FIG. 2 is a view for illustrating another example of the schematic configuration of the determination device for performing the determination method of the present invention.

FIG. 2 is a view for illustrating another example of the schematic configuration of the determination device for performing the determination method of the present invention. A sheet-shaped laminated body 201 is driven in the arrow direction and is stopped at a position of a transparent probe 204P that transmits pulse light 203L. At the time of the stop, the potential of a surface of the laminated body 201 is started to be measured with a potentiometer 204 which measures the potential of a surface of the charge generating layer of the laminated body 201 and the transparent probe 204P. After that, the pulse light (image exposure light) 203L oscillated from a device configured to oscillate pulse laser light (image exposure oscillation device) 203 passes through the transparent probe 204P to expose the laminated body 201 to light, and thus the time change rate of the potential of the surface of the charge generating layer is measured.

The position of a corona charger 102 (202), the position of exposure, and the movement speed of the laminated body are set so that a period of time between the charging by the corona charger 102 (202) and the light irradiation (also referred to as exposure) with the pulse light 103L (203L) is 1.00 second. As the corona charger 102 (202), a scorotron charger having a characteristic of applying a constant potential is preferably used. It is preferred that laser pulse light having a wavelength of 780 nm and a pulse width of 1 μs be used as the pulse light 103L (203L), and the light amount be adjusted with an ND filter. That is, exposure time is 1 μs (microsecond).

Next, the expressions (2) to (4) are described.

Figure 3A:
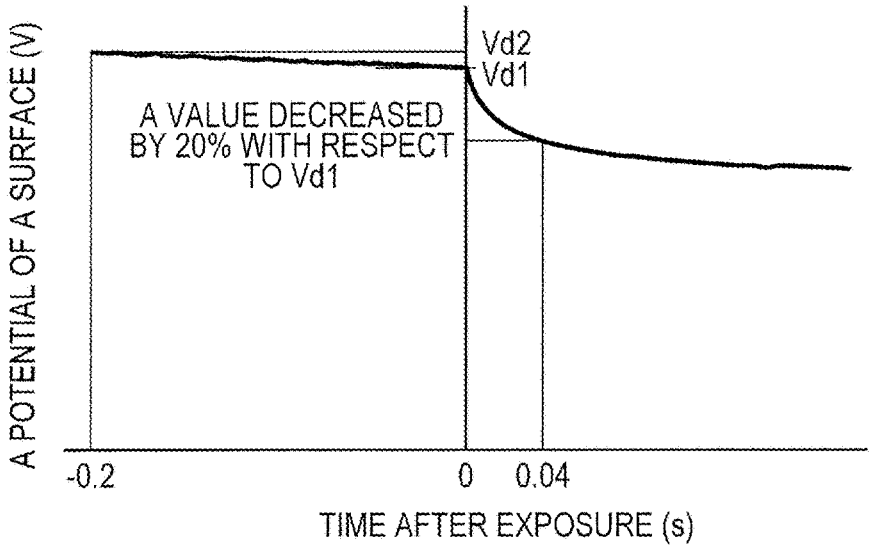
FIG. 3A is a graph for showing the expression (2).
Figure 3B:
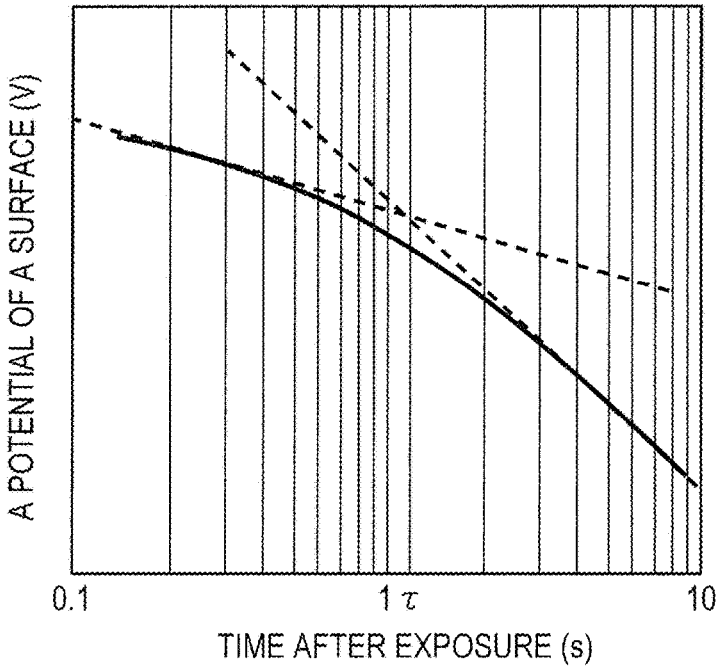
FIG. 3B is a graph for showing the expression (3).

FIG. 3A and FIG. 3B are graphs for showing Vd1, Vd2, and τ in the expressions (2) and (3).

The following charging conditions C and light E are determined before determining whether or not the electrophotographic photosensitive member satisfies the expressions (2) and (3).

<Charging Conditions C>

The conditions for charging the surface of the charge generating layer of the laminated body are set as follows. The value of a grid voltage to be applied to the corona charger and the value of a current of a discharge wire are adjusted so that the potential of a surface of the charge generating layer after 1.00 second from the charging by the corona charger is Vd1 (V) represented by the expression (4). The value of the grid voltage and the value of the current of the discharge wire are defined as the charging conditions C.

$$Vd1=-100\times(d1+d2) \quad (4)$$

<Light E>

The surface of the charge generating layer is charged so that the potential of a surface of the charge generating layer is Vd1 (V) represented by the expression (4) under the charging conditions C. Then, the intensity of light is adjusted with the ND filter so that the potential of a surface of the electrophotographic photosensitive member after 0.04 second from the exposure to laser light having a wavelength of 780 nm for 1 microsecond decays by 20% with respect to Vd1 (V). Light set to this intensity is defined as light E.

FIG. 3A is a graph of an attenuation curve for showing a time change rate of the potential of a surface of the charge generating layer of the laminated body 101 when charged under the charging conditions C and irradiated with the light E after 1.00 second from the charging. Vd2 represents the potential of a surface of the charge generating layer after 0.80 second from the charging, that is, the potential of the surface of the charge generating layer before 0.20 second from the time when the charge generating layer is charged to a potential of a surface of Vd1 (V). Vd2 also represents the potential of the surface of the charge generating layer before 0.20 second from the exposure of the surface of the charge generating layer to the light E. In the present invention, the potential of the surface of the charge generating layer of the laminated body 101 is measured after the laminated body 101 is stopped by the method illustrated in FIG. 1 and FIG. 2. Therefore, the laminated body 101 is driven immediately after the charging by the corona charger, and hence the potential of the surface of the charge generating layer of the laminated body 101 cannot be measured. Thus, it is necessary to measure the amount of dark attenuation represented by the expression (2) under a state in which the laminated body 101 is stopped. In the present invention, the potential of a surface is measured during 0.20 second from 0.80 second to 1.00 second after the charging by the corona charger.

Vd2 and τ can be measured by setting the charging conditions C and the intensity of the light E as described above.

Figure 4A:
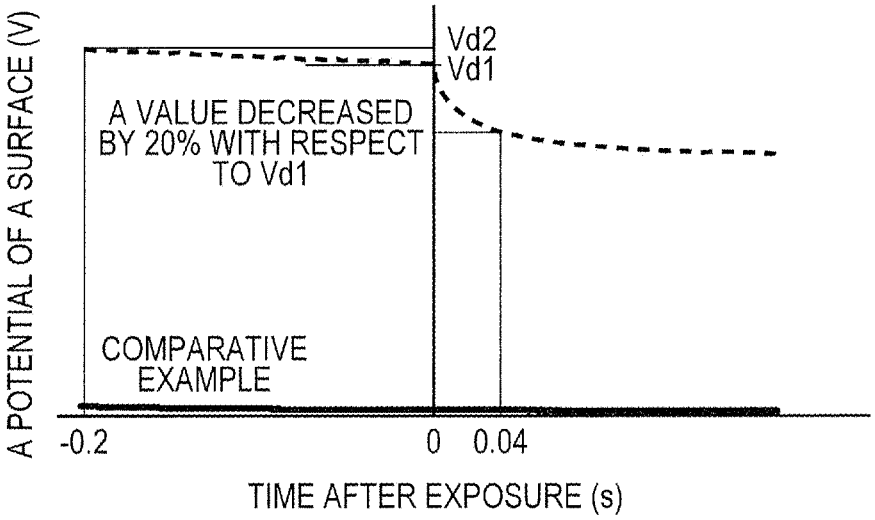
FIG. 4A is a graph for showing a comparative example in which charging and light amount setting cannot be performed by the determination method of the present invention.

In the case where the charging conditions C and the intensity of the light E cannot be set, the determination method of the present invention cannot be satisfied. FIG. 4A is a graph for showing an example in which the charging conditions C cannot be set, and in a comparative example represented by the solid line, the charging conditions C cannot be set. This is an example in which the charging ability of the charge generating layer is not sufficient, and hence the charge generating layer after 1.00 second from the charging cannot be charged to a potential of a surface of Vd1 (V) represented by the expression (4).

Figure 4B:
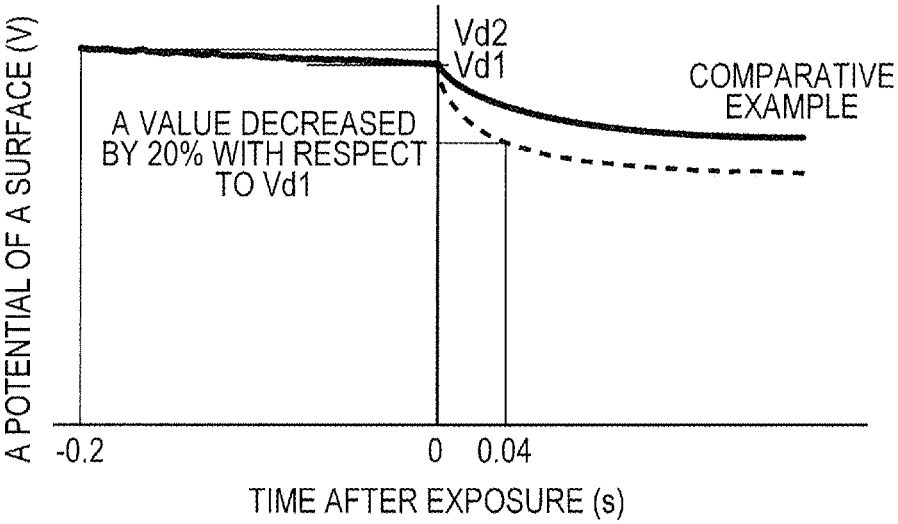
FIG. 4B is a graph for showing a comparative example in which charging and light amount setting cannot be performed by the determination method of the present invention.

FIG. 4B is a graph for showing an example in which the light E cannot be set, and in a comparative example represented by the solid line, the light E cannot be set. This is an example in which the electron transfer function is not sufficient, and hence the potential of a surface of the charge generating layer after 0.04 second after the exposure cannot decay by 20% with respect to Vd1 (V) even when the intensity of light is increased.

Vd1 (V) represented by the expression (4) means that the potential of the surface of the charge generating layer is set so as to be −100 V per unit thickness (μm) with respect to the total thickness (μm) of the undercoat layer having a thickness d1 and the charge generating layer having a thickness d2.

|Vd2-Vd1| in the expression (2) represents a dark attenuation amount in the case where a sufficiently strong electric field is applied to the laminated body. FIG. 5 is a graph for showing an electric field per unit thickness and a dark attenuation amount during 0.2 second (0.2 s). It is understood that the dark attenuation amount abruptly increases at an electric field intensity of from about −70 V/μm to −80 V/μm.

$$0.2\leq|Vd2-Vd1|\leq2.0 \quad (2)$$

The potential of a surface of −100 V per unit thickness is a sufficiently strong electric field in the case where an increase in electric field applied to the laminated body caused by thinning of the hole transporting layer is assumed.

The expression (3) represents transit time τ (ms) determined based on a time change rate of the potential of the surface of the charge generating layer after the surface of the charge generating layer which has a potential of a surface of Vd1 (V) is exposed to the light E. The transit time τ is determined with reference to a Xerographic TOF (XTOF) method disclosed in, for example, Japanese Patent Application Laid-Open No. 2006-251554 and Journal of Society of Electrophotography of Japan, Vol. 22, No. 1 (1983), page 69 to 76. Specifically, the attenuation curve (FIG. 3A) for showing a time change rate of the potential of the surface of the charge generating layer is subjected to logarithmic conversion with respect to the relationship with temporal differentiation of the potential of a surface during a period of time from the exposure (0 seconds) to 0.1 second (100 milliseconds) thereafter to obtain a waveform shown in FIG. 3B. The waveform shown in FIG. 3B is assumed to be formed of two straight lines, and the two straight lines are obtained by straight-line approximation through use of a least-square method. Time elapsed from the exposure of the intersection of the two straight lines obtained by the straight-line approximation through use of the least-square method is defined as τ (transit time). If the obtained waveform does not clearly have a bending point, the transit time can be defined by the logarithmic conversion of the attenuation curve after 0.1 second after the exposure.

The transit time τ in the expression (3) represents a value showing time required for an electron generated in the charge generating layer immediately after the exposure to be injected into the undercoat layer and transferred therein to reach the support. In the case where τ is small, the time required for the electron to reach the support is short, which means that the sensitivity of the electrophotographic photosensitive member is high. In the case where τ is large, the time required for the electron to reach the support is long, which means that the sensitivity of the electrophotographic photosensitive member is low. In the present invention, when $\tau$ is 10 or less, high sensitivity is obtained. Further, $\tau$ that satisfies the expression (5) is more preferred.

$$0.01 \leq \tau \leq 2 \quad (5)$$

From the foregoing, when the expressions (2) and (3) are satisfied, even when dark attenuation is increased due to the application of a strong electric field, the electrons are transferred fast, and sufficiently high sensitivity is obtained.

A second embodiment of the present invention relates to an electrophotographic photosensitive member, including: a support; an undercoat layer on the support; and a photosensitive layer on the undercoat layer. In addition, the electrophotographic photosensitive member has a feature in that the undercoat layer includes a polymerized product of one of the following (i) and (ii):

(i): a polymerized product of a compound represented by the following formula (11); and (ii): a polymerized product of a composition containing the compound represented by the formula (11) and a cross-linking agent.

(11)

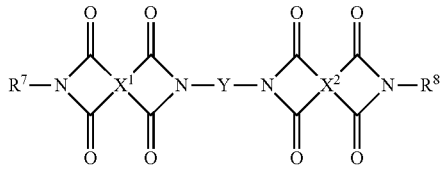

In the formula (11), $X^1$ and $X^2$ each independently represent a residue obtained by removing four carboxyl groups from a substituted or unsubstituted aromatic tetracarboxylic acid. When the residue has a substituent, the substituent is a halogen atom, a cyano group, a nitro group, a substituted or unsubstituted, linear or branched alkyl group, or a substituted or unsubstituted aryl group.

Y represents a substituted or unsubstituted alkylene group having a polymerizable functional group or a substituted or unsubstituted arylene group having a polymerizable functional group.

$R^7$ and $R^8$ each independently represent a substituted or unsubstituted, linear or branched alkyl group, a group derived by substituting one of methylene groups of the substituted or unsubstituted, linear or branched alkyl group with an oxygen atom, a group derived by substituting one of the methylene groups of the substituted or unsubstituted, linear or branched alkyl group with a sulfur atom, a group derived by substituting one of the methylene groups of the substituted or unsubstituted, linear or branched alkyl group with $NR^9$, a substituted or unsubstituted aryl group, a substituted or unsubstituted heterocyclic group, or an alkoxycarbonyl group. $R^7$ and $R^8$ may each have a polymerizable functional group. It should be noted that the oxygen atom, the sulfur atom, and the $NR^9$ are free from being directly bonded to nitrogen atoms to which $R^7$ and $R^8$ are bonded.

The inventors of the present invention have assumed the reason why the electrophotographic photosensitive member including the undercoat layer containing the polymerized product according to the present invention is particularly excellent in the effect of suppressing a positive ghost as follows. The compound of the present invention includes a spacer between two electron transporting sites. Further, the spacer has a polymerizable functional group. Therefore, it is considered that polymerization is performed with respect to the center of the compound, two electron transporting sites exist at an equal interval, and the electron transporting sites exist uniformly in the polymerized product. Therefore, it is considered that the transport of electrons by intermolecular hopping is enhanced, and the high effect of suppressing a positive ghost that is caused by the residence of the electrons is obtained.

[Undercoat Layer]

The undercoat layer contains the polymerized product of the composition including the electron transport material represented by the formula (1), the cross-linking agent, and the thermoplastic resin having a polymerizable functional group. In the polymerized product, the electron transport material represented by the formula (1) may contain the above-mentioned polymerized product of (i) or (ii).

In $Z^1$ and $Z^2$ of the electron transport material represented by the formula (1), the group having an electron transport property refers to a group having a structure having an electron transport property. Examples of the structure having an electron transport property include a quinone structure, an imide structure, a benzimidazole structure, and a cyclopentadienylidene structure.

Now, specific examples of the group having an electron transport property are shown. There are given groups each represented by any one of the following formulae (A1) to (A10).

(A1)

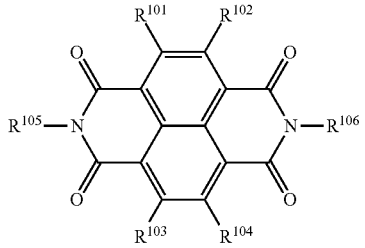

(A2)

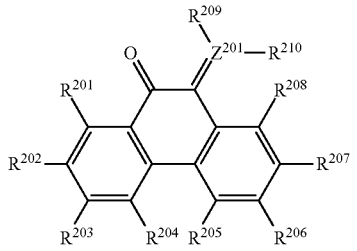

(A3)

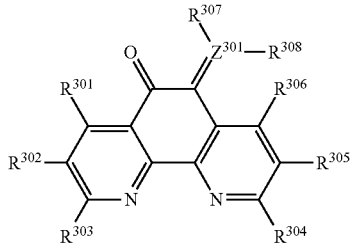

-continued (A4)

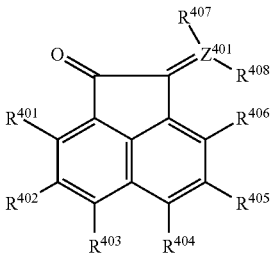

(A5)

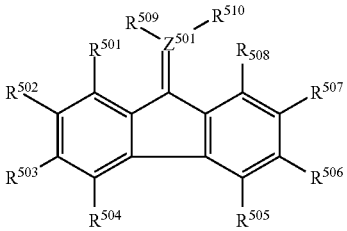

(A6)

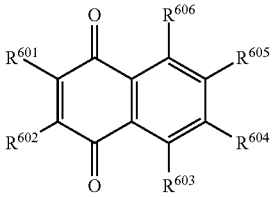

(A7)

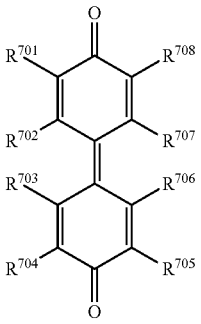

(A8)

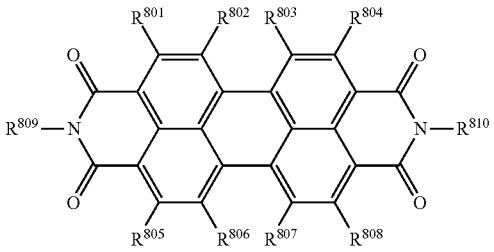

(A9)

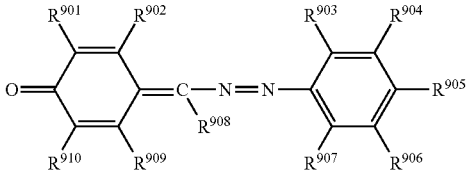

-continued (A10)

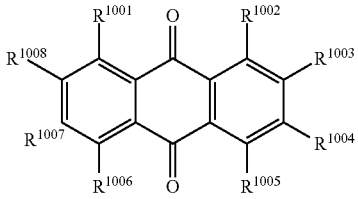

In the formulae (A1) to (A10), any one of $R^{101}$ to $R^{106}$, any one of $R^{201}$ to $R^{210}$, any one of $R^{301}$ to $R^{308}$, any one of $R^{401}$ to $R^{408}$, any one of $R^{501}$ to $R^{510}$, any one of $R^{601}$ to $R^{606}$, any one of $R^{701}$ to $R^{708}$, any one of $R^{801}$ to $R^{80}$, any one of $R^{901}$ to $R^{910}$, or any one of $R^{1001}$ to $R^{1008}$ represents a bonding site (single bond) for bonding to X.

In the formulae (A1) to (A10), $R^{101}$ to $R^{106}$, $R^{201}$ to $R^{210}$, $R^{301}$ to $R^{308}$, $R^{401}$ to $R^{408}$, $R^{501}$ to $R^{510}$, $R^{601}$ to $R^{606}$, $R^{701}$ to $R^{708}$, $R^{801}$ to $R^{810}$, $R^{901}$ to $R^{910}$, and $R^{1001}$ to $R^{1008}$ each independently represent a single bond, a group represented by the following formula (A), a hydrogen atom, a cyano group, a nitro group, a halogen atom, an alkoxycarbonyl group, a substituted or unsubstituted alkyl group, a substituted or unsubstituted aryl group, a substituted or unsubstituted heterocyclic group, or a group derived by substituting one of methylene groups in a main chain of the substituted or unsubstituted alkyl group with $R^3$. $R^3$ represents an oxygen atom, a sulfur atom, or $NR^{1101}$ ($R^{1101}$ represents a hydrogen atom or an alkyl group).

A substituent of the substituted alkyl group is an alkyl group, an aryl group, a halogen atom, or an alkoxycarbonyl group. A substituent of the substituted aryl group and a substituent of the substituted heterocyclic group are each a halogen atom, a nitro group, a cyano group, an alkyl group, a halogen-substituted alkyl group, or an alkoxy group.

$Z^{201}$, $Z^{301}$, $Z^{401}$, and $Z^{501}$ each independently represent a carbon atom, a nitrogen atom, or an oxygen atom. $R^{209}$ and $R^{210}$ are absent when $Z^{201}$ represents the oxygen atom, and $R^{210}$ is absent when $Z^{201}$ represents the nitrogen atom. $R^{307}$ and $R^{308}$ are absent when $Z^{301}$ represents the oxygen atom, and $R^{308}$ is absent when $Z^{301}$ represents the nitrogen atom. $R^{407}$ and $R^{408}$ are absent when $Z^{401}$ represents the oxygen atom, and $R^{408}$ is absent when $Z^{401}$ represents the nitrogen atom. $R^{509}$ and $R^{510}$ are absent when $Z^{501}$ represents the oxygen atom, and $R^{510}$ is absent when $Z^{501}$ represents the nitrogen atom.

$$\text{-}(\alpha)_l\text{-}(\beta)_m\text{-}\gamma \qquad \text{(A)}$$

In the formula (A), at least one of α, β, and γ represents a group having a polymerizable functional group. As described above, the polymerizable functional group is a hydroxyl group, a thiol group, an amino group, a carboxyl group, or a methoxy group. 1 and m each independently represent 0 or 1, and the sum of 1 and m is 0 or more and 2 or less.

α represents a substituted or unsubstituted alkylene group having in its main chain 1 to 6 atoms or a group derived by substituting one of methylene groups in the main chain of the substituted or unsubstituted alkylene group with $R^4$, and these groups may each have a polymerizable functional group. $R^4$ represents an oxygen atom, a sulfur atom, or $NR^{1102}$ ($R^{1102}$ represents a hydrogen atom or an alkyl group). A substituent of the substituted alkylene group is an alkyl group having 1 to 6 carbon atoms, a benzyl group, an alkoxycarbonyl group, or a phenyl group.

β represents a phenylene group, a phenylene group substituted with an alkyl having 1 to 6 carbon atoms, a nitro-substituted phenylene group, a halogen atom-substituted phenylene group, or an alkoxy group-substituted phenylene group. These groups may each have a polymerizable functional group.

γ represents a hydrogen atom, a substituted or unsubstituted alkyl group having in its main chain 1 to 6 atoms, or a group derived by substituting one of methylene groups in the main chain of the substituted or unsubstituted alkyl group with $R^5$. These groups may each have a polymerizable functional group. A substituent of the substituted alkyl group is an alkyl group having 1 to 6 carbon atoms. $R^5$ represents an oxygen atom, a sulfur atom, or $NR^{1103}$ ($R^{1103}$ represents a hydrogen atom or an alkyl group).

Now, specific examples of the groups each represented by any one of the formulae (A1) to (A10) are shown. In Table 1, $A^1$ and $A^2$ are groups each represented by the formula (A). In Table 1, in the case where γ is "-", γ represents a hydrogen atom, and the hydrogen atom of γ is shown in a state of being included in a structure in the column of "α" or "β". In Table 1, "*" represents a bonding site (single bond) for bonding to X.

TABLE 1

| Exemplified Compound | $R^{101}$ | $R^{102}$ | $R^{103}$ | $R^{104}$ | $R^{105}$ | $R^{106}$ |
|---|---|---|---|---|---|---|
| A101 | H | H | H | H | * | $A^1$ |
| A102 | * | H | H | H | 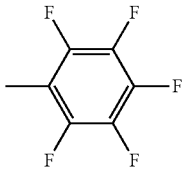 | $A^1$ |
| A103 | H | H | H | H | * | $A^1$ |
| A104 | H | H | H | H | * | $A^1$ |
| A105 | H | H | H | H | * | $A^1$ |
| A106 | H | A | H | H | * | H |
| A107 | H | H | H | H | * | $A^1$ |
| A108 | H | * | H | H | H | $A^1$ |
| A109 | H | H | H | H | * | $A^1$ |
| A110 | H | H | H | H | * | $A^1$ |
| A111 | H | H | H | H | * | $A^1$ |
| A112 | H | H | H | H | * | $A^1$ |
| A113 | H | H | H | H | * | $A^1$ |
| A114 | H | H | H | H | * | $A^1$ |
| A115 | H | H | H | H | * | $A^1$ |
| A116 | H | * | H | H | $A^1$ | $A^2$ |
| A117 | * | H | H | H | $A^1$ | $A^2$ |
| A118 | H | H | H | H | * | $A^1$ |
| A119 | H | H | H | H | * | $A^1$ |
| A120 | H | H | H | H | * | $A^1$ |
| A121 | H | H | H | H | * | H |
| A122 | H | H | H | H | * | 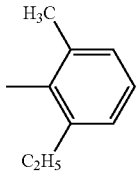 |
| A123 | H | H | H | H | * | 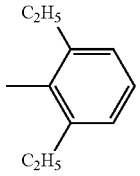 |

| Exemplified Compound | $A^1$ α | $A^1$ β | $A^1$ Y | $A^2$ α | $A^2$ β | $A^2$ Y |
|---|---|---|---|---|---|---|
| A101 | 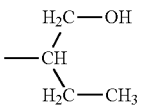 | — | — | — | — | — |

TABLE 1-continued
| | | | | | | |
|---|---|---|---|---|---|---|
| A102 | 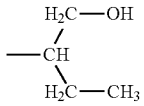 | — | — | — | — | — |
| A103 | — | 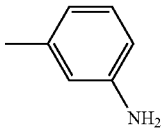 | — | — | — | — |
| A104 | — | 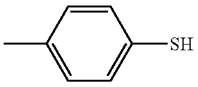 | — | — | — | — |
| A105 | 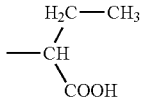 | — | — | — | — | — |
| A106 | — | 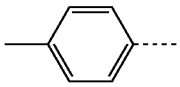 | ----$CH_2$—OH | — | — | — |
| A107 | 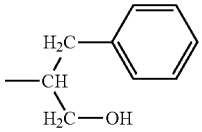 | — | — | — | — | — |
| A108 | 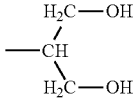 | — | — | — | — | — |
| A109 | 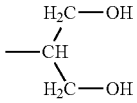 | — | — | — | — | — |
| A110 | 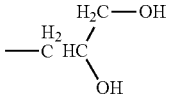 | — | — | — | — | — |
| A111 | — | 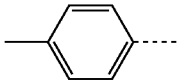 | ----$CH_2$—OH | — | — | — |
| A112 | —$CH_2$—OH | — | — | — | — | — |
| A113 | 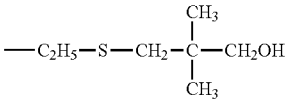 | — | — | — | — | — |
| A114 | 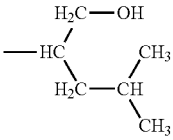 | — | — | — | — | — |
| A115 | —$C_2H_4$—S—$C_2H_4$—OH | — | — | — | — | — |

TABLE 1-continued
| | | | | | | |
|---|---|---|---|---|---|---|
| A116 | 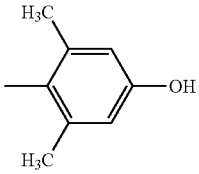 | — | — | 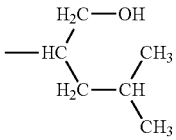 | — | — |
| A117 | — | 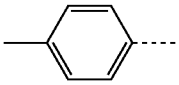 | ----$CH_2$—OH | 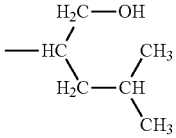 | — | — |
| A118 | 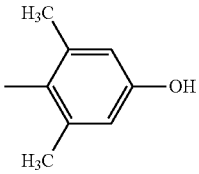 | — | — | — | — | — |
| A119 | 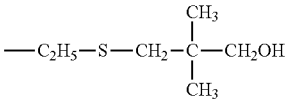 | — | — | — | — | — |
| A120 | 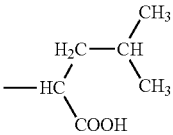 | — | — | — | — | — |
| A121 | — | — | — | — | — | — |
| A122 | — | — | — | — | — | — |
| A123 | — | — | — | — | — | — |
TABLE 2
| Exemplified Compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $R^{201}$ | $A^1$ α | $A^1$ β | $A^1$ Y |
|---|---|---|---|---|---|---|---|---|---|---|---|---|---|---|
| A201 | H | H | $A^1$ | H | H | * | H | H | — | — | O | — | 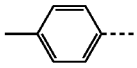 | ----$CH_2$—OH |
| A202 | H | H | * | H | H | H | H | H | $A^1$ | — | N | — | 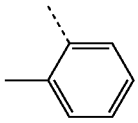 | $H_2C$—OH / ----$CH_2$ |
| A203 | H | H | 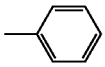 | H | H | $A^1$ | H | H | * | — | N | — | 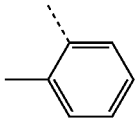 | $H_2C$—OH / ----$CH_2$ |
| A204 | H | H | 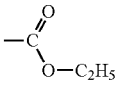 | H | * | 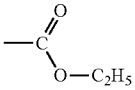 | H | H | $A^1$ | — | N | — | 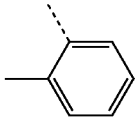 | $H_2C$—OH / ----$CH_2$ |

TABLE 2-continued

| Exemplified Compound | $R^{201}$ | $R^{202}$ | $R^{203}$ | $R^{204}$ | $R^{205}$ | $R^{206}$ | $R^{207}$ | $R^{208}$ | $R^{209}$ | $R^{210}$ | $R^{201}$ | $A^1$ α | $A^1$ β | $A^1$ Y |
|---|---|---|---|---|---|---|---|---|---|---|---|---|---|---|
| A205 | H | H | $A^1$ | H | H | * | H | H | — | — | O | — | 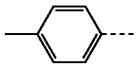 | ----$CH_2$—OH |
| A206 | H | $A^1$ | H | H | H | H | * | H | — | — | O | — | 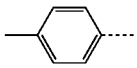 | ----$CH_2$—OH |
| A207 | H | * | H | H | H | H | H | H | $A^1$ | — | N | | 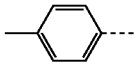 | ----$CH_2$—OH |

TABLE 3

| Exemplified Compound | $R^{301}$ | $R^{302}$ | $R^{303}$ | $R^{304}$ | $R^{305}$ | $R^{306}$ | $R^{307}$ | $R^{308}$ | $Z^{301}$ | $A^1$ α | $A^1$ β | $A^1$ Y |
|---|---|---|---|---|---|---|---|---|---|---|---|---|
| A301 | H | $A^1$ | H | H | * | H | — | — | O | — | 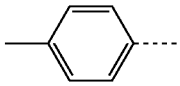 | ----$CH_2$—OH |
| A302 | H | H | * | H | H | H | $A^1$ | — | N | — | 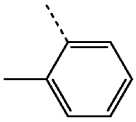 | $H_2C$—OH / ----$CH_2$ |
| A303 | H | * | H | H | H | H | $A^1$ | — | N | $H_2C$—O / —CH \ $H_2C$—$CH_3$ | — | — |
| A304 | H | * | Cl | Cl | H | H | $A^1$ | — | N | — | 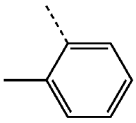 | $H_2C$—OH / ----$CH_2$ |
| A305 | H | * | H | H | $A^1$ | H | CN | CN | C | — | 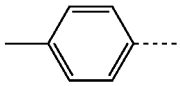 | ----$CH_2$—OH |

TABLE 4

| Exemplified Compound | $R^{401}$ | $R^{402}$ | $R^{403}$ | $R^{404}$ | $R^{405}$ | $R^{406}$ | $R^{407}$ | $R^{408}$ | $Z^{401}$ | $A^1$ α | $A^1$ β | $A^1$ Y |
|---|---|---|---|---|---|---|---|---|---|---|---|---|
| A401 | H | H | $A^1$ | H | H | * | CN | CN | C | — | 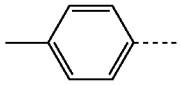 | ----$CH_2$—OH |
| A402 | H | * | H | H | H | H | $A^1$ | — | N | — | 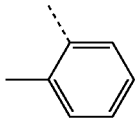 | $H_2C$—OH / ----$CH_2$ |

TABLE 4-continued

| Exemplified Compound | $R^{401}$ | $R^{402}$ | $R^{403}$ | $R^{404}$ | $R^{405}$ | $R^{406}$ | $R^{407}$ | $R^{408}$ | $Z^{401}$ | $A^1$ α | $A^1$ β | $A^1$ Y |
|---|---|---|---|---|---|---|---|---|---|---|---|---|
| A403 | H | H | $A^1$ | H | H | H | * | CN | C | — | 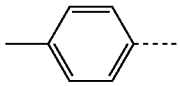 | ----$CH_2$—OH |
| A404 | H | H | H | $A^1$ | H | H | * | CN | C | — | 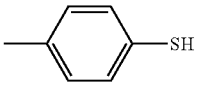 | — |
| A405 | H | H | $A^1$ | H | H | * | — | — | O | — | 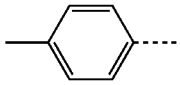 | ----$CH_2$—OH |

TABLE 5

| Exemplified Compound | $R^{501}$ | $R^{502}$ | $R^{503}$ | $R^{504}$ | $R^{505}$ | $R^{506}$ | $R^{507}$ | $R^{508}$ | $R^{509}$ | $R^{510}$ | $Z^{501}$ | $A^1$ α | $A^1$ β | $A^1$ Y |
|---|---|---|---|---|---|---|---|---|---|---|---|---|---|---|
| A501 | H | $A^1$ | H | H | H | H | * | H | CN | CN | C | — | 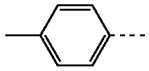 | ----$CH_2$—OH |
| A502 | H | $NO_2$ | H | H | * | H | $NO_2$ | H | $A^1$ | — | N | — | 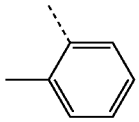 | $H_2C$—OH / ----$CH_2$ |
| A503 | H | $A^1$ | H | H | H | H | * | H | CN | CN | C | $H_2C$—OH / —CH \ $H_2C$—$CH_3$ | — | — |
| A504 | H | * | H | H | H | $A^1$ | H | H | CN | CN | C | — | 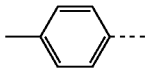 | ----$CH_2$—OH |
| A505 | H | H | * | H | H | $A^1$ | H | H | CN | CN | C | $H_2C$—OH / —$H_2$C—CH \ OH | — | — |

TABLE 6

| Exemplified Compound | $R^{601}$ | $R^{602}$ | $R^{603}$ | $R^{604}$ | $R^{605}$ | $R^{606}$ | $A^1$ α | $A^1$ β | $A^1$ Y |
|---|---|---|---|---|---|---|---|---|---|
| A601 | $A^1$ | H | H | * | H | H | — | 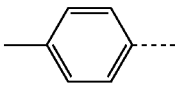 | ----$CH_2$—OH |
| A602 | $A^1$ | H | H | H | * | H | — | 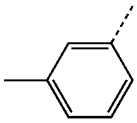 | ----$CH_2$—OH |

TABLE 6-continued

| Exemplified Compound | $R^{601}$ | $R^{602}$ | $R^{603}$ | $R^{604}$ | $R^{605}$ | $R^{606}$ | $A^1$ α | $A^1$ β | $A^1$ Y |
|---|---|---|---|---|---|---|---|---|---|
| A603 | $A^1$ | H | * | H | H | H | $H_2C—OH$ / —CH \ $H_2C—CH_3$ | — | — |
| A604 | $A^1$ | * | H | H | H | H | — | 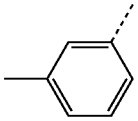 | ----$CH_2$—OH |
| A605 | * | $A^1$ | H | H | H | H | $H_2C—OH$ / —CH \ $H_2C—CH_3$ | — | — |

TABLE 7

| Exemplified Compound | $R^{701}$ | $R^{702}$ | $R^{703}$ | $R^{704}$ | $R^{705}$ | $R^{706}$ | $R^{707}$ | $R^{708}$ | $A^1$ α | $A^1$ β | $A^1$ Y |
|---|---|---|---|---|---|---|---|---|---|---|---|
| A701 | $A^1$ | H | H | H | * | H | H | H | — | 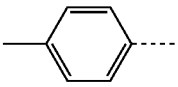 | ----$CH_2$—OH |
| A702 | $A^1$ | H | H | H | H | * | H | H | $H_2C—OH$ / —CH \ $H_2C—CH_3$ | — | — |
| A703 | $A^1$ | H | H | H | H | * | H | H | — | 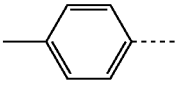 | ----$CH_2$—OH |
| A704 | $A^1$ | * | H | H | $A^2$ | H | H | H | $H_2C—OH$ / —CH \ $H_2C—CH_3$ | — | — |
| A705 | $A^1$ | H | H | H | $A^2$ | * | H | H | — | 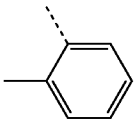 | ----$CH_2$—OH |

| Exemplified Compound | $A^2$ α | $A^2$ β | $A^2$ Y |
|---|---|---|---|
| A701 | — | — | — |
| A702 | — | — | — |
| A703 | — | — | — |
| A704 | — | 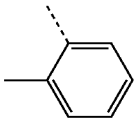 | ----$CH_2$—OH |
| A705 | —$(CH_2)_5$—OH | — | — |

TABLE 8
| Exemplified Compound | $R^{801}$ | $R^{802}$ | $R^{803}$ | $R^{804}$ | $R^{805}$ | $R^{806}$ | $R^{807}$ | $R^{808}$ | $R^{809}$ | $R^{810}$ | $A^1$ α | $A^1$ β | $A^1$ Y |
|---|---|---|---|---|---|---|---|---|---|---|---|---|---|
| A801 | H | H | H | H | H | H | H | H | * | $A^1$ | 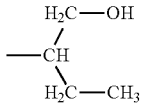 | — | — |
| A802 | H | H | H | H | H | H | H | H | * | $A^1$ | — | 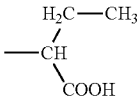 | — |
| A803 | H | CN | H | H | H | H | CN | H | * | $A^1$ | 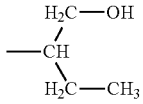 | — | — |
| A804 | * | H | H | H | H | H | H | H | H | $A^1$ | 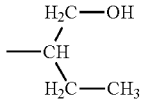 | — | — |
| A805 | H | H | H | H | H | H | H | H | * | $A^1$ | — | 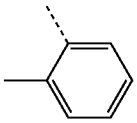 | 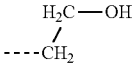 |
30
TABLE 9
| Exemplified Compound | $R^{901}$ | $R^{902}$ | $R^{903}$ | $R^{904}$ | $R^{905}$ | $R^{906}$ | $R^{907}$ | $R^{908}$ | $R^{909}$ | $R^{910}$ | $A^1$ α | $A^1$ β | $A^1$ Y |
|---|---|---|---|---|---|---|---|---|---|---|---|---|---|
| A901 | 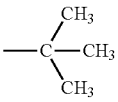 | H | H | H | * | H | H | H | H | $A^1$ | $—CH_2—OH$ | — | — |
| A902 | * | H | H | H | $A^1$ | H | H | H | H | 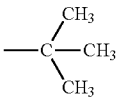 | — | 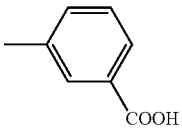 | — |
| A903 | $A^1$ | H | H | H | * | H | H | H | H | 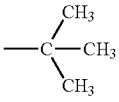 | — | 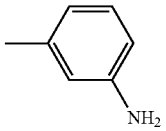 | — |
| A904 | 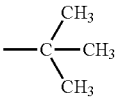 | $A^1$ | H | H | * | H | H | H | H | 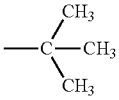 | — | 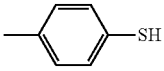 | — |
| A905 | $A^1$ | H | H | H | * | H | H | H | H | 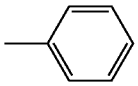 | $—CH_2—OH$ | — | — |

TABLE 10

| Exemplified Compound | $R^{1001}$ | $R^{1002}$ | $R^{1003}$ | $R^{1004}$ | $R^{1005}$ | $R^{1006}$ | $R^{1007}$ | $R^{1008}$ | $A^1$ α | $A^1$ β | $A^1$ Y |
|---|---|---|---|---|---|---|---|---|---|---|---|
| A1001 | $A^1$ | H | H | H | * | H | H | H | —$CH_2$—OH | — | — |
| A1002 | $A^1$ | H | H | H | * | H | H | H | —$(CH_2)_2$—OH | — | — |
| A1003 | H | H | H | * | H | H | H | $A^1$ | —$CH_2$—OH | — | — |
| A1004 | H | H | * | H | H | H | H | $A^1$ | —$(CH_2)_2$—OH | — | — |
| A1005 | H | CN | H | * | H | H | CN | $A^1$ | — | —$C_6H_4$—$OCH_3$ | — |
| A1006 | $A^1$ | $A^1$ | H | $NO_2$ | * | H | $NO_2$ | H | —$(CH_2)_2$—OH | — | — |
| A1007 | H | $A^1$ | $A^1$ | H | H | H | * | H | —$CH_2$—OH | — | — |

X represents a linking group, and the linking group is a substituted or unsubstituted alkylene group, a substituted or unsubstituted arylene group, a substituted or unsubstituted heterocyclic group, or a group derived by substituting one of methylene groups in a main chain of the substituted or unsubstituted alkylene group with $R^1$. $R^1$ represents an oxygen atom, a sulfur atom, $SO_2$, $NR^2$, CO, or a substituted or unsubstituted arylene group. $R^2$ represents a hydrogen atom, an alkyl group, or an aryl group. For example, an alkyl group, an aryl group, a hydroxyl group, an amino group, and a halogen group are given as a substituent of the substituted alkylene group, a substituent of the substituted arylene group, and a substituent of the substituted heterocyclic group.

Now, specific examples of X are shown. In Table 11, dotted lines represent bonding sites for bonding to $Z^1$ and $Z^2$.

TABLE 11

X1

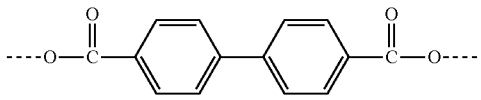

X2

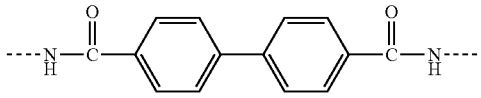

X3

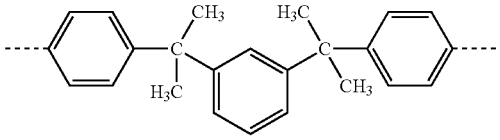

X4

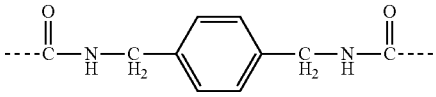

X5

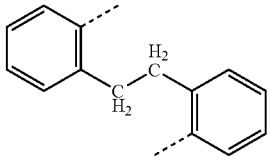

TABLE 11-continued

X6

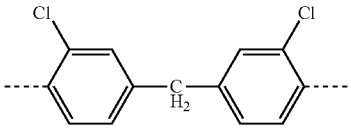

X7

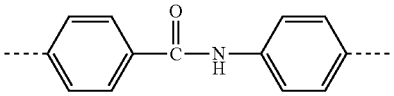

X8

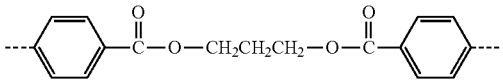

X9

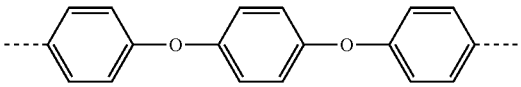

X10

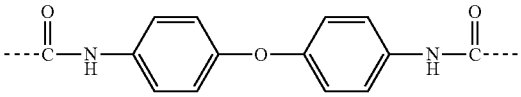

X11

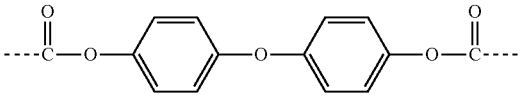

X12

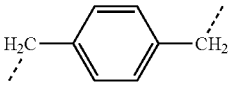

X13

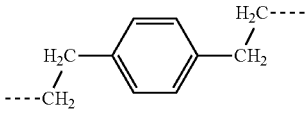

X14

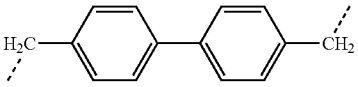

TABLE 11-continued
| | |
|---|---|
| X15 | 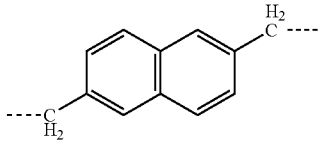 |
| X16 | 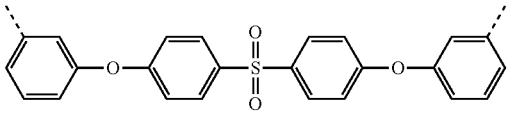 |
| X17 | 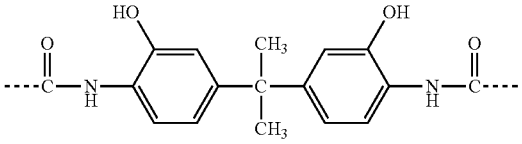 |
| X18 | 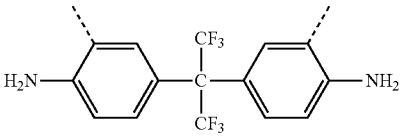 |
| X19 | 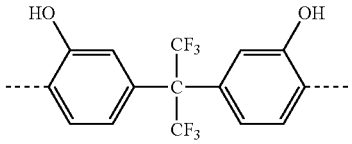 |
| X20 | 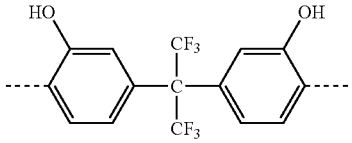 |
| X21 | 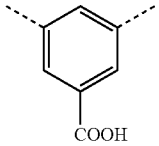 |
| X22 | 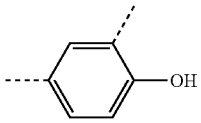 |
| X23 | 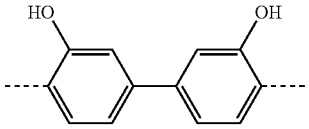 |
| X24 | 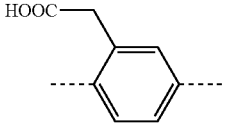 |
| X25 | 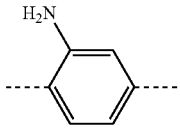 |
TABLE 11-continued
| | |
|---|---|
| X26 | 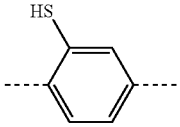 |
| X27 | 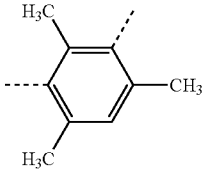 |
| X28 | 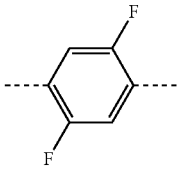 |
| X29 | 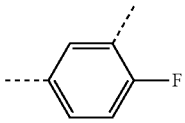 |
| X30 | 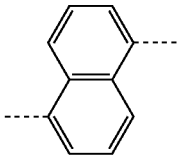 |
| X31 | 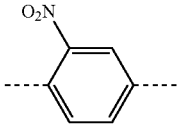 |
| X32 | 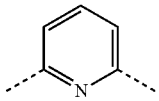 |
| X33 | 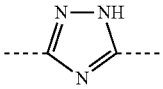 |
| X34 | 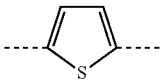 |
| X35 | -----$(CH_2)_4$---- |
| X36 | -----$(CH_2)_5$---- |
| X37 | -----$(CH_2)_6$---- |
| X38 | -----$(CH_2)_8$---- |
| X39 | -----$(CH_2)_{10}$---- |
| X40 | -----$(CH_2)_{12}$---- |

TABLE 11-continued
| | |
|---|---|
| X41 | 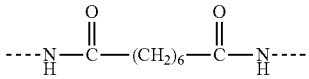 |
| X42 | 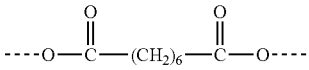 |
| X43 | 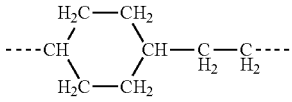 |
| X44 | 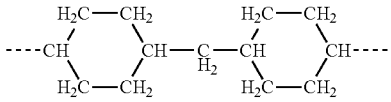 |
| X45 | 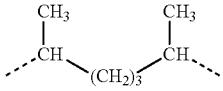 |
| X46 | 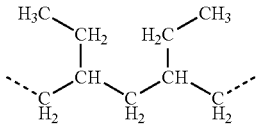 |
| X47 | 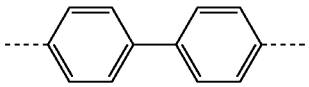 |
| X48 | 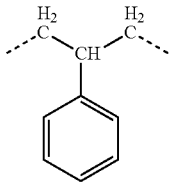 |
| X49 | 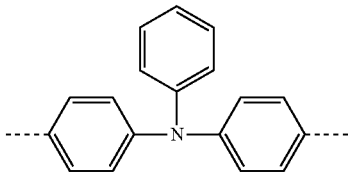 |
| X50 | 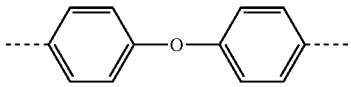 |
| X51 | 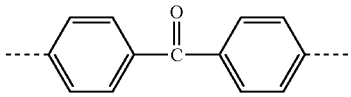 |
| X52 | 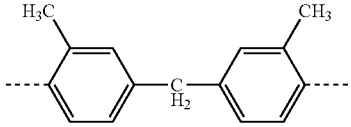 |
| X53 | $(CH_2)_2—O—(CH_2)_2$ |
| X54 | $(CH_2)_3—O—(CH_2)_3—O—(CH_2)_3$ |
TABLE 11-continued
| | |
|---|---|
| X55 | $(CH_2)_2—NH—(CH_2)_2—NH—(CH_2)_2$ |
| X56 | $O—(CH_2)_6—O$ |
| X57 | $(CH_2)_3—C(=O)—(CH_2)_3$ |
| X58 | $(CH_2)_4—C(COOH)H$ |
| X59 | $C(=O)—(CH_2)_4—C(=O)$ |
| X60 | $C(=O)—O—(CH_2)_6—O—C(=O)$ |
| X61 | 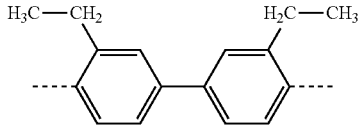 |
| X62 | 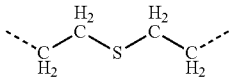 |
| X63 | $C(=O)—(CH_2)_2—CH(COOH)$ |
| X64 | $(CH_2)_2—C(NH_2)H—(CH_2)_2$ |
| X65 | $(CH_2)_2—N(CH_3)—(CH_2)_2$ |
| X66 | 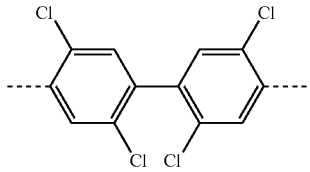 |
| X67 | 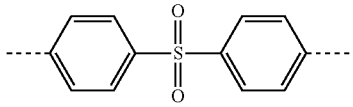 |
| X68 | 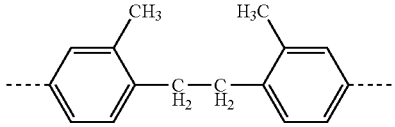 |
| X69 | 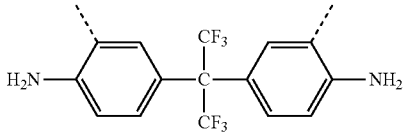 |

TABLE 11-continued

| | |
|---|---|
| X70 | 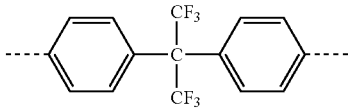 |

Now, specific examples of the electron transport material represented by the formula (1) are shown in Table 12. In Table 12, in the case where X is "-", X represents a single bond.

TABLE 12

| Formula (1) | $Z^1$ | $Z^2$ | X |
|---|---|---|---|
| (1-1)-1 | A101 | A101 | X42 |
| (1-1)-2 | A102 | A102 | X42 |
| (1-1)-3 | A103 | A103 | — |
| (1-1)-4 | A114 | A114 | X5 |
| (1-1)-5 | A101 | A101 | X8 |
| (1-1)-6 | A105 | A105 | X24 |
| (1-1)-7 | A119 | A119 | X15 |
| (1-1)-8 | A115 | A119 | X36 |
| (1-1)-9 | A112 | A112 | X42 |
| (1-1)-10 | A109 | A121 | X9 |
| (1-2)-1 | A201 | A201 | X11 |
| (1-2)-2 | A202 | A202 | X8 |
| (1-2)-3 | A201 | A201 | X12 |
| (1-2)-4 | A201 | A201 | X23 |
| (1-2)-5 | A205 | A205 | — |
| (1-3)-1 | A301 | A301 | X16 |
| (1-3)-2 | A302 | A302 | X41 |
| (1-3)-3 | A303 | A303 | X56 |
| (1-3)-4 | A304 | A304 | X2 |
| (1-3)-5 | A305 | A305 | X15 |
| (1-4)-1 | A401 | A401 | X18 |
| (1-4)-2 | A402 | A402 | X59 |
| (1-4)-3 | A403 | A403 | X21 |
| (1-4)-4 | A404 | A404 | X4 |
| (1-4)-5 | A405 | A405 | X69 |
| (1-5)-1 | A501 | A501 | X8 |
| (1-5)-2 | A502 | A502 | X3 |
| (1-5)-3 | A503 | A503 | X2 |
| (1-5)-4 | A504 | A504 | X17 |
| (1-5)-5 | A505 | A505 | X22 |
| (1-6)-1 | A601 | A601 | X13 |
| (1-6)-2 | A602 | A602 | X52 |
| (1-6)-3 | A603 | A603 | X15 |
| (1-6)-4 | A605 | A605 | X32 |
| (1-6)-5 | A604 | A605 | X21 |
| (1-7)-1 | A701 | A701 | X35 |
| (1-7)-2 | A702 | A702 | X31 |
| (1-7)-3 | A703 | A703 | X11 |
| (1-7)-4 | A704 | A704 | X44 |
| (1-7)-5 | A705 | A705 | X17 |
| (1-8)-1 | A801 | A801 | — |
| (1-8)-2 | A802 | A802 | — |
| (1-8)-3 | A801 | A801 | X21 |
| (1-8)-4 | A802 | A802 | X15 |
| (1-8)-5 | A802 | A805 | X42 |
| (1-8)-6 | A803 | A803 | X61 |
| (1-8)-7 | A803 | A803 | X7 |
| (1-8)-8 | A804 | A804 | X34 |
| (1-8)-9 | A804 | A804 | X41 |
| (1-8)-10 | A805 | A805 | X29 |
| (1-8)-11 | A805 | A805 | X27 |
| (1-9)-1 | A901 | A901 | X66 |
| (1-9)-2 | A901 | A901 | X3 |
| (1-9)-3 | A902 | A903 | X12 |
| (1-9)-4 | A904 | A904 | X14 |
| (1-9)-5 | A905 | A905 | X23 |
| (1-10)-1 | A1001 | A1007 | X1 |
| (1-10)-2 | A1002 | A1002 | X50 |
| (1-10)-3 | A1005 | A1005 | X53 |
| (1-10)-4 | A1006 | A1006 | X19 |
| (1-1)-11 | A122 | A122 | X20 |
| (1-1)-12 | A123 | A123 | X17 |

The electron transport material represented by the formula (1) has at least one polymerizable functional group, and preferably has two or more polymerizable functional groups because the formation of a network structure is accelerated particularly at a time of polymerization.

A partial structure of the electron transport material represented by the formula (1) having the group represented by the formula (A1) can be synthesized through use of a known synthesis method disclosed in, for example, U.S. Pat. No. 4,442,193, U.S. Pat. No. 4,992,349, U.S. Pat. No. 5,468,583, or Chemistry of materials, Vol. 19, No. 11, 2703-2705 (2007). Further, the partial structure can be synthesized by a reaction between naphthalenetetracarboxylic acid dianhydride available from Tokyo Chemical Industry Co. Ltd., Sigma-Aldrich Japan, or Johnson Matthey Japan Inc. and a monoamine derivative.

A partial structure of the electron transport material represented by the formula (1) having the group represented by the formula (A2) is available from, for example, Tokyo Chemical Industry Co. Ltd., Sigma-Aldrich Japan, or Johnson Matthey Japan Inc. Further, the partial structure can be synthesized through use of a synthesis method disclosed in Chem. Educator No. 6, 227-234 (2001), Journal of Synthetic Organic Chemistry, Japan, vol. 15, 29-32 (1957), or Journal of Synthetic Organic Chemistry, Japan, vol. 15, 32-34 (1957) based on a phenanthrene derivative or a phenanthroline derivative. A dicyanomethylene group can also be introduced through a reaction with malononitrile.

A partial structure of the electron transport material represented by the formula (1) having the group represented by the formula (A3) is available from Tokyo Chemical Industry Co. Ltd., Sigma-Aldrich Japan, or Johnson Matthey Japan Inc. Further, the partial structure can be synthesized through use of a synthesis method disclosed in Bull. Chem. Soc. Jpn., Vol. 65, 1006-1011 (1992) based on a phenanthrene derivative or a phenanthroline derivative. A dicyanomethylene group can also be introduced through a reaction with malononitrile.

A partial structure of the electron transport material represented by the formula (1) having the group represented by the formula (A4) is available from, for example, Tokyo Chemical Industry Co. Ltd., Sigma-Aldrich Japan, or Johnson Matthey Japan Inc. Further, the partial structure can be synthesized through use of a synthesis method disclosed in Tetrahedron Letters, 43(16), 2991-2994 (2002) or Tetrahedron Letters, 44(10), 2087-2091 (2003) based on an acenaphthenequinone derivative. A dicyanomethylene group can also be introduced through a reaction with malononitrile.

A partial structure of the electron transport material represented by the formula (1) having the group represented by the formula (A5) is available from, for example, Tokyo Chemical Industry Co. Ltd., Sigma-Aldrich Japan, or Johnson Matthey Japan Inc. Further, the partial structure can be synthesized through use of a synthesis method disclosed in U.S. Pat. No. 4,562,132 with a fluorenone derivative and malononitrile. Further, the partial structure can also be synthesized through use of a synthesis method disclosed in Japanese Patent Application Laid-Open No. H05-279582 or Japanese Patent Application Laid-Open No. H07-070038 with a fluorenone derivative and an aniline derivative.

A partial structure of the electron transport material represented by the formula (1) having the group represented by the formula (A6) can be synthesized through use of a synthesis method disclosed in, for example, Chemistry Letters, 37(3), 360-361 (2008) or Japanese Patent Application Laid-Open No. H09-151157. Further, the partial structure is available from Tokyo Chemical Industry Co. Ltd., Sigma-Aldrich Japan, or Johnson Matthey Japan Inc.

A partial structure of the electron transport material represented by the formula (1) having the group represented by the formula (A7) can be synthesized through use of a synthesis method disclosed in Japanese Patent Application Laid-Open No. H01-206349 or PPCI/Japan Hard Copy '98, proceedings p. 207 (1998). Further, the partial structure can be synthesized using as a raw material a phenol derivative available from Tokyo Chemical Industry Co., Ltd. or Sigma-Aldrich Japan.

A partial structure of the electron transport material represented by the formula (1) having the group represented by the formula (A8) can be synthesized through use of a known synthesis method disclosed in, for example, Journal of the American chemical society, Vol. 129, No. 49, 15259-78 (2007). Further, the partial structure can be synthesized by a reaction between perylenetetracarboxylic acid dianhydride available from Tokyo Chemical Industry Co. Ltd., Sigma-Aldrich Japan, or Johnson Matthey Japan Inc. and a monoamine derivative.

A partial structure of the electron transport material represented by the formula (1) having the group represented by the formula (A9) can be synthesized, for example, as follows through use of a compound available from Tokyo Chemical Industry Co., Ltd., Sigma-Aldrich Japan, or Johnson Matthey Japan Inc. That is, the partial structure can be synthesized by oxidizing the compound with an oxidant in an organic solvent. As the oxidant, there is given potassium permanganate, and as the organic solvent, there is given chloroform.

A partial structure of the electron transport material represented by the formula (1) having the group represented by the formula (A10) can be synthesized through use of a known synthesis method disclosed in, for example, Bulletin of Tokai Women's Junior College, 7, 1-11 (1980) and is available from, for example, Tokyo Chemical Industry Co., Ltd., Sigma-Aldrich Japan, or Johnson Matthey Japan Inc. A cyanated methylene structure or an imine structure may be introduced through the action of a cyanated methylene derivative or an aniline derivative.

Then, the partial structures of the electron transport material represented by the formula (1) having the group represented by any one of the formulae (A1) to (A10) are linked to each other, and thus the intended electron transport material represented by the formula (1) can be obtained. In order to link the partial structures of the electron transport material represented by the formula (1), a known method can be used, which involves, based on the partial structure of the electron transport material represented by the formula (1) having a functional group introduced therein, reacting a compound having a plurality of functional groups capable of being bonded to the introduced functional group, or the like. Specifically, the functional group can be introduced through the reactions described below.

For example, there are given: a method involving introducing an arylene group by means of a cross-coupling reaction based on a halide of the partial structure of the electron transport material represented by the formula (1), the reaction involving using a palladium catalyst and a base; a method involving introducing an alkylene group by means of a cross-coupling reaction based on a halide of the partial structure of the electron transport material represented by the formula (1), the reaction involving using a $FeCl_3$ catalyst and a base; a method involving introducing a linking group through an ester bond or an amide bond by reacting a diol compound or a diamino compound based on the partial structure of the electron transport material represented by the formula (1) having a carboxyl group introduced therein; a method involving introducing a linking group through an ester bond or a urethane bond by reacting a dicarboxyl compound or a diisocyanate compound based on the partial structure of the electron transport material represented by the formula (1) having a hydroxyl group introduced therein; and a method involving introducing a linking group through an amide bond or a urea bond by reacting a dicarboxyl compound or a diisocyanate compound based on the partial structure of the electron transport material represented by the formula (1) having an amino group introduced therein.

Compounds that can be used in the above-mentioned reactions are available from Tokyo Chemical Industry Co. Ltd., Sigma-Aldrich Japan, or Johnson Matthey Japan Inc.

The electron transport material represented by the formula (1) has a polymerizable functional group (a hydroxyl group, a thiol group, an amino group, or a carboxyl group) capable of reacting with the cross-linking agent. As a method of introducing the polymerizable functional group into the main skeleton of the electron transport material represented by the formula (1), there is given a method involving introducing the polymerizable functional group directly into the main skeleton of the electron transport material represented by the formula (1). Also available is a method involving introducing a structure having the polymerizable functional group or a functional group that may serve as a precursor of the polymerizable functional group into the main skeleton of the electron transport material represented by the formula (1). As the latter method, there is given a method involving introducing an aryl group having the polymerizable functional group by means of a cross-coupling reaction based on a halide of the partial structure of the electron transport material represented by the formula (1), the reaction involving using a palladium catalyst and a base. Also available is a method involving introducing an alkyl group having the polymerizable functional group by means of a cross-coupling reaction based on the halide, the reaction involving using a $FeCl_3$ catalyst and a base. Also available is a method involving subjecting a halide of the partial structure of the electron transport material represented by the formula (1) to lithiation, and causing an epoxy compound or carbon dioxide to act on the resultant to introduce a hydroxyalkyl group or a carboxyl group.

Further, the electron transport material represented by the formula (1) may be a compound represented by the formula (11). In this case, it is preferred that the polymerizable functional group be a hydroxyl group, a thiol group, an amino group, a carboxyl group, or a methoxy group.

(11)

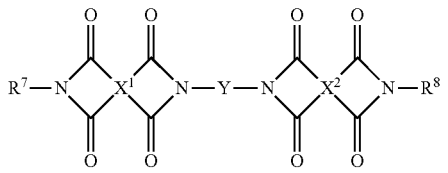

In the formula (11), $X^1$ and $X^2$ each independently represent a residue obtained by removing four carboxyl groups from a substituted or unsubstituted aromatic tetracarboxylic acid. When the residue has a substituent, the substituent is a halogen atom, a cyano group, a nitro group, a substituted or unsubstituted alkyl group, or a substituted or unsubstituted aryl group.

Y represents a substituted or unsubstituted alkylene group having a polymerizable functional group or a substituted or unsubstituted arylene group having a polymerizable functional group.

$R^7$ and $R^8$ each independently represent a substituted or unsubstituted alkyl group, a group derived by substituting one of methylene groups of the substituted or unsubstituted alkyl group with an oxygen atom, a group derived by substituting one of the methylene groups of the substituted or unsubstituted alkyl group with a sulfur atom, a group derived by substituting one of the methylene groups of the substituted or unsubstituted alkyl group with $NR^9$, a substituted or unsubstituted aryl group, a substituted or unsubstituted heterocyclic group, or an alkoxycarbonyl group. $R^7$ and $R^8$ may each have a polymerizable functional group.

It should be noted that the oxygen atom, the sulfur atom, and the $NR^9$ are free from being directly bonded to nitrogen atoms to which $R^7$ and $R^8$ are bonded.

Examples of the residue obtained by removing four carboxyl groups from an aromatic tetracarboxylic acid represented by $X^1$ or $X^2$ in the compound represented by the formula (11) include a phenyl group, a biphenyl group, a p-terphenyl group, a naphthyl group, an anthryl group, and a perylenyl group. Specific examples of the aromatic tetracarboxylic acid include, but not limited to, 1,2,3,4-benzenetetracarboxylic acid, 1,2,4,5-benzenetetracarboxylic acid, 2,2',3,3'-biphenyltetracarboxylic acid, 3,3',4,4'-biphenyltetracarboxylic acid, 2,3,3',4'-biphenyltetracarboxylic acid, 3,3',4,4'-p-terphenyltetracarboxylic acid, 2,2',3,3'-p-terphenyltetracarboxylic acid, 2,3,3',4'-p-terphenyltetracarboxylic acid, 1,2,4,5-naphthalenetetracarboxylic acid, 1,2,5,6-naphthalenetetracarboxylic acid, 1,4,5,8-naphthalenetetracarboxylic acid, 2,3,6,7-naphthalenetetracarboxylic acid, 2,3,6,7-anthracenetetracarboxylic acid, and 3,4,9,10-perylenetetracarboxylic acid.

Substituents of the $X^1$ and $X^2$ are exemplified by, but not limited to: a halogen atom such as a fluorine, chlorine, bromine, or iodine atom; an alkyl group such as a methyl group, an ethyl group, a propyl group, or a butyl group; and an aryl group such as a phenyl group, a naphthyl group, a biphenyl group, a terphenyl group, or a fluorenyl group. In addition, the alkyl group may be further substituted with the halogen atom or the aryl group, and the aryl group may be further substituted with the halogen atom or the alkyl group. Further, the $X^1$ and $X^2$ may each be substituted with one or two or more substituents.

Examples of the alkylene group represented by Y in the compound represented by the formula (11) include, but not limited to, a methylene group, an ethylene group, a propylene group, a butylene group, a pentylene group, a hexylene group, a cyclohexylene group, a heptylene group, an octylene group, a nonylene group, and a decylene group.

Examples of the arylene group represented by Y in the compound represented by the formula (11) include, but not limited to, a phenylene group, a naphthylene group, a biphenylylene group, a fluorenylylene group, a spirofluorenylylene group, an anthranyl group, and a phenanthrenyl group.

Examples of the polymerizable functional group that Y has include an active hydrogen group, an unsaturated hydrocarbon group, and a methoxy group. The active hydrogen group is preferably a hydroxyl group, a hydroxyalkyl group, a carboxyl group, an amino group, and a thiol group. Of those, a hydroxyl group and a carboxyl group are more preferred. In addition, the unsaturated hydrocarbon group is preferably an ethylene group, an acryloyloxy group, or a methacryloyloxy group which are substituents of the arylene group.

As a substituent of the Y, there are given, for example, a methyl group, an ethyl group, a propyl group, and a butyl group. The compound represented by the formula (11) may have one or two or more of the polymerizable functional groups that Y has, and may have one kind or two or more kinds thereof.

Examples of the alkyl group represented by $R^7$ or $R^8$ in the compound represented by the formula (11) include, but not limited to, a methyl group, an ethyl group, a propyl group, a butyl group, a pentyl group, a hexyl group, a heptyl group, an octyl group, a nonyl group, a decyl group, and a cyclohexyl group.

Examples of the group derived by substituting one of the methylene groups of the alkyl group with an oxygen atom represented by $R^7$ or $R^8$ in the compound represented by the formula (11) include, but not limited to, a methoxymethyl group, a methoxyethyl group, an ethoxymethyl group, and an ethoxyethyl group.

Examples of the group derived by substituting one of the methylene groups of the alkyl group with a sulfur atom represented by $R^7$ or $R^8$ in the compound represented by the formula (11) include, but not limited to, a methylthiomethyl group, a methylthioethyl group, a methylthiopropyl group, a methylthiobutyl group, an ethylthiomethyl group, an ethylthioethyl group, an ethylthiopropyl group, and an ethylthiobutyl group as well as a mercaptomethyl group, a mercaptoethyl group, a mercaptopropyl group, a mercaptobutyl group, a mercaptopentyl group, a mercaptohexyl group, a mercaptoheptyl group, a mercaptooctyl group, a mercaptononyl group, a mercaptodecyl group, and a mercaptocyclohexyl group.

Examples of the group derived by substituting one of the methylene groups of the alkyl group with $NR^9$ represented by $R^7$ or $R^8$ in the compound represented by the formula (11) include, but not limited to, a dimethylaminomethyl group, a dimethylaminoethyl group, a dimethylaminopropyl group, a methylethylaminomethyl group, a methylethylaminoethyl group, a methylethylaminopropyl group, a diethylaminomethyl group, a diethylaminoethyl group, a diethylaminopropyl group, an ethylpropylaminomethyl group, an ethylpropylaminoethyl group, an ethylpropylaminopropyl group, a dipropylaminomethyl group, a dipropylaminoethyl group, and a dipropylaminopropyl group.

Examples of the aryl group represented by $R^7$ or $R^8$ in the compound represented by the formula (11) include, but not limited to, a phenyl group, a naphthyl group, a biphenyl group, a terphenyl group, and a fluorenyl group.

Examples of the heterocyclic group represented by $R^7$ or $R^8$ in the compound represented by the formula (11) include, but not limited to, thiophene, pyrrole, pyridine, pyrazine, pyrimidine, pyridazine, triazine, quinoline, isoquinoline, oxazole, oxadiazole, phenanthridine, acridine, naphthyridine, quinoxaline, quinazoline, cinnoline, phthalazine, phenanthroline, phenazine, dibenzofuran, dibenzothiophene, carbazole, benzofuran, benzothiophene, indole, benzimidazole, benzothiazole, and benzothiadiazole.

Examples of the alkoxycarbonyl group represented by $R^7$ or $R^8$ in the compound represented by the formula (11) include, but not limited to, a methoxycarbonyl group, an ethoxycarbonyl group, a propoxycarbonyl group, and a butoxycarbonyl group.

As substituents of the alkyl group, the group derived by substituting one of the methylene groups of the alkyl group with an oxygen atom, the group derived by substituting one of the methylene groups of the alkyl group with a sulfur atom, and the group derived by substituting one of the methylene groups of the alkyl group with $NR^9$, there are given, for example: an aralkyl group such as a benzyl group; aryl groups such as a phenyl group and a biphenyl group; heterocyclic groups such as a pyridyl group, a pyrrolyl group, a benzimidazolyl group, and a benzothiazolyl group; alkoxyl groups such as a methoxyl group, an ethoxyl group, a propoxyl group, and a phenoxyl group; halogen atoms such as fluorine, chlorine, bromine, and iodine atoms; a cyano group; a nitro group; a carbonyl group; a carboxyl group; and an alkoxycarbonyl group.

As substituents of the aryl group and the heterocyclic group, there are given, for example: alkyl groups such as a methyl group, an ethyl group, a propyl group, and a butyl group; an aralkyl group such as a benzyl group; aryl groups such as a phenyl group and a biphenyl group; heterocyclic groups such as a pyridyl group, a pyrrolyl group, a benzimidazolyl group, and a benzothiazolyl group; alkoxyl groups such as a methoxyl group, an ethoxyl group, a propoxyl group, and a phenoxyl group; halogen atoms such as fluorine, chlorine, bromine, and iodine atoms; a cyano group; a nitro group; an alkoxycarbonyl group; an alkoxy group; and a halogenated alkyl group.

In addition, when $R^7$ and $R^8$ each have a polymerizable functional group, examples of the polymerizable functional group include the same functional groups as the examples of the polymerizable functional group that Y has. As in the case of Y, the compound may have one or two or more of the polymerizable functional groups that $R^7$ and $R^8$ have, and may have one kind or two or more kinds thereof.

In the second embodiment of the present invention, the compound represented by the formula (11) is used as (i) a polymerized product of the compound represented by the formula (11) or (ii) a polymerized product of a composition containing the compound represented by the formula (11) and a cross-linking agent. It should be noted that, in the case where the compound represented by the formula (11) is used as (i) the polymerized product of the compound represented by the formula (11), the polymerizable functional group of Y is preferably an unsaturated hydrocarbon group. The unsaturated hydrocarbon group is preferably an ethylene group, an acryloyloxy group, or a methacryloyloxy group which are substituents of the arylene group.

Examples of the compound represented by the formula (11) according to the present invention are shown in Tables 13 to 16, but the present invention is not limited thereto. A plurality of compounds each represented by the formula (11) may be used in combination.

TABLE 13

| Exemplified Compound | $R^7$ | $X^1$ | Y | $X^2$ | $R^8$ |
|---|---|---|---|---|---|
| E101 | 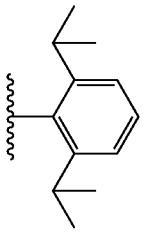 | 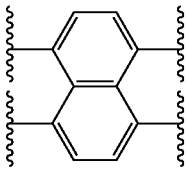 | 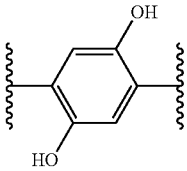 | 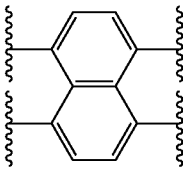 | 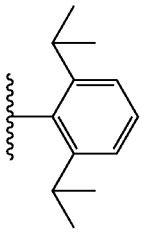 |
| E102 | 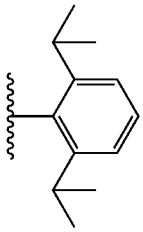 | 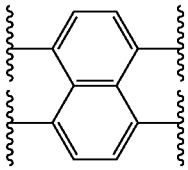 | 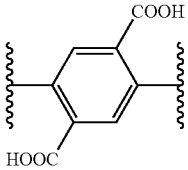 | 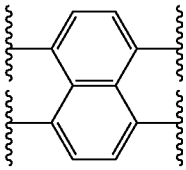 | 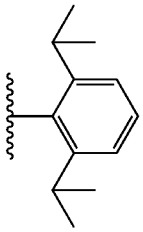 |
| E103 | 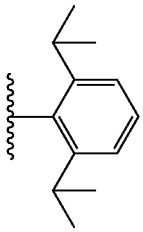 | 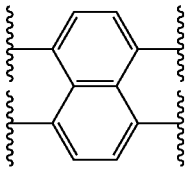 | 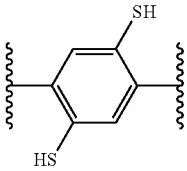 | 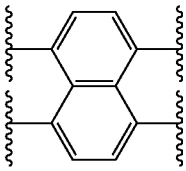 | 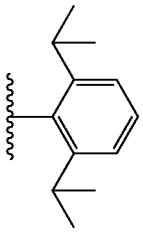 |

TABLE 13-continued
| Exemplified Compound | $R^7$ | $X^1$ | Y | $X^2$ | $R^8$ |
|---|---|---|---|---|---|
| E104 | 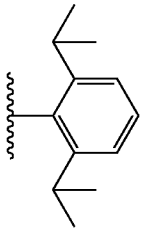 | 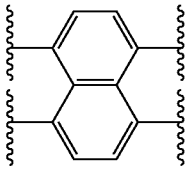 | 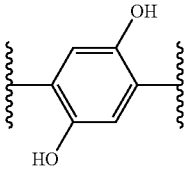 | 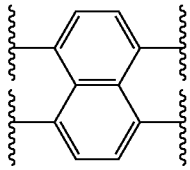 | 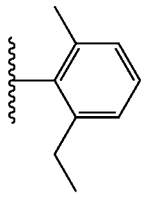 |
| E105 | 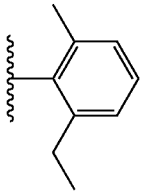 | 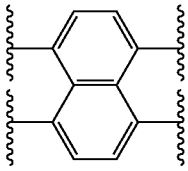 | 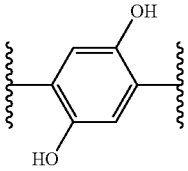 | 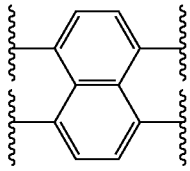 | 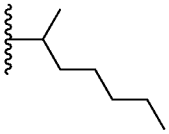 |
| E106 | 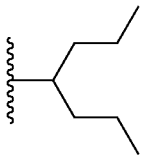 | 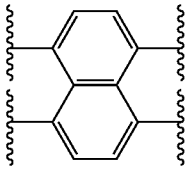 | 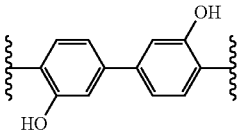 | 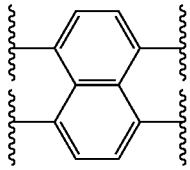 | 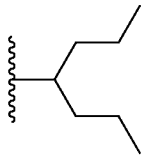 |
| E107 | 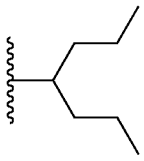 | 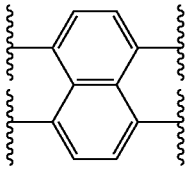 | 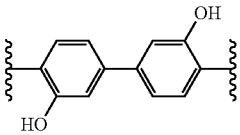 | 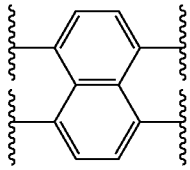 | 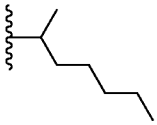 |
| E108 | 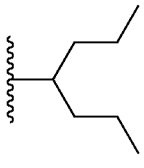 | 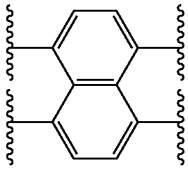 | 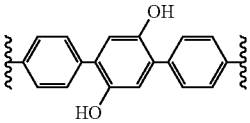 | 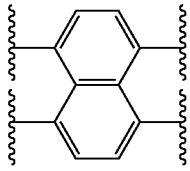 | 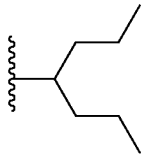 |
| E109 | 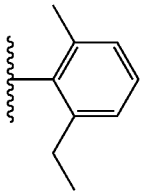 | 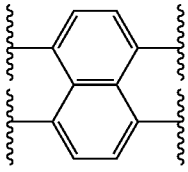 | 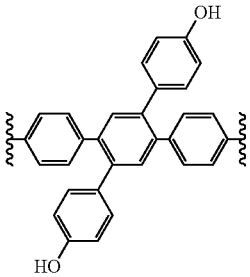 | 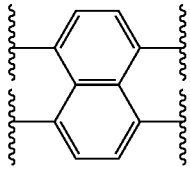 | 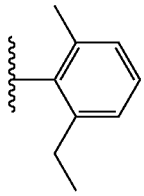 |
| E110 | 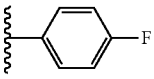 | 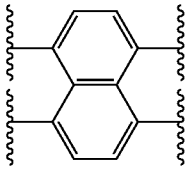 | 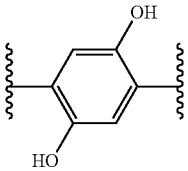 | 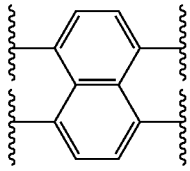 | 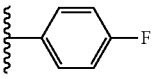 |

TABLE 13-continued
| Exemplified Compound | $R^7$ | $X^1$ | Y | $X^2$ | $R^8$ |
|---|---|---|---|---|---|
| E111 | 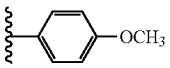 | 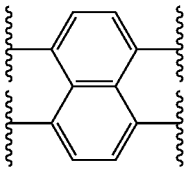 | 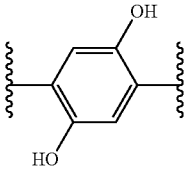 | 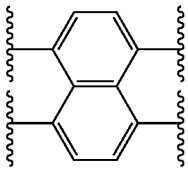 | 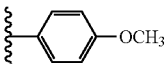 |
| E112 | 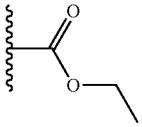 | 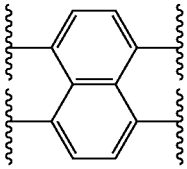 | 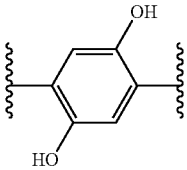 | 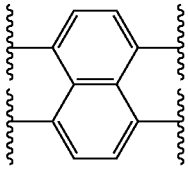 | 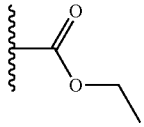 |
| E113 | 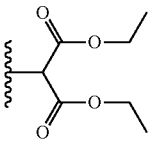 | 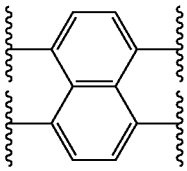 | 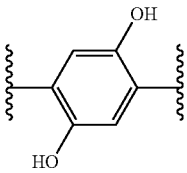 | 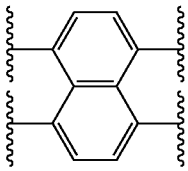 | 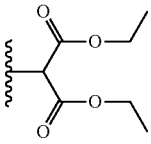 |
| E114 | 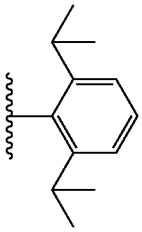 | 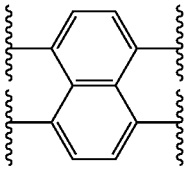 | 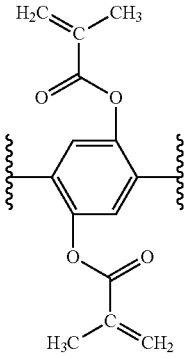 | 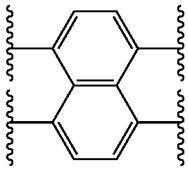 | 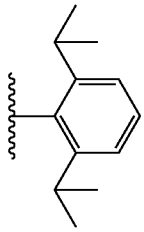 |
| E115 | 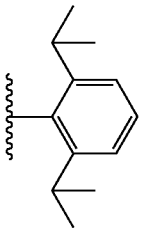 | 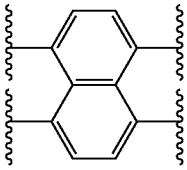 | 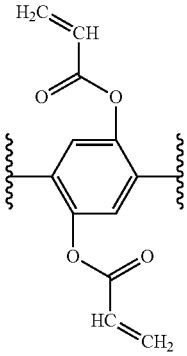 | 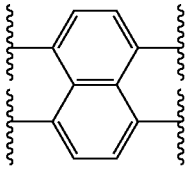 | 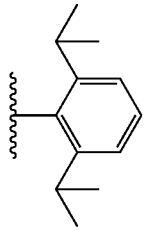 |

TABLE 13-continued
| Exemplified Compound | $R^7$ | $X^1$ | Y | $X^2$ | $R^8$ |
|---|---|---|---|---|---|
| E116 | 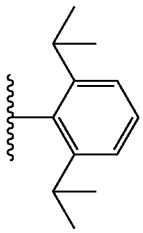 | 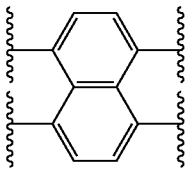 | 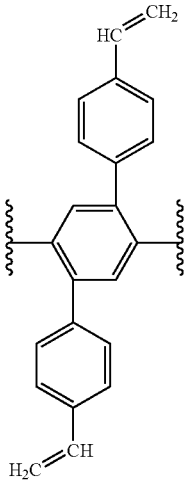 | 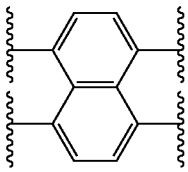 | 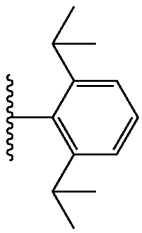 |
| E117 | 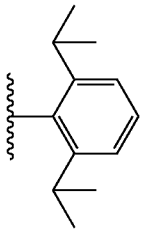 | 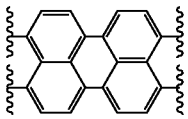 | 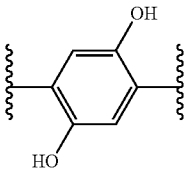 | 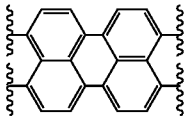 | 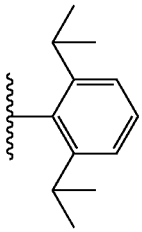 |
| E118 | 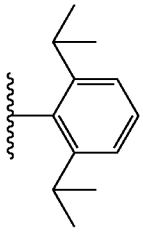 | 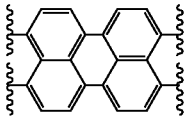 | 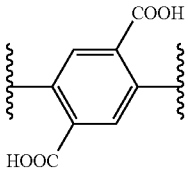 | 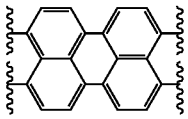 | 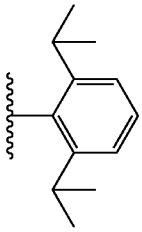 |
| E119 | 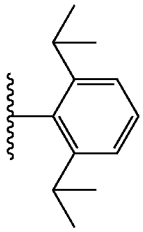 | 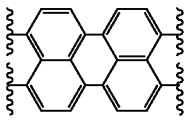 | 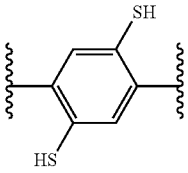 | 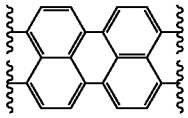 | 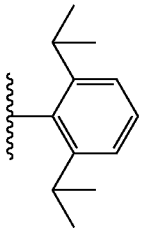 |
| E120 | 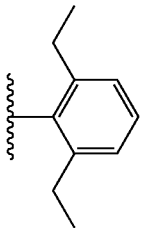 | 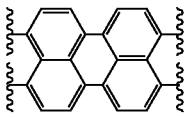 | 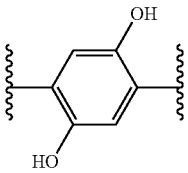 | 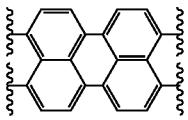 | 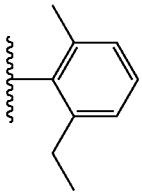 |

TABLE 13-continued
| Exemplified Compound | $R^7$ | $X^1$ | Y | $X^2$ | $R^8$ |
|---|---|---|---|---|---|
| E121 | 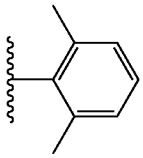 | 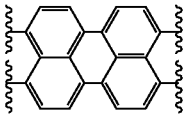 | 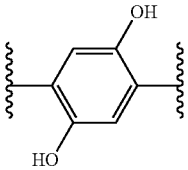 | 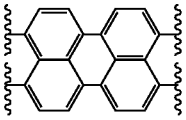 | 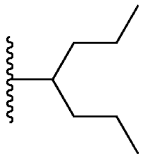 |
| E122 | 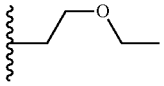 | 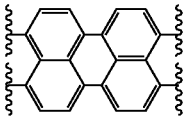 | 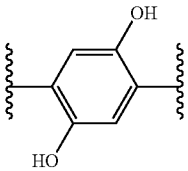 | 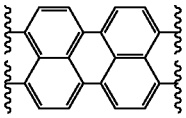 | 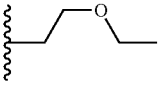 |
| E123 | 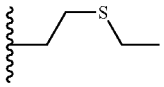 | 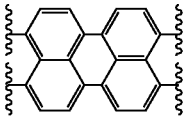 | 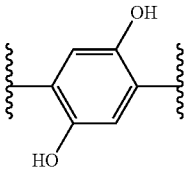 | 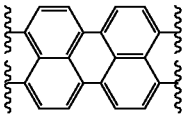 | 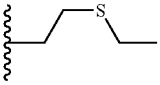 |
| E124 | 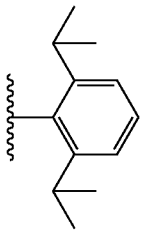 | 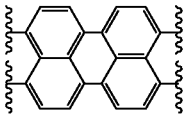 | 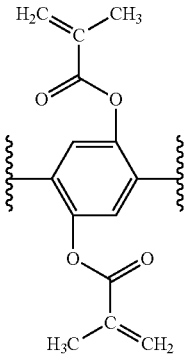 | 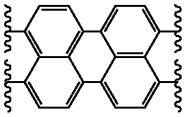 | 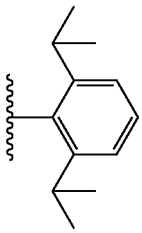 |
| E125 | 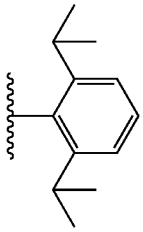 | 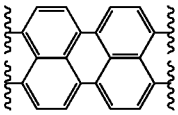 | 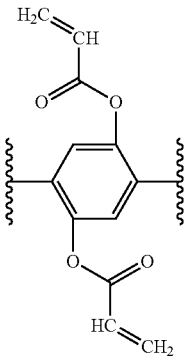 | 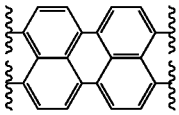 | 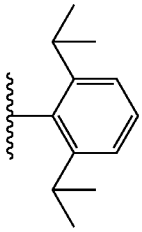 |

TABLE 13-continued
| Exemplified Compound | $R^7$ | $X^1$ | Y | $X^2$ | $R^8$ |
|---|---|---|---|---|---|
| E126 | 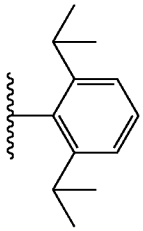 | 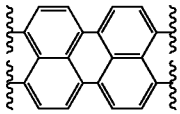 | 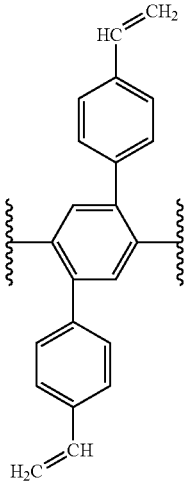  | 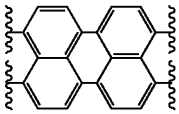 | 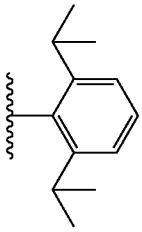 |
| E127 | 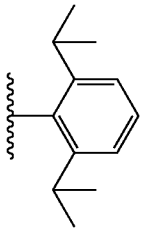 | 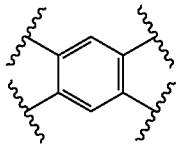 | 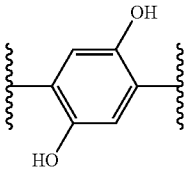  | 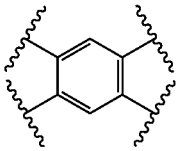 | 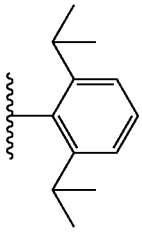 |
| E128 | 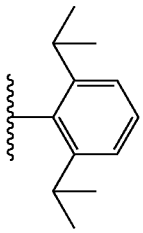 | 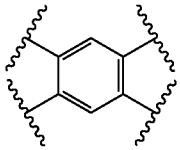 | 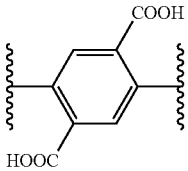  | 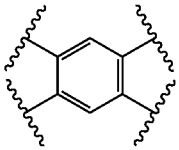 | 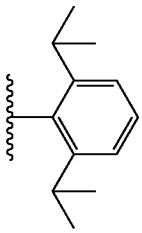 |
| E129 | 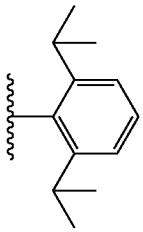 | 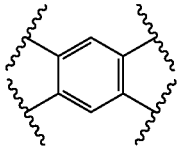 | 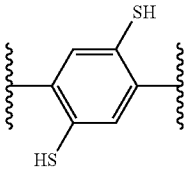  | 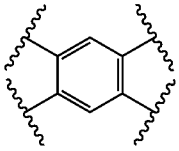 | 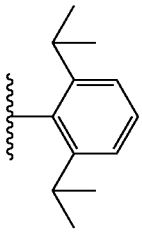 |
| E130 | 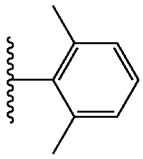 | 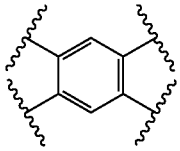 | 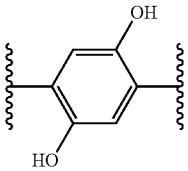  | 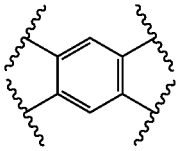 | 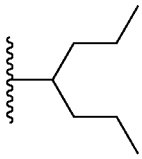 |

TABLE 13-continued
| Exemplified Compound | $R^7$ | $X^1$ | Y | $X^2$ | $R^8$ |
|---|---|---|---|---|---|
| E131 | 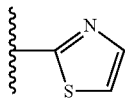 | 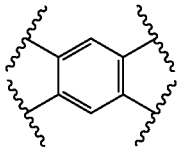 | 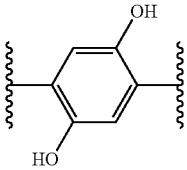 | 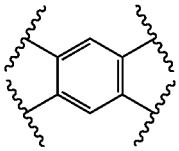 | 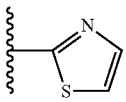 |
| E132 | 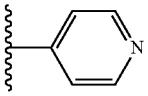 | 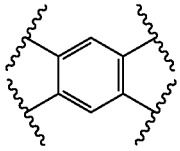 | 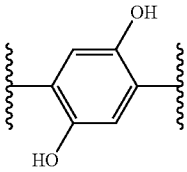 | 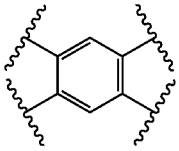 | 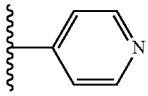 |
| E133 | 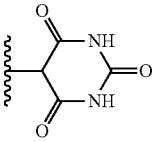 | 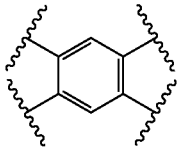 | 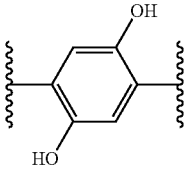 | 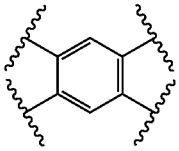 | 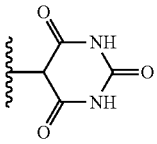 |
| E134 | 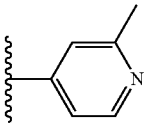 | 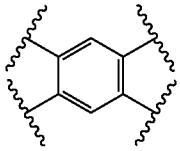 | 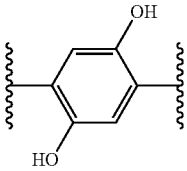 | 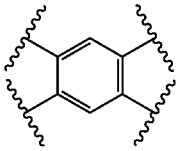 | 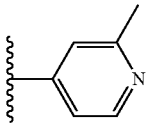 |
| E135 | 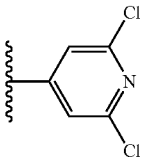 | 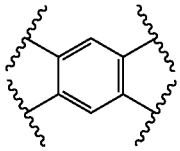 | 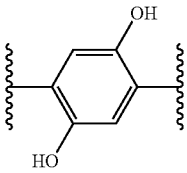 | 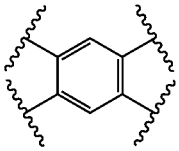 | 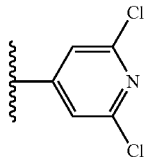 |
| E136 | 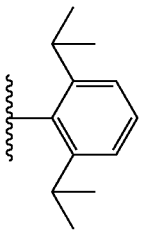 | 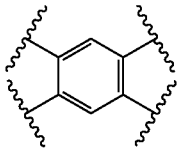 | 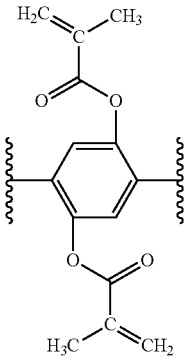 | 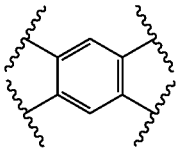 | 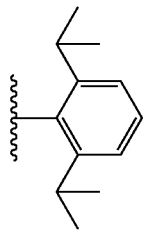 |

TABLE 13-continued
| Exemplified Compound | $R^7$ | $X^1$ | Y | $X^2$ | $R^8$ |
|---|---|---|---|---|---|
| E137 | 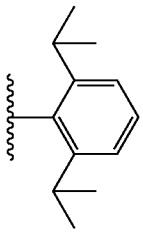 | 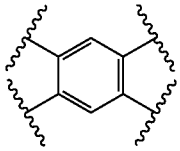 | 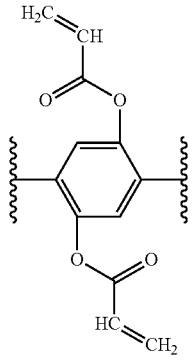 | 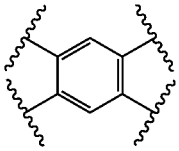 | 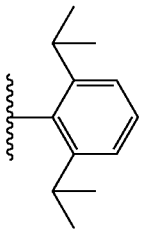 |
| E138 | 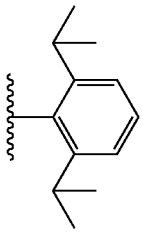 | 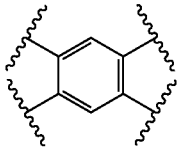 | 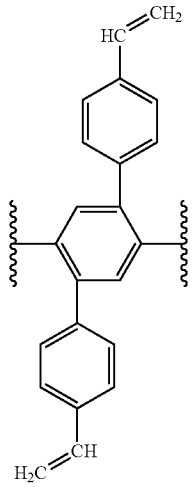 | 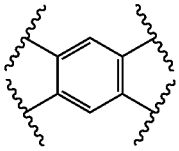 | 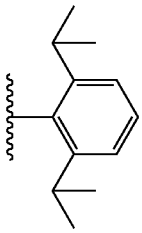 |
| E139 | 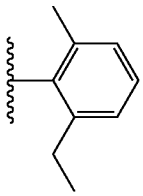 | 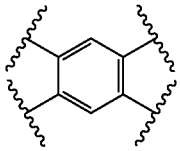 | 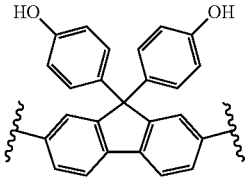 | 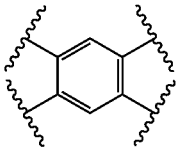 | 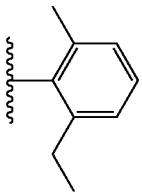 |
| E140 | 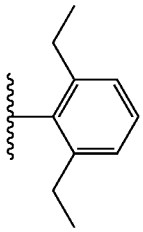 | 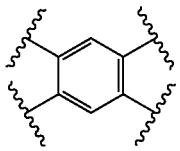 | 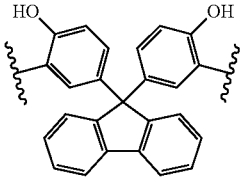 | 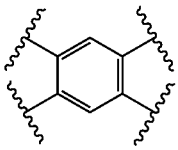 | 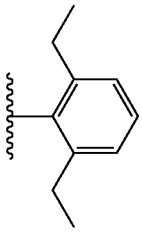 |
| E141 | 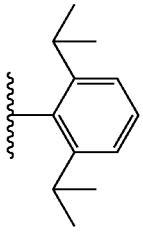 | 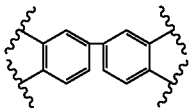 | 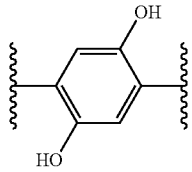 | 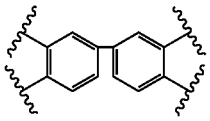 | 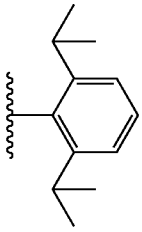 |

TABLE 13-continued
| Exemplified Compound | $R^7$ | $X^1$ | Y | $X^2$ | $R^8$ |
|---|---|---|---|---|---|
| E142 | 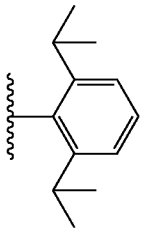 | 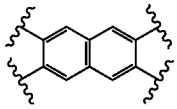 | 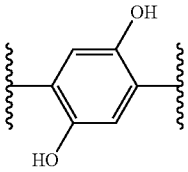 | 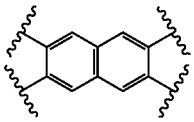 | 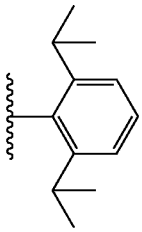 |
| E143 | 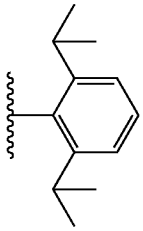 | 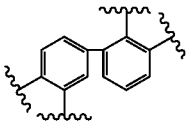 | 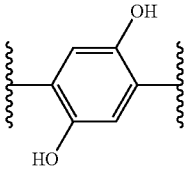 | 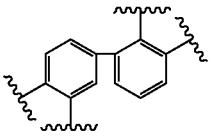 | 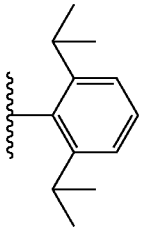 |
| E144 | 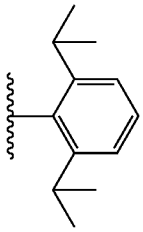 | 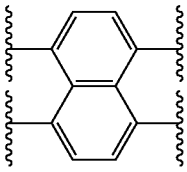 | 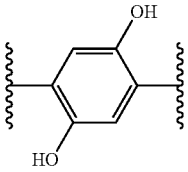 | 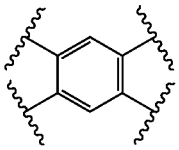 | 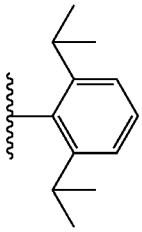 |
| E145 | 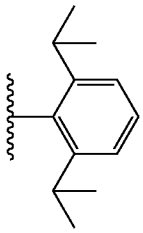 | 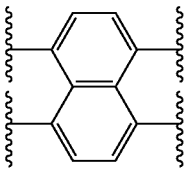 | 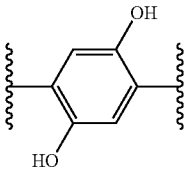 | 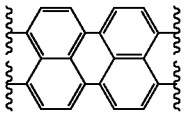 | 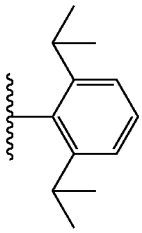 |
| E146 | 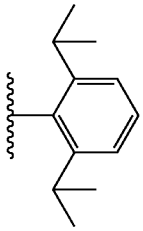 | 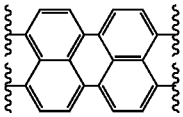 | 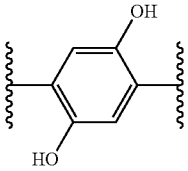 | 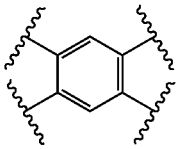 | 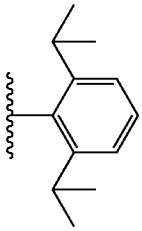 |
| E147 | 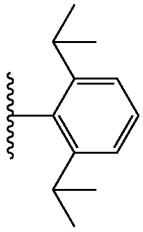 | 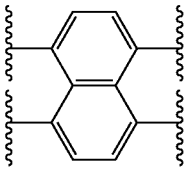 | 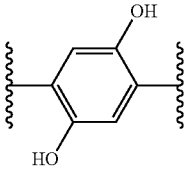 | 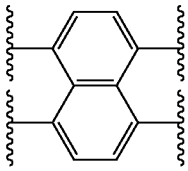 | 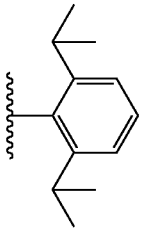 |

TABLE 14
| Exemplified Compound | $R^7$ | $X^1$ | Y | $X^2$ | $R^8$ |
|---|---|---|---|---|---|
| E201 | 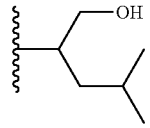 | 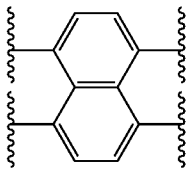 | 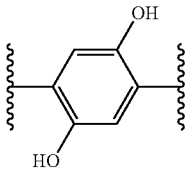 | 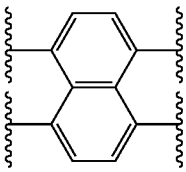 | 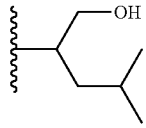 |
| E202 | 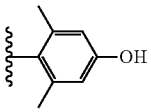 | 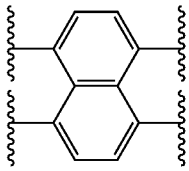 | 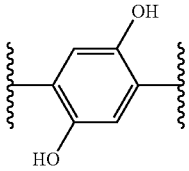 | 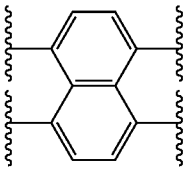 | 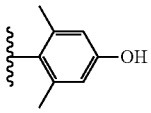 |
| E203 | 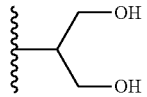 | 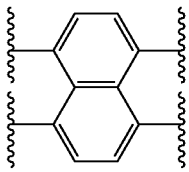 | 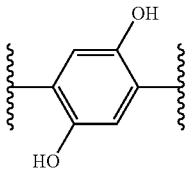 | 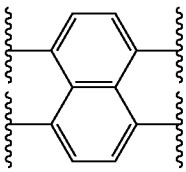 | 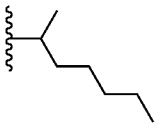 |
| E204 | 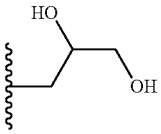 | 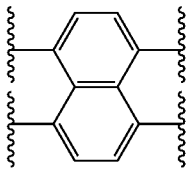 | 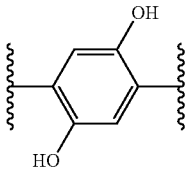 | 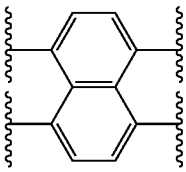 | 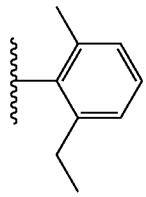 |
| E205 | 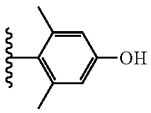 | 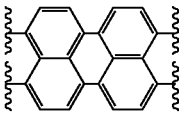 | 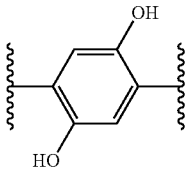 | 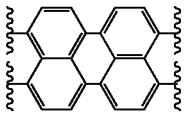 | 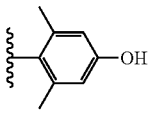 |
| E206 | 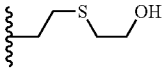 | 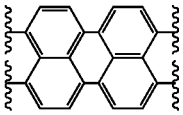 | 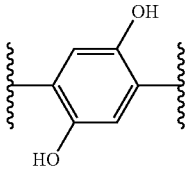 | 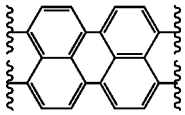 | 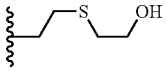 |
| E207 | 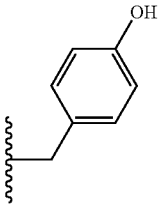 | 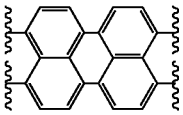 | 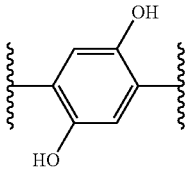 | 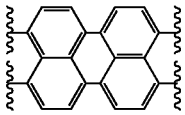 | 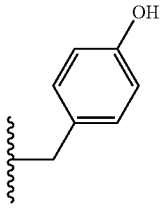 |
| E208 | 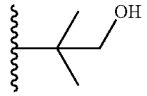 | 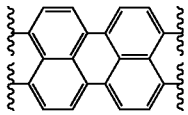 | 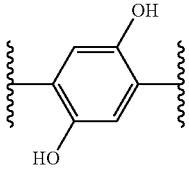 | 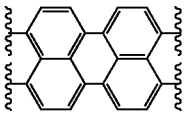 | 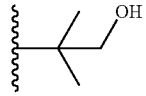 |

TABLE 14-continued
| Exemplified Compound | $R^7$ | $X^1$ | Y | $X^2$ | $R^8$ |
|---|---|---|---|---|---|
| E209 | 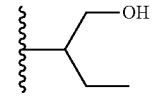 | 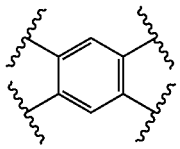 | 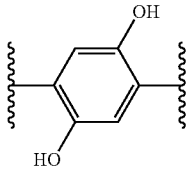 | 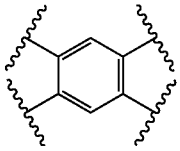 | 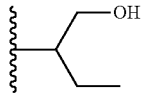 |
| E210 | 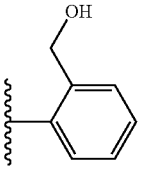 | 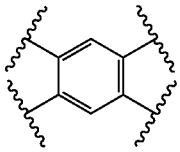 | 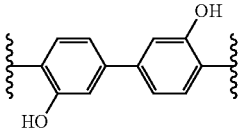 | 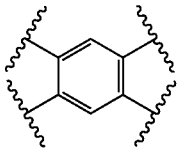 | 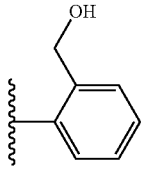 |
| E211 | 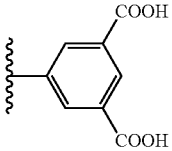 | 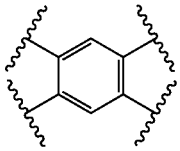 | 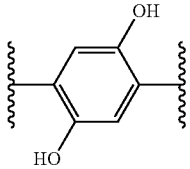 | 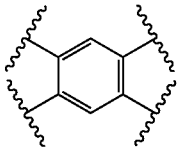 | 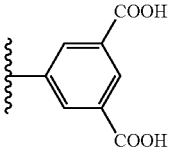 |
| E212 | 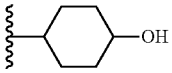 | 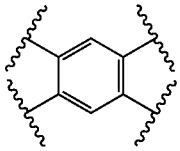 | 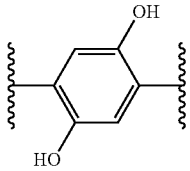 | 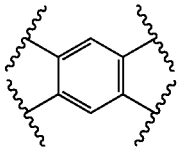 | 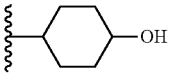 |
TABLE 15
| Exemplified Compound | $R^7$ | $X^1$ | Y | $X^2$ | $R^8$ |
|---|---|---|---|---|---|
| E301 | 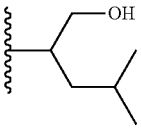 | 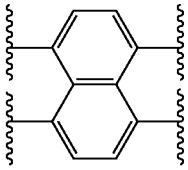 | 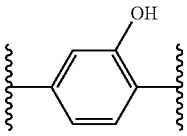 | 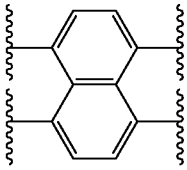 | 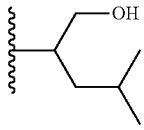 |
| E302 | 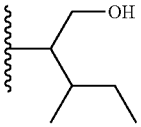 | 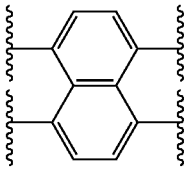 | 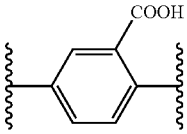 | 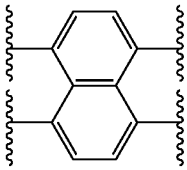 | 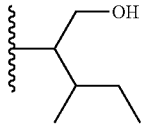 |
| E303 | 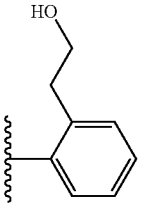 | 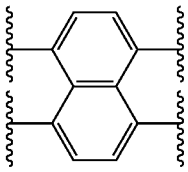 | 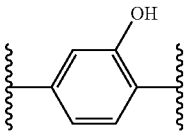 | 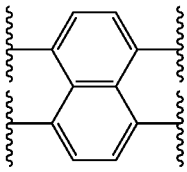 | 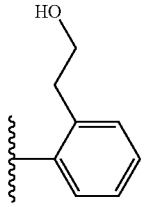 |

TABLE 15-continued
| Exemplified Compound | $R^7$ | $X^1$ | Y | $X^2$ | $R^8$ |
|---|---|---|---|---|---|
| E304 | 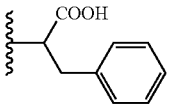 | 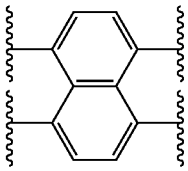 | 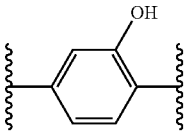 | 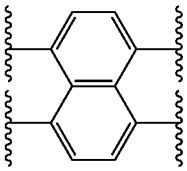 | 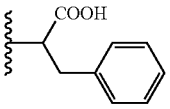 |
| E305 | 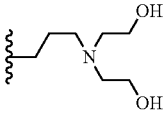 | 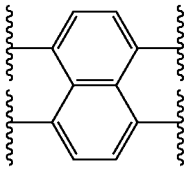 | 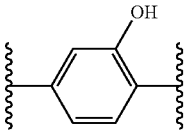 | 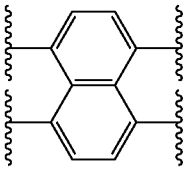 | 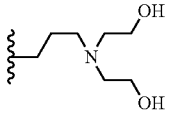 |
| E306 | 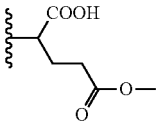 | 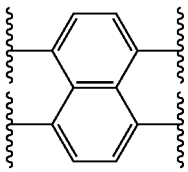 | 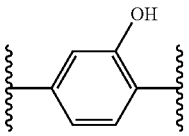 | 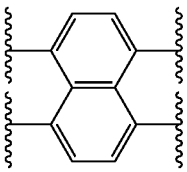 | 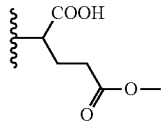 |
| E307 | 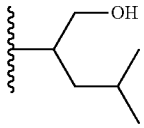 | 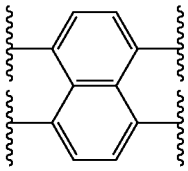 | 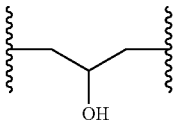 | 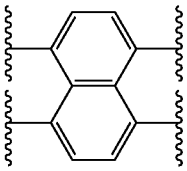 | 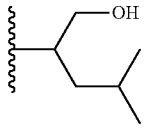 |
| E308 | 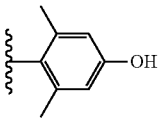 | 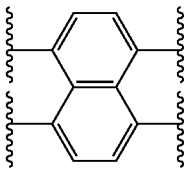 | 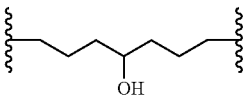 | 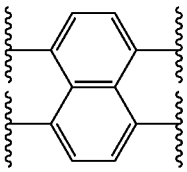 | 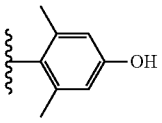 |
| E309 | 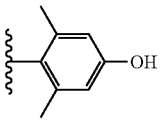 | 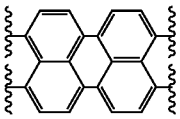 | 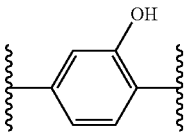 | 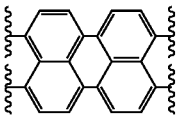 | 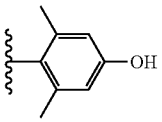 |
| E310 | 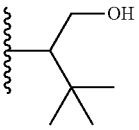 | 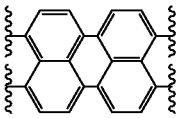 | 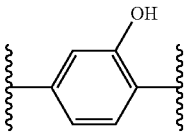 | 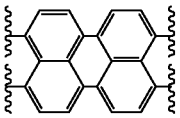 | 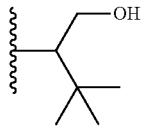 |
| E311 | 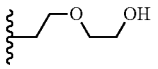 | 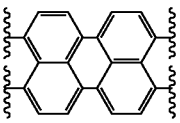 | 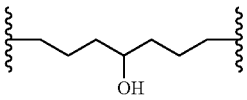 | 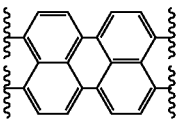 | 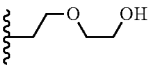 |
| E312 | 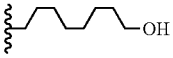 | 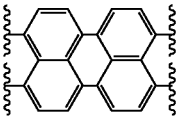 | 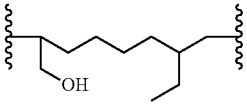 | 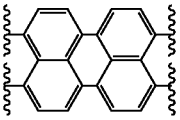 | 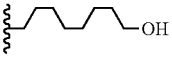 |

TABLE 15-continued
| Exemplified Compound | $R^7$ | $X^1$ | Y | $X^2$ | $R^8$ |
|---|---|---|---|---|---|
| E313 | 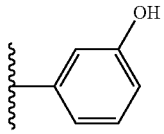 | 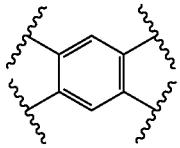 | 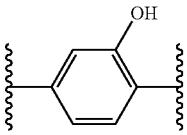 | 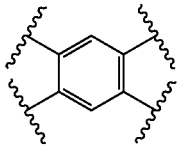 | 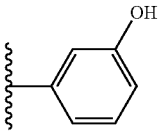 |
| E314 | 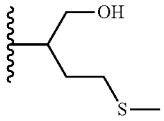 | 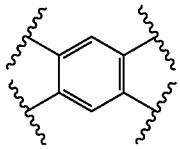 | 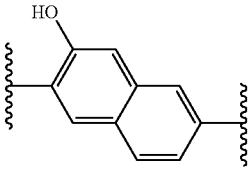 | 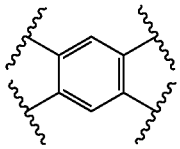 | 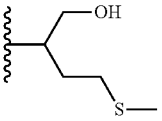 |
| E315 | 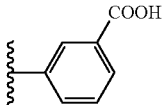 | 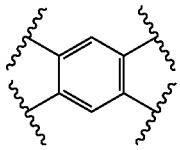 | 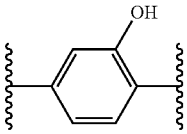 | 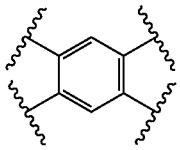 | 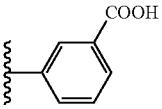 |
| E316 | 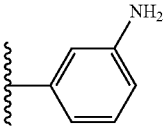 | 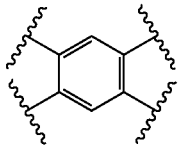 | 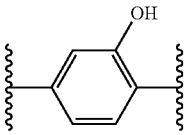 | 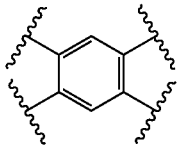 | 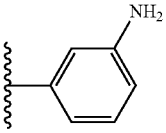 |
| E317 | 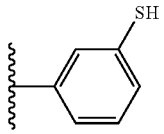 | 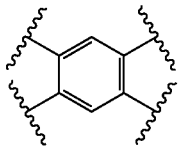 | 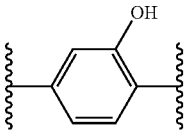 | 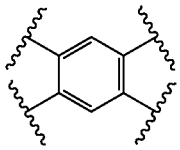 | 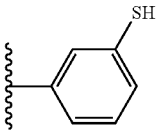 |
| E318 | 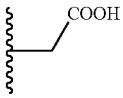 | 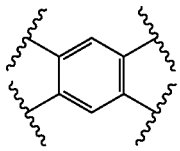 | 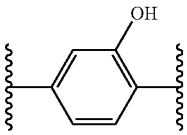 | 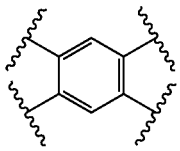 | 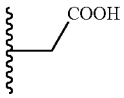 |
| E319 | 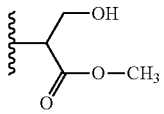 | 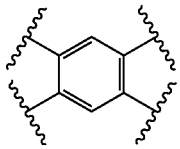 | 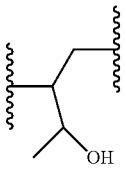 | 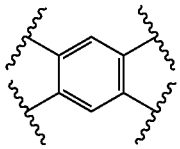 | 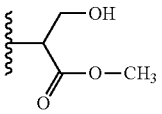 |
| E320 | 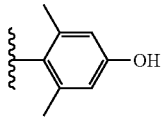 | 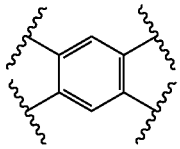 | 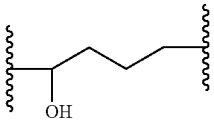 | 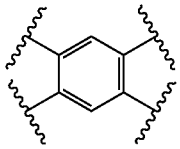 | 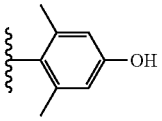 |

TABLE 16
| Exemplified Compound | $R^7$ | $X^1$ | Y | $X^2$ | $R^8$ |
|---|---|---|---|---|---|
| E401 | 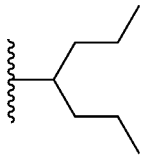 | 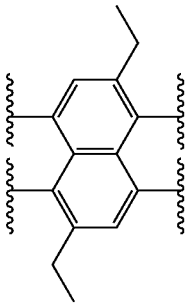 | 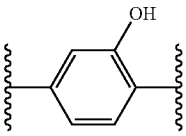 | 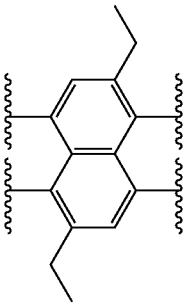 | 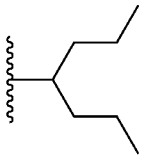 |
| E402 | 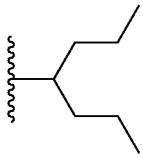 | 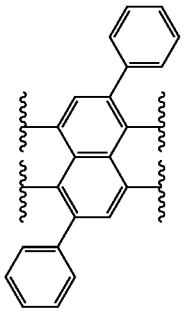 | 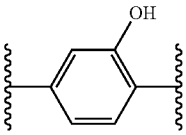 | 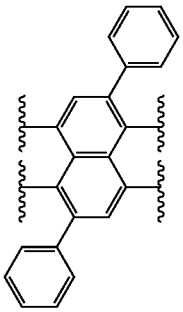 | 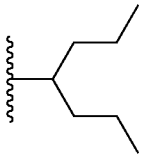 |
| E403 | 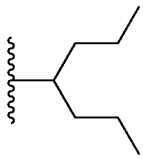 | 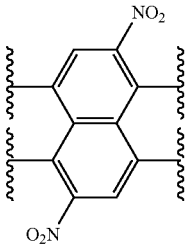 | 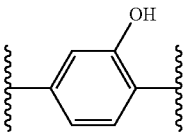 | 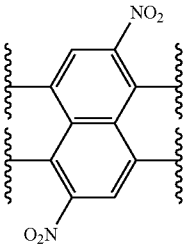 | 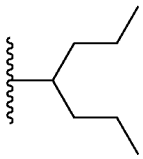 |
| E404 | 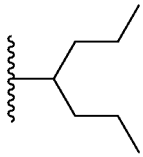 | 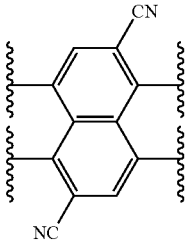 | 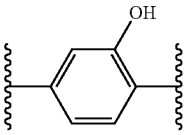 | 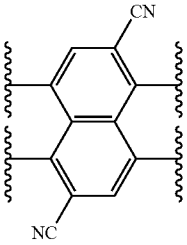 | 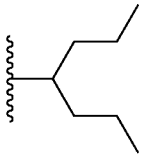 |
| E405 | 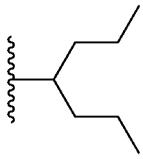 | 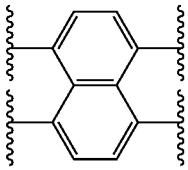 | 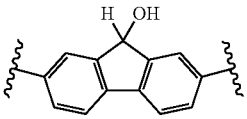 | 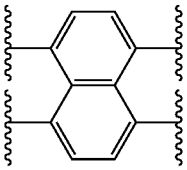 | 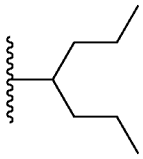 |
| E406 | 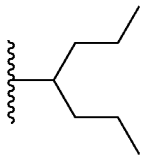 | 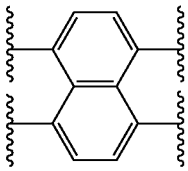 | 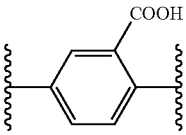 | 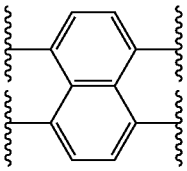 | 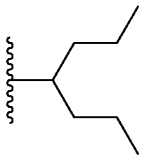 |

TABLE 16-continued
| Exemplified Compound | $R^7$ | $X^1$ | Y | $X^2$ | $R^8$ |
|---|---|---|---|---|---|
| E407 | 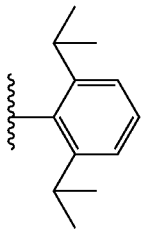 | 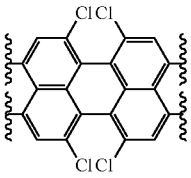 | 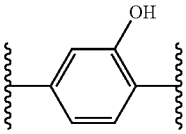 | 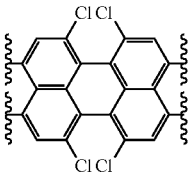 | 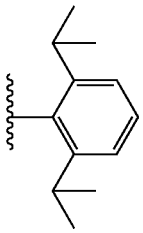 |
| E408 | 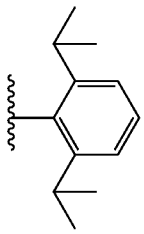 | 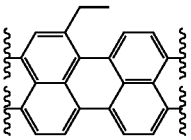 | 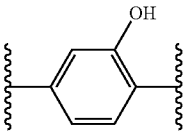 | 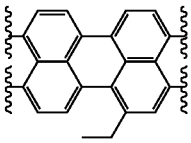 | 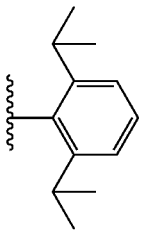 |
| E409 | 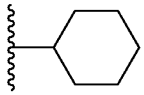 | 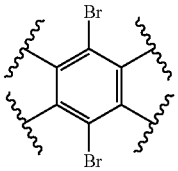 | 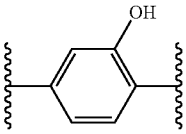 | 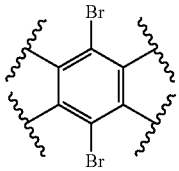 | 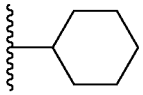 |
| E410 | 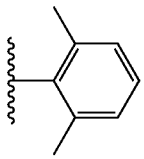 | 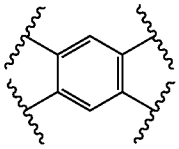 | 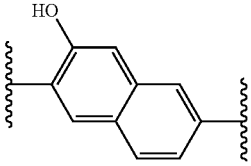 | 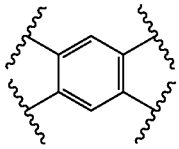 | 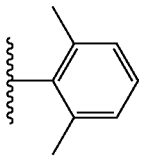 |
| E411 | 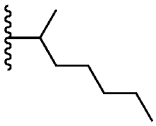 | 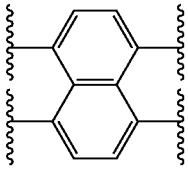 | 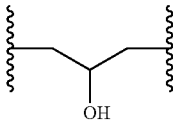 | 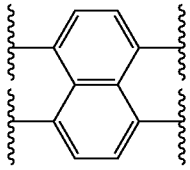 | 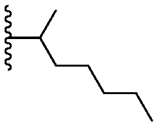 |
| E412 | 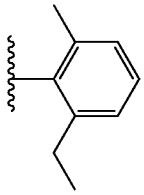 | 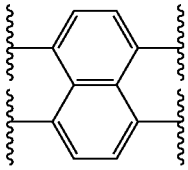 | 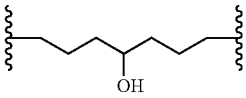 | 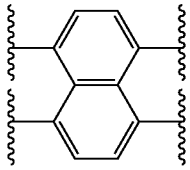 | 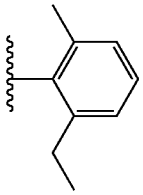 |
| E413 | 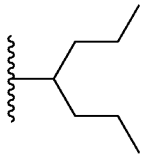 | 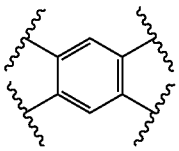 | 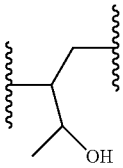 | 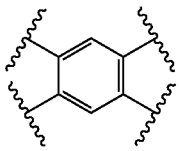 | 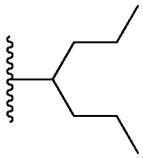 |

TABLE 16-continued
| Exemplified Compound | $R^7$ | $X^1$ | Y | $X^2$ | $R^8$ |
|---|---|---|---|---|---|
| E414 | 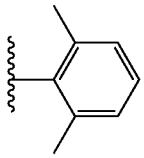 | 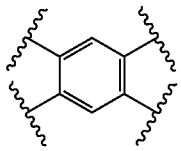 | 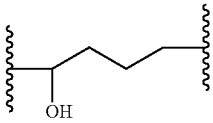 | 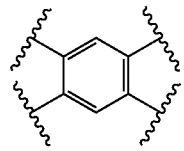 | 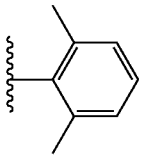 |
| E415 | 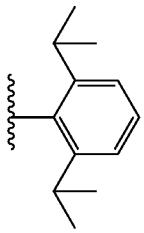 | 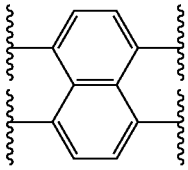 | 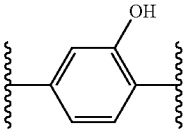 | 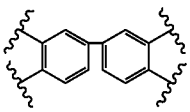 | 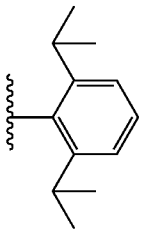 |
| E416 | 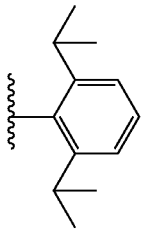 | 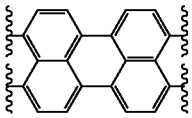 | 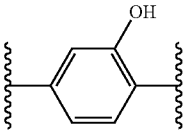 | 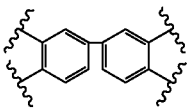 | 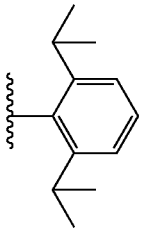 |
| E417 | 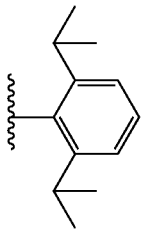 | 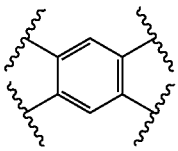 | 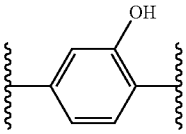 | 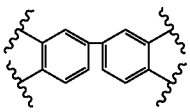 | 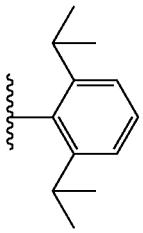 |
| E418 | 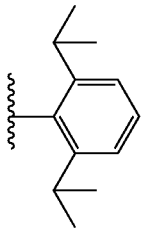 | 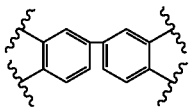 | 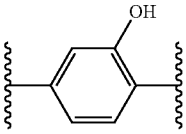 | 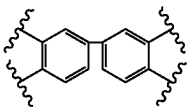 | 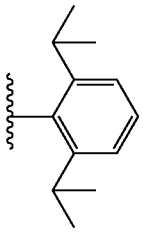 |
| E419 | 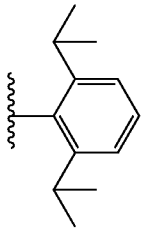 | 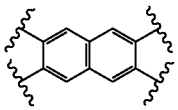 | 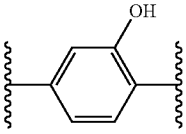 | 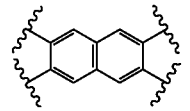 | 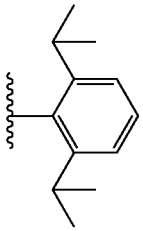 |

TABLE 16-continued

| Exemplified Compound | $R^7$ | $X^1$ | Y | $X^2$ | $R^8$ |
|---|---|---|---|---|---|
| E420 | 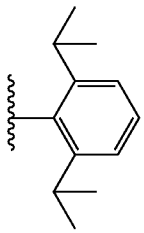 | 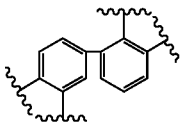 | 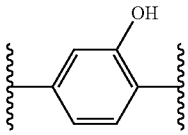 | 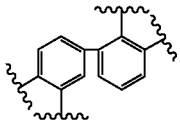 | 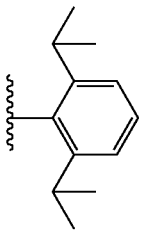 |

The compound represented by the formula (11) in the present invention can be synthesized through use of a known synthesis method disclosed in, for example, Japanese Patent Application Laid-Open No. 2007-108670 or Journal of the Imaging Society of Japan, 45(6), 521-525, (2006). In addition, the compound is also available as a reagent from, for example, Tokyo Chemical Industry Co. Ltd., Sigma-Aldrich Japan, or Johnson Matthey Japan Inc.

As a method of introducing a polymerizable functional group when synthesizing the compound represented by the formula (11), there are two methods. One of the methods is (i) a method involving directly introducing the polymerizable functional group when synthesizing the compound represented by the formula (11). The other is (ii) a method involving forming a skeleton of the compound represented by the formula (11) having a group that is to serve as a basis for introducing the polymerizable functional group and then introducing a structure having the polymerizable functional group when synthesizing the compound represented by the formula (11). As the method of (ii), there is given, for example, a method involving introducing an aryl group containing a functional group into the compound represented by the formula (11) in which $R^7$, $R^8$, or Y represents a halogen-substituted naphthyl group by means of a cross-coupling reaction using a palladium catalyst and a base. Further, a $FeCl_3$ catalyst may be used in place of the palladium catalyst. Further, also available is a method involving subjecting the compound represented by the formula (11) in which $R^7$, $R^8$, or Y represents a halogen-substituted naphthyl group to lithiation, and causing an epoxy compound or $CO_2$ to act on the resultant to introduce a hydroxyalkyl group or a carboxyl group.

Further, as a method of introducing an unsaturated hydrocarbon group (for example, acryloyl, methacryloyl, or styrene) when synthesizing the compound represented by the formula (11), there is given the following method. That is, there is given a method involving using a monoamine having the unsaturated hydrocarbon group as a structure for $R^7$ or $R^8$ or as a structure for the Y moiety which is a diamine when synthesizing the compound represented by the formula (11). There is also given a method involving deriving an ester of acrylic acid or methacrylic acid from a hydroxyl group of the compound represented by the formula (11) having a hydroxyl group to introduce an acryloyl group or a methacryloyl group.

The compound and the like according to the present invention were confirmed by the following method.

Mass Analysis

A molecular weight was measured under the conditions of an acceleration voltage of 20 kV, a mode of Reflector, and a molecular weight standard product of fullerene $C_{60}$ through use of a mass spectrometer (MALDI-TOF MS, ultraflex, manufactured by Bruker Daltonics Inc.). The molecular weight was confirmed based on the obtained peak-top value.

A synthesis example of the compound represented by the formula (11) is described.

(Synthesis Example)

13.4 g (50 mmol) of 1,4,5,8-naphthalenetetracarboxylic acid dianhydride and 70 ml of dimethylacetamide were loaded into a 300-ml three-necked flask under a nitrogen stream at room temperature. A mixture of 5.7 g (50 mmol) of 4-heptylamine and 30 ml of dimethylacetamide was dropped into the three-necked flask under stirring. After the completion of dropping, the resultant was heated to 50° C. and then stirred at this temperature for 2 hours. Further, 5.4 g (25 mmol) of 3,3'-dihydroxybenzidine and 30 ml of dimethylacetamide were added to the resultant and the mixture was refluxed by heating for 6 hours. After the completion of the reaction, the vessel was cooled and the resultant was concentrated under reduced pressure. The residue was purified by silica gel column chromatography. Further, the recovered product was recrystallized with toluene/ethyl acetate to obtain 2.4 g of Exemplified Compound (E106).

Next, the cross-linking agent is described. A compound having a reactive group that polymerizes or cross-links with the electron transport material having a polymerizable functional group and the thermoplastic resin having a polymerizable functional group can be used as the cross-linking agent. Specifically, for example, a compound described in the "Cross-linking Agent Handbook" edited by Shinzo Yamashita and Tosuke Kaneko, and published by TAISEISHA LTD. (1981) can be used.

The cross-linking agent to be used in the undercoat layer is preferably a compound having 2 to 6 isocyanate groups, 2 to 6 blocked isocyanate groups, or 2 to 6 groups each represented by $—CH_2—OR^6$ ($R^6$ represents an alkyl group). The compound is specifically an isocyanate compound having isocyanate groups or blocked isocyanate groups or an amine compound having groups each represented by $—CH_2—OR^6$. Of those, an isocyanate compound having 2 to 6 isocyanate groups or 2 to 6 blocked isocyanate groups is preferred. Examples of the isocyanate compound include triisocyanatobenzene, triisocyanatomethylbenzene, triphenylmethane triisocyanate, lysine triisocyanate, and an isocyanurate modified product, biuret modified product, allophanate modified product, and trimethylolpropane or pentaerythritol adduct modified product of a diisocyanate such as tolylene diisocyanate, hexamethylene diisocyanate, dicyclohexylmethane diisocyanate, naphthalene diisocyanate, diphenylmethane diisocyanate, isophorone diisocyanate, xylylene diisocyanate, 2,2,4-trimethylhexamethylene diisocyanate, methyl 2,6-diisocyanatohexanoate, or norbornane diisocyanate. Of those, an isocyanurate modified product and an adduct modified product are more preferred.

The blocked isocyanate group is a group having a structure represented by —NHCOX$^3$ (where X$^3$ represents a protective group). Although X$^3$ may represent any protective group as long as the protective group can be introduced into an isocyanate group, X$^3$ preferably represents a group represented by any one of the following formulae (H1) to (H7).

(H1)

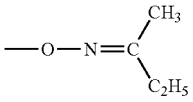

(H2)

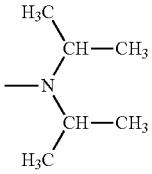

(H3)

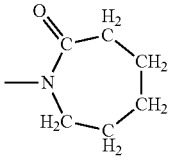

-continued (H4)

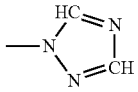

(H5)

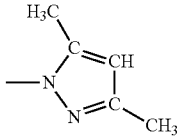

(H6)

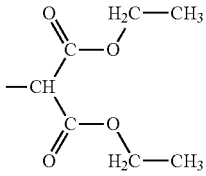

(H7)

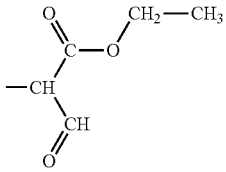

Specific examples (B1) to (B21) of the isocyanate compound are shown below.

(B1)

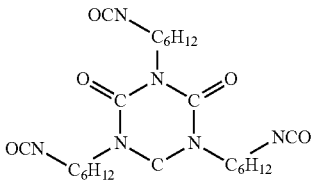

(B2)

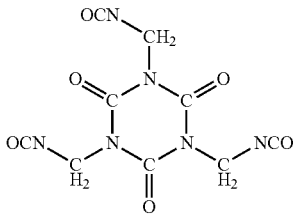

(B3)

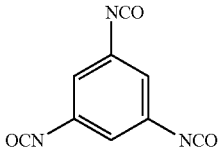

(B4)

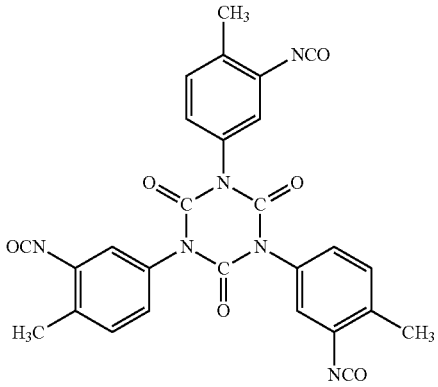

-continued
(B5)
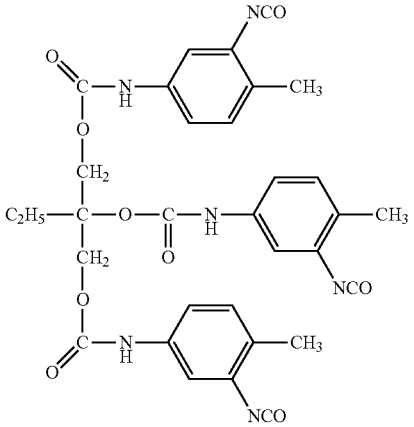
(B6)
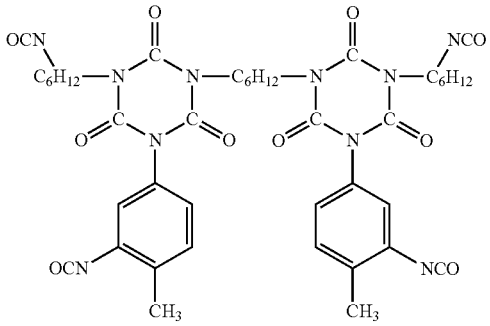
(B7)
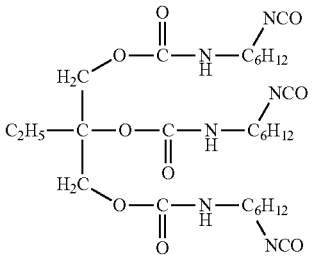
(B8)
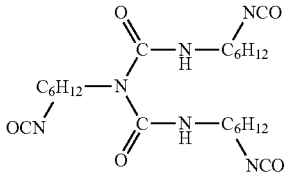
(B9)
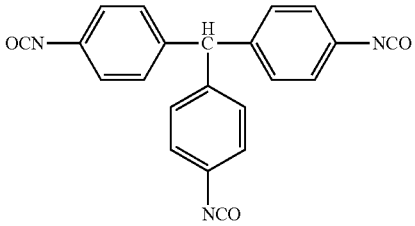
(B10)
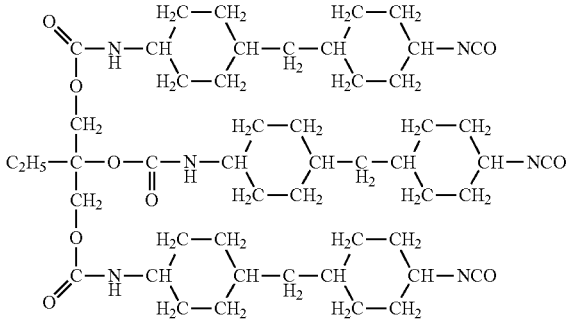
(B11)
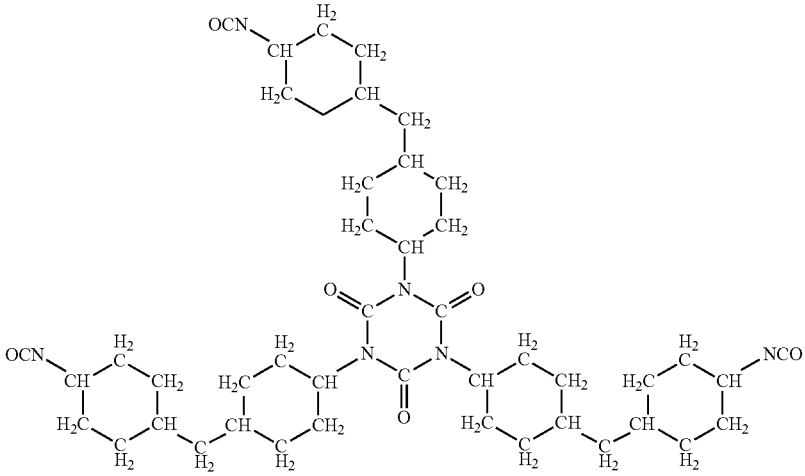

-continued
(B12)
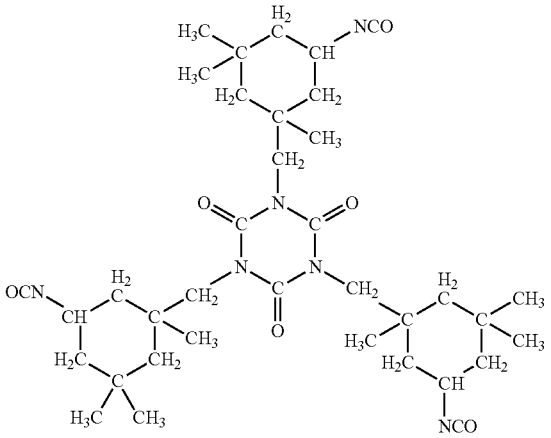
(B13)
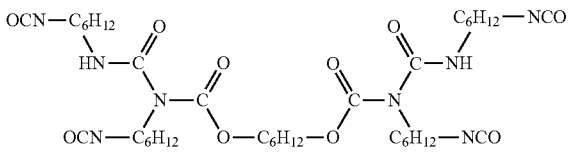
(B14)
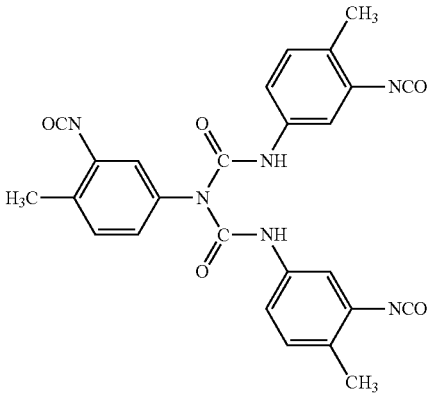
(B15)
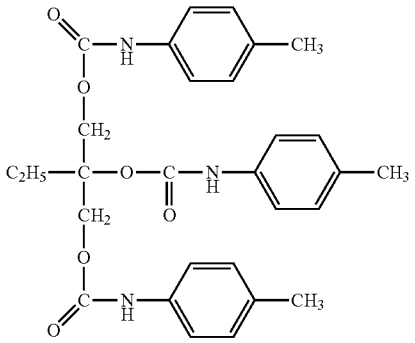
(B16)
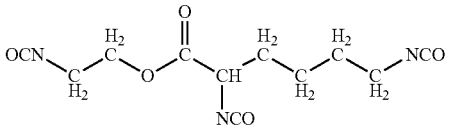
(B17)
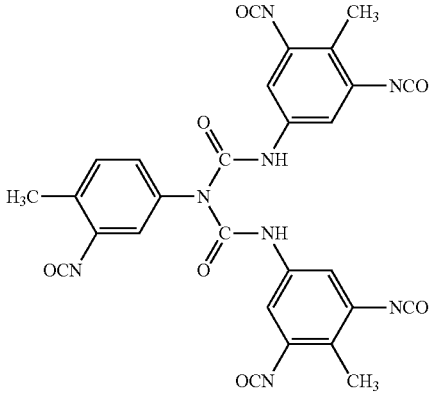

-continued (B18)

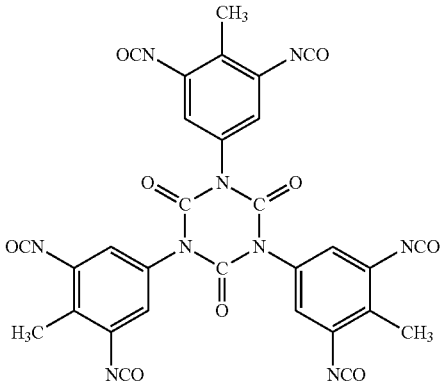

(B19)

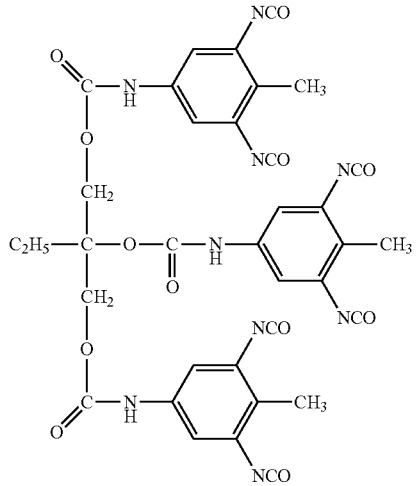

(B20)

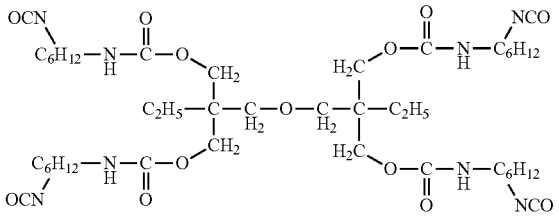

(B21)

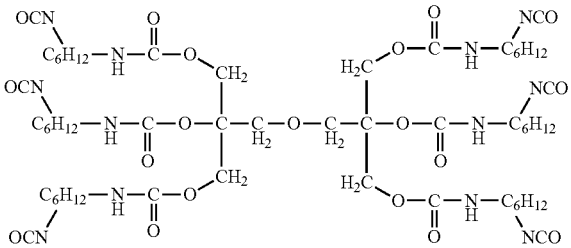

As the amine compound, for example, an amine compound having 2 to 6 groups each represented by —$CH_2$—$OR^6$ is preferred. As the amine compound, for example, there are given a melamine compound, a guanamine compound, and a urea compound. Preferred specific examples of the amine compound include a compound represented by any one of the following formulae (C1) to (C5) and an oligomer of the compound represented by any one of the following formulae (C1) to (C5).

(C1)

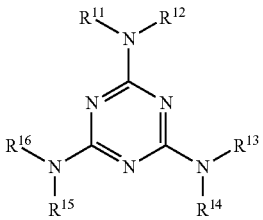

(C2)

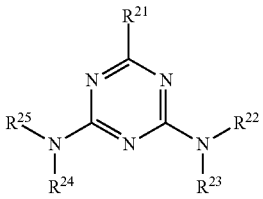

-continued (C3)

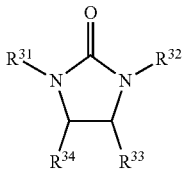

(C4)

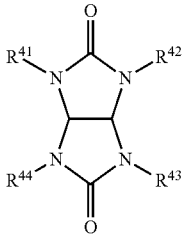

(C5)

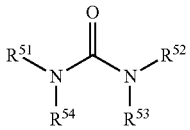

In the formulae (C1) to (C5), $R^{11}$ to $R^{16}$, $R^{22}$ to $R^{25}$, $R^{31}$ to $R^{34}$, $R^{41}$ to $R^{44}$, and $R^{51}$ to $R^{54}$ each independently represent a hydrogen atom, a hydroxyl group, an acyl group, or a monovalent group represented by —$CH_2$—$OR^6$. At least one of $R^{11}$ to $R^{16}$, at least one of $R^{22}$ to $R^{25}$, at least one of $R^{31}$ to $R^{34}$, at least one of $R^{41}$ to $R^{44}$, and at least one of $R^{51}$ to $R^{54}$ each represent a monovalent group represented by —$CH_2$—$OR^6$. $R^6$ represents a hydrogen atom or an alkyl group having 1 or more and 10 or less carbon atoms. The alkyl group is preferably a methyl group, an ethyl group, a propyl group (n-propyl group or iso-propyl group), a butyl group (n-butyl group, iso-butyl group, or tert-butyl group), or the like from the viewpoint of polymerizability. $R^{21}$ represents an aryl group, an aryl group substituted with alkyl group, a cycloalkyl group, or a cycloalkyl group substituted with an alkyl group.

Specific examples of the compound represented by any one of the formulae (C1) to (C5) are shown below. Further, the amine compound may contain an oligomer (multimer) of the compound represented by any one of the formulae (C1) to (C5).

The polymerization degree of the multimer is preferably 2 or more and 100 or less. Further, the above-mentioned multimer and monomer can also be used as a mixture of two or more kinds.

A compound that can be generally purchased as the compound represented by the formula (C1) is exemplified by SUPER MELAMI No. 90 (manufactured by NOF CORPORATION), SUPER BECKAMINE (trademark) TD-139-60, L-105-60, L127-60, L110-60, J-820-60, or G-821-60 (manufactured by DIC Corporation), U-VAN 2020 (Mitsui Chemicals, Inc.), Sumitex Resin M-3 (Sumitomo Chemical Company), or NIKALAC MW-30, MW-390, or MX-750LM (manufactured by NIPPON CARBIDE INDUSTRIES CO., INC.).

A compound that can be generally purchased as the compound represented by the formula (C2) is exemplified by SUPER BECKAMINE (trademark) L-148-55, 13-535, L-145-60, or TD-126 (manufactured by DIC Corporation) or NIKALAC BL-60 or BX-4000 (manufactured by NIPPON CARBIDE INDUSTRIES CO., INC.).

A compound that can be generally purchased as the compound represented by the formula (C3) is exemplified by NIKALAC MX-280 (manufactured by NIPPON CARBIDE INDUSTRIES CO., INC.).

A compound that can be generally purchased as the compound represented by the formula (C4) is exemplified by NIKALAC MX-270 (manufactured by NIPPON CARBIDE INDUSTRIES CO., INC.).

A compound that can be generally purchased as the compound represented by the formula (C5) is exemplified by NIKALAC MX-290 (manufactured by NIPPON CARBIDE INDUSTRIES CO., INC.).

Specific examples of the compound represented by the formula (C1) are shown below.

(C1-1)

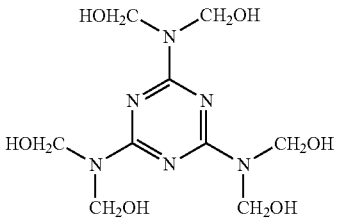

(C1-2)

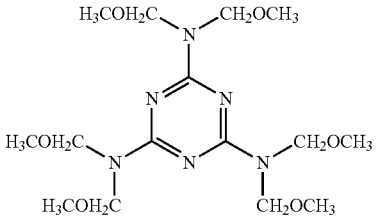

-continued (C1-3)

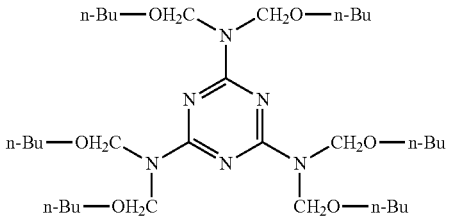

(C1-4)

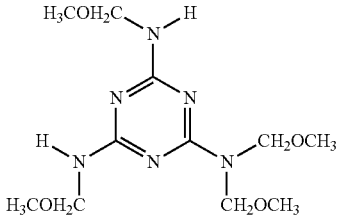

(C1-5)

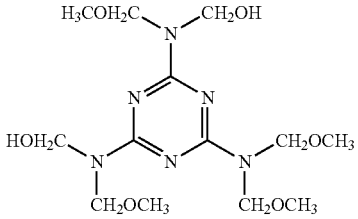

(C1-6)

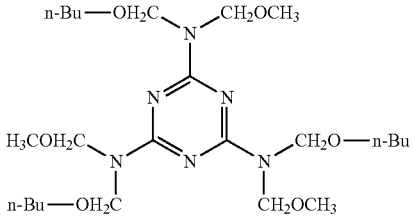

(C1-7)

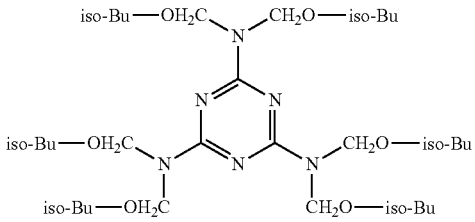

(C1-8)

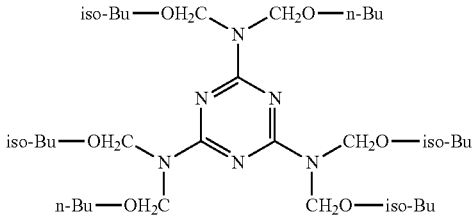

(C1-9)

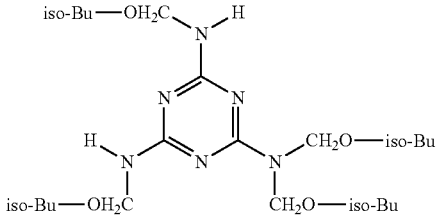

-continued
(C1-10)
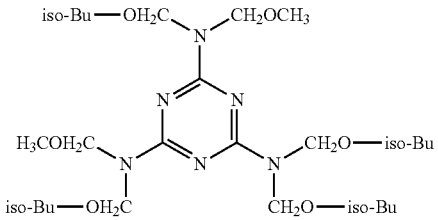
(C1-11)
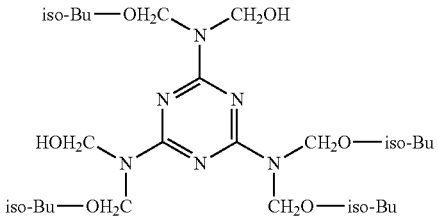
(C1-12)
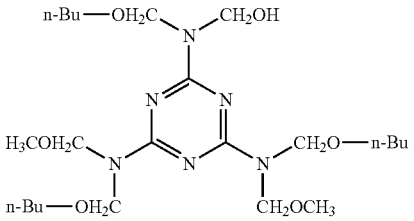
Specific examples of the compound represented by the formula (C2) are shown below.
(C2-1)
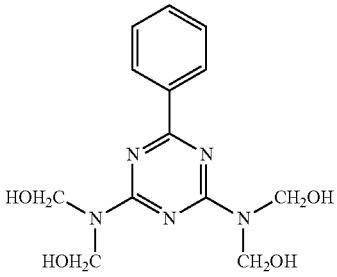
(C2-2)
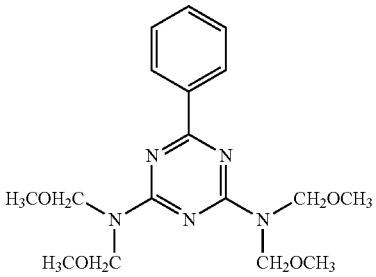
-continued
(C2-3)
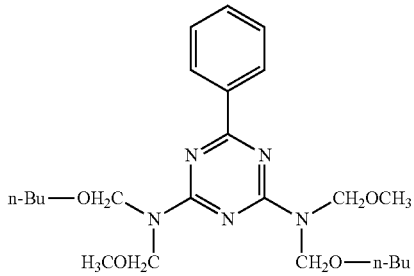
(C2-4)
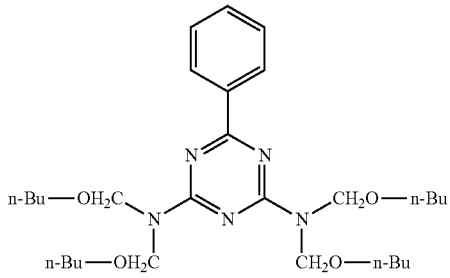
(C2-5)
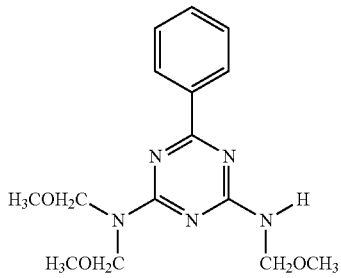
(C2-7)
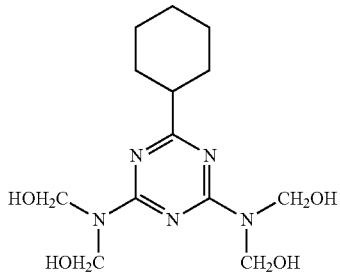
(C2-8)
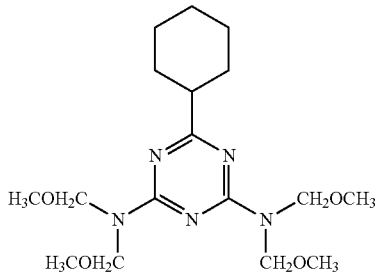

-continued
(C2-9)
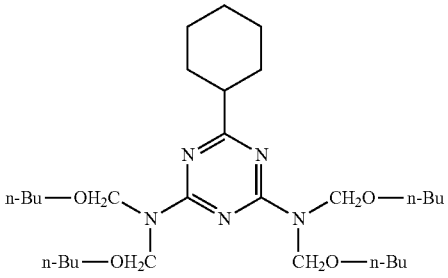
(C2-10)
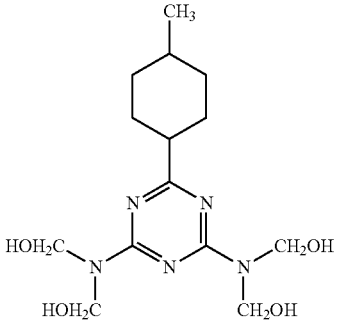
(C2-11)
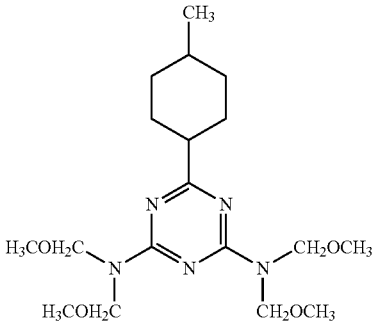
(C2-12)
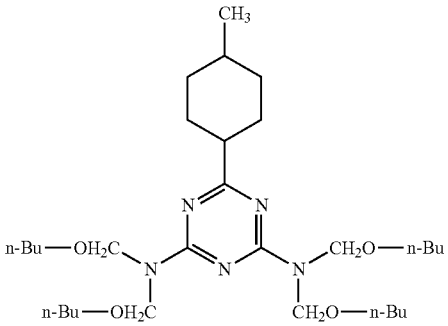
(C2-13)
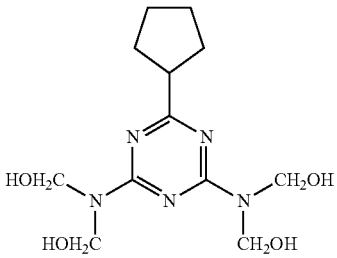
-continued
(C2-14)
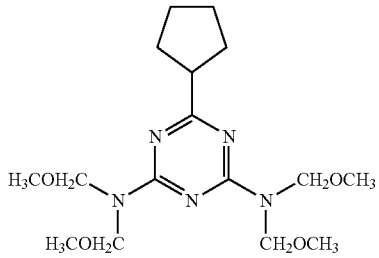
(C2-15)
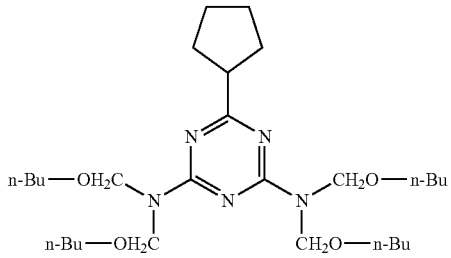
(C2-16)
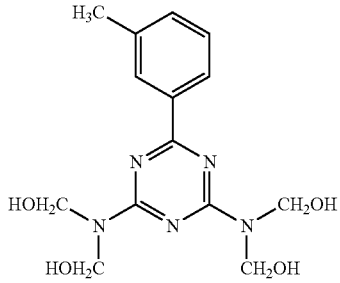
(C2-17)
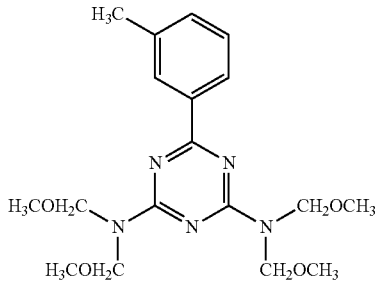
(C2-18)
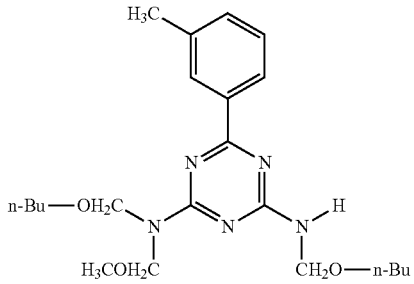
Specific examples of the compound represented by the formula (C3) are shown below.

(C3-1)
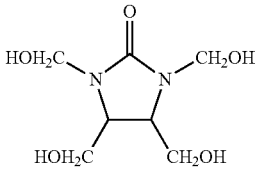
(C3-2)
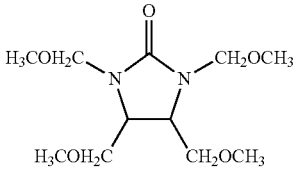
(C3-3)
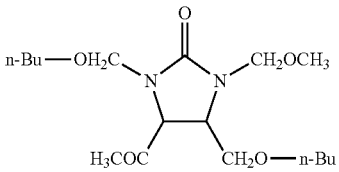
(C3-4)
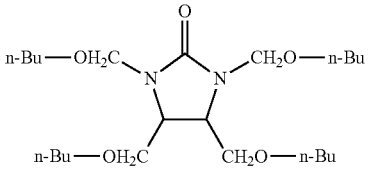
(C3-5)
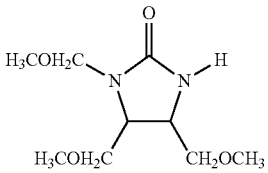
(C3-6)
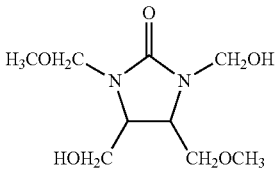
Specific examples of the compound represented by the formula (C4) are shown below.
(C4-1)
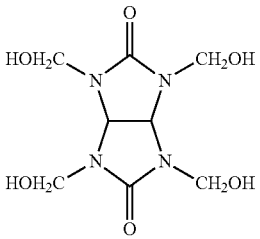
-continued
(C4-2)
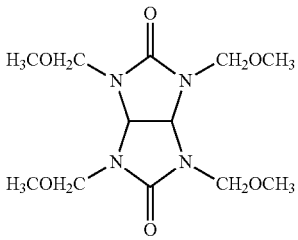
(C4-3)
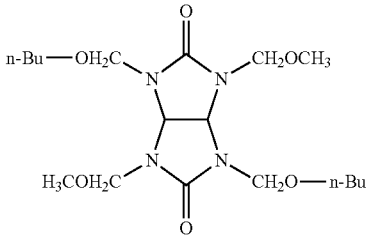
(C4-4)
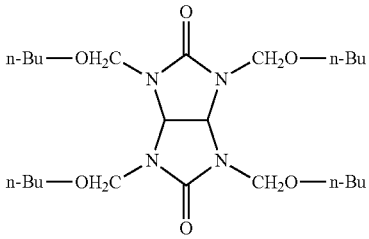
(C4-5)
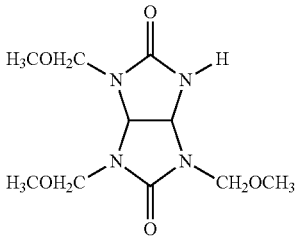
(C4-6)
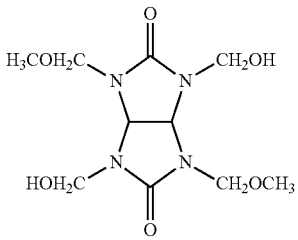
Specific examples of the compound represented by the formula (C5) are shown below.
(C5-1)
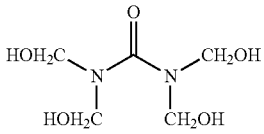

-continued (C5-2)

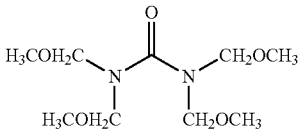

(C5-3)

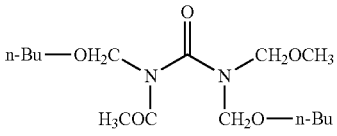

(C5-4)

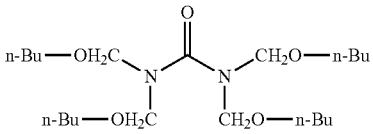

(C5-5)

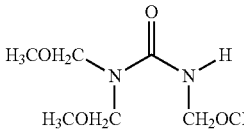

(C5-6)

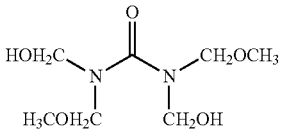

Next, the thermoplastic resin having a polymerizable functional group is described. The thermoplastic resin having a polymerizable functional group is preferably a thermoplastic resin having a structural unit represented by the following formula (D).

(D)

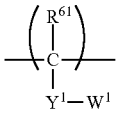

In the formula (D), $R^{61}$ represents a hydrogen atom or an alkyl group, $Y^1$ represents a single bond, an alkylene group, or a phenylene group, and $W^1$ represents a hydroxyl group, a thiol group, an amino group, a carboxyl group, or a methoxy group.

Examples of the thermoplastic resin having a structural unit represented by the formula (D) include an acetal resin, a polyolefin resin, a polyester resin, a polyether resin, a polyamide resin, and a cellulose resin. The structural unit represented by the formula (D) may be present in a characteristic structure represented below, or may be present separately from the characteristic structure. The characteristic structures are represented in the following formulae (E-1) to (E-6). The formula (E-1) represents the structural unit of the acetal resin. The formula (E-2) represents the structural unit of the polyolefin resin. The formula (E-3) represents the structural unit of the polyester resin. The formula (E-4) represents the structural unit of the polyether resin. The formula (E-5) represents the structural unit of the polyamide resin. The formula (E-6) represents the structural unit of the cellulose resin.

(E-1)

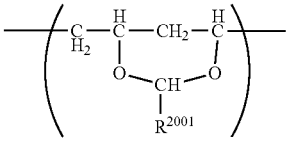

(E-2)

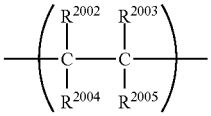

(E-3)

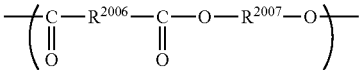

(E-4)

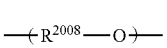

(E-5)

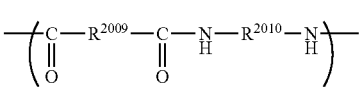

(E-6)

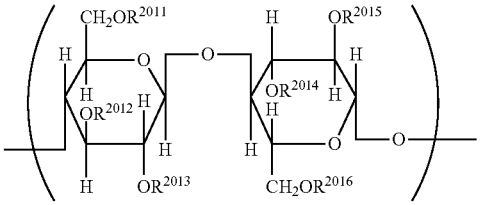

In the formulae, $R^{2001}$ to $R^{2005}$ each independently represent a substituted or unsubstituted alkyl group, or a substituted or unsubstituted aryl group, and $R^{2006}$ to $R^{2010}$ each independently represent a substituted or unsubstituted alkylene group, or a substituted or unsubstituted arylene group. When $R^{2001}$ represents $C_3H_7$, the resin represented by E-1 includes butyral moiety. $R^{2011}$ to $R^{2016}$ each represent an acetyl group, a hydroxyethyl group, a hydroxypropyl group, or a hydrogen atom.

The resin having a structural unit represented by the formula (D) (hereinafter sometimes referred to as "resin D") is obtained by, for example, polymerizing a monomer having a polymerizable functional group (hydroxyl group, thiol group, amino group, carboxyl group, or methoxy group) that can be purchased from Sigma-Aldrich Japan or Tokyo Chemical Industry Co., Ltd.

In addition, the resin D can be generally purchased. Examples of the resin that can be purchased include: a polyether polyol-based resin such as AQD-457 or AQD-473 manufactured by Nippon Polyurethane Industry Co., Ltd., or SANNIX GP-400 or GP-700 manufactured by Sanyo Chemical Industries, Ltd.; a polyester polyol-based resin such as PHTHALKYD W2343 manufactured by Hitachi Chemical Co., Ltd., WATERSOL S-118 or CD-520 or BECKOLITE M-6402-50 or M-6201-40IM manufactured by DIC Corporation, HARIDIP WH-1188 manufactured by Harima Chemicals, Inc., or ES3604 or ES6538 manufactured by Japan U-Pica Company Ltd.; an polyacrylic polyol-based resin such as BURNOCK WE-300 or WE-304 manufactured by DIC Corporation; a polyvinyl alcohol-based resin such as KURARAY POVAL PVA-203 manufactured by KURARAY CO., LTD.; a polyvinyl acetal-based resin such as BX-1 or BM-1 manufactured by Sekisui Chemical Co., Ltd.; a polyamide-based resin such as TORESIN FS-350 manufactured by Nagase ChemteX Corporation; a carboxyl group-containing resin such as AQUALIC manufactured by Nippon Shokubai CO., LTD. or FINELEX SG2000 manufactured by Namariichi Co., Ltd.; a polyamine resin such as LUCKAMIDE manufactured by DIC Corporation; and a polythiol resin such as QE-340M manufactured by Toray Fine Chemicals Co., Ltd. Of those, a polyvinyl acetal-based resin, a polyester polyol-based resin, and the like are more preferred from the viewpoints of polymerizability and uniformity of the undercoat layer.

The weight-average molecular weight (Mw) of the resin D preferably falls within the range of from 5,000 to 400,000.

Examples of a method of quantifying the polymerizable functional group in the resin include: the titration of a carboxyl group with potassium hydroxide; the titration of an amino group with sodium nitrite; the titration of a hydroxyl group with acetic anhydride and potassium hydroxide; the titration of a thiol group with 5,5'-dithiobis(2-nitrobenzoic acid); and a calibration curve method involving obtaining the amount of the polymerizable functional group from the IR spectrum of a sample whose polymerizable functional group introduction ratio has been changed.

Specific examples of the resin D are shown in Table 17 below. In the column "characteristic structure" of Table 17, a structural unit represented by any one of the formulae (E-1) to (E-6), and major structures in the structural units in the cases of "butyral", "polyolefin", "polyester", "polyether", "cellulose", "polyamide", and "acetal" are "polyvinyl butyral", "polyethylene", "polybutylene succinate", "polyoxyphenylene", "cellulose triacetate", "polyhexamethylene adipamide", and "polyvinyl formal", respectively.

The content of the electron transport material having a polymerizable functional group is preferably 50 mass % or more and 85 mass % or less with respect to the total mass of the composition including the electron transport material having a polymerizable functional group, the cross-linking agent, and the resin having a polymerizable functional group. When the content of the electron transport material is 50 mass % or more and 85 mass % or less, a black dot does not occur, and the sensitivity further increases. When the content of the electron transport material is 50 mass % or more, the structurally appropriate distance can be kept between adjacent molecules of the electron transport material, and hence the sensitivity further increases. Further, when the content of the electron transport material is 85 mass % or less, it is considered that the electron transport material is polymerized to accelerate the formation of a network structure, and the effect of suppressing a black dot is further enhanced.

The content of the polymerized product according to the present invention in the undercoat layer is preferably 50 mass % or more and 100 mass % or less, more preferably 80 mass % or more and 100 mass % or less with respect to the total mass of the undercoat layer.

The thickness d1 of the undercoat layer is preferably 0.7 μm or more and 3.0 μm or less. When the thickness d1 is 0.7 μm or more and 3.0 μm or less, the expressions (2) and (3) are likely to be satisfied, and the sensitivity under a high electric field further increases. When the thickness d1 is 0.7 μm or more, an increase in dark attenuation is suppressed, and hence the sensitivity further increases. Further, when the thickness d1 is 3.0 μm or less, the expression (3) is likely to be satisfied, and hence the sensitivity further increases.

TABLE 17

| | Structure | | | Number of moles of functional | Characteristic | Substituent of characteristic | Molecular |
|---|---|---|---|---|---|---|---|
| | $R^{61}$ | $Y^1$ | $W^1$ | group per g | structure | structure | weight |
| D1 | H | Single bond | OH | 3.3 mmol | Butyral | $R^{2001}$=$C_3H_8$ | $1 \times 10^5$ |
| D2 | H | Single bond | OH | 3.3 mmol | Butyral | $R^{2001}$=$C_3H_8$ | $4 \times 10^4$ |
| D3 | H | Single bond | OH | 3.3 mmol | Butyral | $R^{2001}$=$C_3H_8$ | $2 \times 10^4$ |
| D4 | H | Single bond | OH | 1.0 mmol | Polyolefin | $R^{2002}$ to $R^{2005}$=H | $1 \times 10^5$ |
| D5 | H | Single bond | OH | 3.0 mmol | Polyester | $R^{2006}$=$R^{2007}$=$C_2H_4$ | $8 \times 10^4$ |
| D6 | H | Single bond | OH | 2.5 mmol | Polyether | $R^{208}$=$C_4H_8$ | $5 \times 10^4$ |
| D7 | H | Single bond | OH | 2.1 mmol | Polyether | $R^{2008}$=$C_4H_9$ | $2 \times 10^5$ |
| D8 | H | Single bond | COOH | 3.5 mmol | Polyolefin | $R^{102}$ to $R^{105}$=H | $6 \times 10^4$ |
| D9 | H | Single bond | $NH_2$ | 1.2 mmol | Polyamide | $R^{2009}$=$C_{10}H_{20}$, $R^{2010}$=$C_6H_{12}$ | $2 \times 10^5$ |
| D10 | H | Single bond | SH | 1.3 mmol | Polyolefin | $R^{2002}$ to $R^{2005}$=H | $9 \times 10^3$ |
| D11 | H | Phenylene | OH | 2.8 mmol | Polyolefin | $R^{2002}$ to $R^{2005}$=H | $4 \times 10^3$ |
| D12 | H | Single bond | OH | 3.0 mmol | Butyral | $R^{2001}$=$C_3H_8$ | $7 \times 10^4$ |
| D13 | H | Single bond | OH | 2.9 mmol | Polyester | $R^{2006}$=Ph, $R^{2007}$=$C_2H_4$ | $2 \times 10^4$ |
| D14 | H | Single bond | OH | 2.5 mmol | Polyester | $R^{2006}$=$R^{2007}$=$C_2H_4$ | $6 \times 10^3$ |
| D15 | H | Single bond | OH | 2.7 mmol | Polyester | $R^{2006}$=$R^{2007}$=$C_2H_4$ | $8 \times 10^4$ |
| D16 | H | Single bond | COOH | 1.4 mmol | Polyolefin | $R^{2002}$ to $R^{2004}$=H, $R^{2005}$=$CH_3$ | $2 \times 10^5$ |
| D17 | H | Single bond | COOH | 2.2 mmol | Polyester | $R^{2006}$=Ph, $R^{2007}$=$C_2H_4$ | $9 \times 10^3$ |
| D18 | H | Single bond | COOH | 2.8 mmol | Polyester | $R^{2006}$=$R^{2007}$=$C_2H_4$ | $8 \times 10^2$ |
| D19 | $CH_3$ | $CH_2$ | OH | 1.5 mmol | Polyester | $R^{2006}$=$R^{2007}$=$C_2H_5$ | $2 \times 10^4$ |
| D20 | $C_2H_5$ | $CH_2$ | OH | 2.1 mmol | Polyester | $R^{2006}$=$R^{2007}$=$C_2H_6$ | $1 \times 10^4$ |
| D21 | $C_2H_5$ | $CH_2$ | OH | 3.0 mmol | Polyester | $R^{2006}$=$R^{2007}$=$C_2H_7$ | $5 \times 10^4$ |
| D22 | H | Single bond | $OCH_3$ | 1.2 mmol | Polyolefin | $R^{2002}$ to $R^{2005}$=H | $7 \times 10^3$ |
| D23 | H | Single bond | OH | 3.3 mmol | Butyral | $R^{2001}$=$C_3H_8$ | $2.7 \times 10^5$ |
| D24 | H | Single bond | OH | 3.3 mmol | Butyral | $R^{2001}$=$C_3H_8$ | $4 \times 10^5$ |
| D25 | H | Single bond | OH | 2.5 mmol | Acetal | $R^{2001}$=H | $3.4 \times 10^5$ |
| D26 | H | Single bond | OH | 2.8 mmol | Cellulose | $R^{2011}$=$R^{2016}$=H, $R^{2012}$ to $R^{2015}$=$COCH_3$ | $3 \times 10^4$ |

In the polymerized product of (ii), the mass ratio between the compound represented by the formula (11) and the cross-linking agent in the composition of the undercoat layer is preferably 100:50 or more and 100:750 or less. Further, the mass ratio is more preferably 100:50 or more and 100:500 or less. When the mass ratio falls within the above-mentioned range, it is considered that the aggregation of the cross-linking agent is suppressed, and as a result, a trap site in the undercoat layer decreases, to thereby further enhance the effect of suppressing a ghost.

Further, in the case where the undercoat layer contains the polymerized product of (i) or (ii), the thickness of the undercoat layer is preferably 0.5 μm or more and 15 μm or less from the viewpoint of the effect of suppressing a ghost. The thickness of the undercoat layer is more preferably 0.5 μm or more and 5 μm or less.

Now, the support, the hole transporting layer, and the other layers of the laminated body are described.

[Support]

The support is preferably a support having conductivity (conductive support). For example, a support made of a metal such as aluminum, nickel, copper, gold, or iron, or an alloy thereof can be used. Examples thereof include: a support obtained by forming a thin film of a metal such as aluminum, silver, or gold on an insulating support such as a polyester resin, a polycarbonate resin, a polyimide resin, or a glass; and a support having formed thereon a thin film of an electroconductive material such as indium oxide or tin oxide.

The surface of the support may be subjected to electrochemical treatment such as anodization, wet honing treatment, blast treatment, or cutting treatment in order that the electrical characteristics of the electrophotographic photosensitive member may be improved and interference fringes may be suppressed.

An electroconductive layer may be formed between the support and the undercoat layer of the laminated body. The electroconductive layer is obtained by: forming, on the support, a coating film of an application liquid for the electroconductive layer obtained by dispersing electroconductive particles in a resin; and drying the coating film.

Examples of the electroconductive particles include carbon black, acetylene black, powder of a metal such as aluminum, nickel, iron, nichrome, copper, zinc, or silver, and powder of a metal oxide such as electroconductive tin oxide or ITO.

In addition, examples of the resin include a polyester resin, a polycarbonate resin, a polyvinyl butyral resin, an acrylic resin, a silicone resin, an epoxy resin, a melamine resin, a urethane resin, a phenol resin, and an alkyd resin.

Examples of the solvent of the application liquid for the electroconductive layer include an ether-based solvent, an alcohol-based solvent, a ketone-based solvent, and an aromatic hydrocarbon solvent. The thickness of the electroconductive layer is preferably 0.2 μm or more and 40 μm or less, more preferably 1 μm or more and 35 μm or less, still more preferably 5 μm or more and 30 μm or less.

[Charge Generating Layer]

In the laminated body, the photosensitive layer is formed on the undercoat layer. The photosensitive layer includes the charge generating layer containing a charge generating material and a binder resin. Further, it is preferred that the photosensitive layer be a laminated photosensitive layer including the charge generating layer and the hole transporting layer containing a hole transporting material.

Examples of the charge generating material include an azo pigment, a perylene pigment, an anthraquinone derivative, an anthanthrone derivative, a dibenzpyrenequinone derivative, a pyranthrone derivative, a violanthrone derivative, an isoviolanthrone derivative, an indigo derivative, a thioindigo derivative, phthalocyanine pigments such as a metal phthalocyanine and a metal-free phthalocyanine, and a bisbenzimidazole derivative. Of those, at least one kind selected from the group consisting of an azo pigment and phthalocyanine pigments is preferred. Of the phthalocyanine pigments, oxytitanium phthalocyanine, chlorogallium phthalocyanine, and hydroxygallium phthalocyanine are preferred.

Examples of the binder resin to be used for the charge generating layer include: a polymer and copolymer of a vinyl compound such as styrene, vinyl acetate, vinyl chloride, an acrylic acid ester, a methacrylic acid ester, vinylidene fluoride, or trifluoroethylene; a polyvinyl alcohol resin; a polyvinyl acetal resin; a polycarbonate resin; a polyester resin; a polysulfone resin; a polyphenylene oxide resin; a polyurethane resin; a cellulose resin; a phenol resin; a melamine resin; a silicone resin; and an epoxy resin. Of those, a polyesterresin, a polycarbonate resin, and a polyvinyl acetal resin are preferred, and polyvinyl acetal is more preferred.

In the charge generating layer, the mass ratio (charge generating material/binder resin) of the charge generating material to the binder resin falls within the range of preferably from 10/1 to 1/10, more preferably from 5/1 to 1/5. A solvent to be used in an application liquid for the charge generating layer is, for example, an alcohol-based solvent, a sulfoxide-based solvent, a ketone-based solvent, an ether-based solvent, an ester-based solvent, or an aromatic hydrocarbon solvent.

The thickness of the charge generating layer is preferably 0.05 μm or more and 5 μm or less.

[Hole Transporting Layer]

The hole transporting layer is formed on the charge generating layer. The hole transporting layer contains a hole transporting material and a binder resin.

Examples of the hole transporting material include a polycyclic aromatic compound, a heterocyclic compound, a hydrazone compound, a styryl compound, a benzidine compound, a triarylamine compound, a triphenylamine, and a polymer having in its main chain or side chain a group derived from any one of these compounds. Of those, at least one kind selected from the group consisting of a triarylamine compound, a benzidine compound, and a styryl compound is preferred.

Examples of the binder resin to be used for the hole transporting layer include a polyester resin, a polycarbonate resin, a polymethacrylic acid ester resin, a polyarylate resin, a polysulfone resin, and a polystyrene resin. Of those, a polycarbonate resin and a polyarylate resin are preferred. In addition, it is preferred that the weight-average molecular weight (Mw) of any such binder resin fall within the range of from 10,000 to 300,000.

In the hole transporting layer, the ratio (hole transporting material/binder resin) of the hole transporting material to the binder resin is preferably from 10/5 to 5/10, more preferably from 10/8 to 6/10.

When the thickness of the hole transporting layer according to the present invention is 15 μm or less, the effects are obtained effectively. When the thickness of the hole transporting layer is 3 μm or more and 10 μm or less, the effects of the present invention are obtained more effectively. When the thickness is 3 μm or more, the expression (2) is likely to be satisfied. When the thickness is 10 μm or less, the intensity of an electric field applied to the undercoat layer becomes high, and hence the effects of the present invention are more significantly obtained as compared to the undercoat layer in the related art. Further, in the case where the undercoat layer contains the polymerized product of (i) or (ii), even when the thickness of the hole transporting layer is more than 15 μm, the effect of suppressing a ghost is obtained. The thickness of the hole transporting layer in this case is preferably more than 15 μm and 40 μm or less.

A solvent to be used in an application liquid for the hole transporting layer is, for example, an alcohol-based solvent, a sulfoxide-based solvent, a ketone-based solvent, an ether-based solvent, an ester-based solvent, or an aromatic hydrocarbon solvent.

It should be noted that another layer such as a second undercoat layer free of the polymerized product relating to the present invention may be formed between the undercoat layer and the charge generating layer.

In addition, a surface protective layer may be formed on the hole transporting layer. The surface protective layer contains electroconductive particles or a charge transporting material and a binder resin. In addition, the surface protective layer may further contain an additive such as a lubricant. In addition, the binder resin itself of the protective layer may be provided with conductivity or a charge transport property, and in this case, the electroconductive particles or the charge transporting material except the resin may not be incorporated into the protective layer. In addition, the binder resin of the protective layer may be a thermoplastic resin, or may be a curable resin polymerised with heat, light, or a radiation (such as an electron beam).

The following method is preferred as a method of forming each layer: an application liquid obtained by dissolving and/or dispersing a material constituting each layer in a solvent is applied, and the resultant coating film is dried and/or cured to form the layer. A method of applying the application liquid is, for example, an immersion application method (immersion coating method), a spray coating method, a curtain coating method, or a spin coating method. Of those, an immersion application method is preferred from the viewpoints of efficiency and productivity.

[Process Cartridge and Electrophotographic Apparatus]

Figure 7:
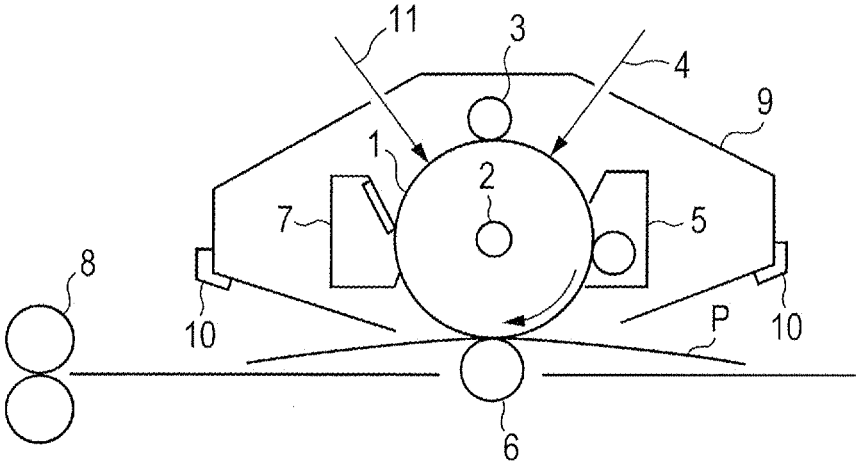
FIG. 7 is a view for illustrating a schematic configuration of an electrophotographic apparatus including a process cartridge including an electrophotographic photosensitive member.

FIG. 7 is a view for illustrating the schematic configuration of an electrophotographic apparatus including a process cartridge including an electrophotographic photosensitive member.

In FIG. 7, an electrophotographic photosensitive member 1 having a cylindrical shape is rotationally driven about an axis 2 in a direction indicated by an arrow at a predetermined peripheral speed. The surface (peripheral surface) of the electrophotographic photosensitive member 1 to be rotationally driven is uniformly charged to a predetermined positive or negative potential by a charging unit 3 (primary charging unit such as a charging roller). Next, the surface receives exposure light (image exposure light) 4 from an exposing unit (not shown) such as slit exposure or laser beam scanning exposure. Thus, electrostatic latent images corresponding to the target image are sequentially formed on the surface of the electrophotographic photosensitive member 1.

The electrostatic latent images formed on the surface of the electrophotographic photosensitive member 1 are then developed with toner in the developer of a developing unit 5 to become toner images. Next, the toner images formed on and carried by the surface of the electrophotographic photosensitive member 1 are sequentially transferred onto a transfer material P (such as paper) by a transfer bias from a transferring unit 6 (such as a transfer roller). It should be noted that the transfer material P is taken out and supplied from a transfer material-supplying unit (not shown) to a space (abutment portion) between the electrophotographic photosensitive member 1 and the transferring unit 6 in synchronization with the rotation of the electrophotographic photosensitive member 1.

The transfer material P onto which the toner images have been transferred is separated from the surface of the electrophotographic photosensitive member 1 and introduced into a fixing unit 8, where the images are fixed. Thus, the transfer material is printed out as an image-formed product (print or copy) to the outside of the apparatus.

The surface of the electrophotographic photosensitive member 1 after the transfer of the toner images is cleaned through the removal of a transfer residual developer (toner) by a cleaning unit 7 (such as a cleaning blade). Next, the surface is subjected to antistatic treatment by pre-exposure light 11 from a pre-exposing unit (not shown), and is then repeatedly used in image formation. It should be noted that, when the charging unit 3 is a contact charging unit using a charging roller or the like as illustrated in FIG. 7, pre-exposure is not necessarily needed.

Two or more of components such as the electrophotographic photosensitive member 1, the charging unit 3, the developing unit 5, and the cleaning unit 7 may be selected, stored in a container, and integrally coupled to form a process cartridge. In this case, the process cartridge is preferably removably mounted onto the main body of the electrophotographic apparatus such as a copying machine or a laser beam printer. In FIG. 7, the electrophotographic photosensitive member 1, the charging unit 3, the developing unit 5, and the cleaning unit 7 are integrally supported to from a cartridge. In addition, the cartridge serves as a process cartridge 9 removably mounted onto the main body of the electrophotographic apparatus by using a guiding unit 10 such as the rail of the main body of the electrophotographic apparatus.

EXAMPLES

Next, the production and evaluation of the electrophotographic photosensitive member are described.

Example 1

An aluminum cylinder (JIS-A3003, aluminum alloy) having a length of 260.5 mm and a diameter of 30 mm was used as a support (conductive support).

Then, 50 parts of titanium oxide particles (powder resistivity: 120 Ω·cm, coverage ratio of tin oxide: 40%) each covered with oxygen-deficient tin oxide, 40 parts of a phenol resin (Plyophen J-325, manufactured by DIC Corporation, resin solid content: 60%), and 50 parts of methoxypropanol serving as a solvent (dispersion medium) were loaded into a sand mill using glass beads each having a diameter of 1 mm and subjected to dispersion treatment for 3 hours to prepare an application liquid (dispersion liquid) for an electroconductive layer. The application liquid for an electroconductive layer was applied onto the support by immersion to obtain a coating film. The coating film thus obtained was subjected to drying and thermal polymerization at 150° C. for 30 minutes to form an electroconductive layer having a thickness of 16 μm.

The average particle diameter of the titanium oxide particles each covered with oxygen-deficient tin oxide in the application liquid for an electroconductive layer was measured by a centrifugal sedimentation method at a number of revolutions of 5,000 rpm using tetrahydrofuran as a dispersion medium with a particle size distribution analyzer (trade name: CAPA 700, manufactured by Horiba, Ltd.). As a result, the average particle diameter was 0.31 μm.

Next, 6.1 parts of an electron transport material (1-1)-1, 5.2 parts of an isocyanate compound (B1, protective group (H1)=5.1:2.2 (mass ratio)), 0.3 part of a resin (D1), and 0.05 part of dioctyltin laurate serving as a catalyst were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated to be polymerized at 160° C. for 40 minutes, to thereby form an undercoat layer having a thickness (UC thickness) of 1.25 μm.

The content of the electron transport material with respect to the total mass of the composition containing the electron transport material, the cross-linking agent, and the resin was 52 mass %.

Next, a hydroxygallium phthalocyanine crystal (charge generating material) of a crystal form having peaks at Bragg angles)(2θ±0.2° in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 5 parts of a polyvinyl butyral resin (trade name: S-LEC BX-1, manufactured by Sekisui Chemical Co., Ltd.), and 250 parts of cyclohexanone were loaded into a sand mill using glass beads each having a diameter of 1 mm, and the mixture was subjected to dispersion treatment for 1.5 hours. Next, 250 parts of ethyl acetate was added to the resultant to prepare an application liquid for a charge generating layer. The application liquid for a charge generating layer was applied onto the undercoat layer by immersion to obtain a coating film. The coating film thus obtained was dried at 100° C. for 10 minutes to form a charge generating layer having a thickness of 0.15 μm.

Next, 8 parts of a compound (hole transporting material) represented by the formula (12-1) and 10 parts of polyarylate having a structural unit represented by the formula (13-1) and a structural unit represented by the formula (13-2) in a ratio of 5/5 and having a weight-average molecular weight (Mw) of 100,000 were dissolved in a mixed solvent of 40 parts of dimethyoxymethane and 60 parts of chlorobenzene to prepare an application liquid for a hole transporting layer. The application liquid for a hole transporting layer was applied onto the charge generating layer by immersion to obtain a coating film. The coating film thus obtained was dried at 120° C. for 40 minutes to form a hole transporting layer having a thickness (CT thickness) of 7 μm.

(12-1)

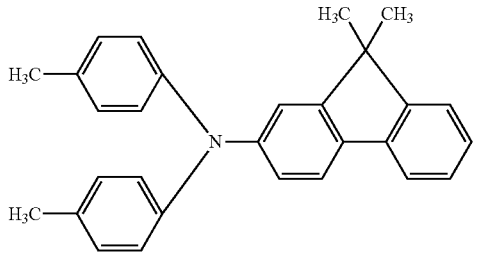

-continued (13-1)

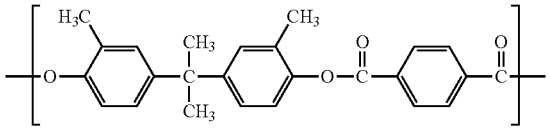

(13-2)

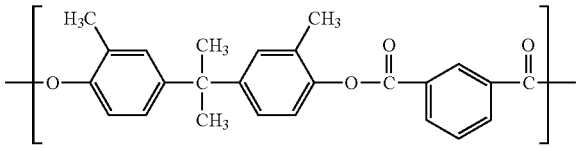

Thus, an electrophotographic photosensitive member for evaluating a positive ghost and a fluctuation in potential was produced. Further, another electrophotographic photosensitive member was produced in the same manner as described above, and the above-mentioned laminated body was prepared therefrom and subjected to the measurement method of the present invention.

(Determination Test)

The electrophotographic photosensitive member was immersed in a mixed solvent of 40 parts of dimethoxymethane and 60 parts of chlorobenzene for 5 minutes to peel the hole transporting layer. Then, the resultant was dried at 100° C. for 10 minutes to obtain a laminated body. It was confirmed that the hole transporting layer did not exist on the surface by a FTIR-ATR method.

Next, the laminated body was left under an environment having a temperature of 25° C. and a humidity of 50% RH for 24 hours, and then |Vd2−Vd1| (expression (2)) and transit time τ (expression (3)) were calculated by the above-mentioned determination method as described above. The measurement results are shown in Table 18.

(Evaluation of Black Dot)

The above-mentioned electrophotographic photosensitive member was mounted onto a process cartridge of the above-mentioned laser beam printer, and the process cartridge was mounted onto a station for a cyan process cartridge. A solid white image was output. The determination was performed by visual inspection.

(Evaluation of Sensitivity and Dark Attenuation)

The sensitivity was evaluated based on a light portion potential at a time of irradiation with the same light. It can be evaluated that, when the light portion potential is low, the sensitivity is high, and when the light portion potential is high, the sensitivity is low. The dark attenuation was evaluated based on a dark portion potential at a time of the application of the same voltage. It was determined that, when the dark portion potential was low, the dark attenuation was large, and when the dark portion potential was high, the dark attenuation was small. The evaluation was made by mounting the electrophotographic photosensitive member onto a reconstructed machine of a laser beam printer (trade name: LaserJet P4510, manufactured by Hewlett-Packard Japan, Ltd.).

The reconstruction was performed so that an external power source was used for charging to set Vpp of AC to 1,800 V and a frequency to 870 Hz and set the application voltage of DC to −700 V, and the light amount of exposure light (image exposure light) became variable.

The potential of a surface of the electrophotographic photosensitive member was measured by removing a cartridge for development from the evaluation machine and inserting a potential measurement device therein. The potential measurement device has a configuration in which a potential measurement probe is arranged at a development position of the cartridge for development, and the position of the potential measurement probe with respect to the electrophotographic photosensitive member was set to the center in a drum axis direction.

First, a dark portion potential (Vd) was measured without irradiation with light. As a result, the dark potion potential (Vd) was −670 V. Then, the light E was set to 0.40 μJ/cm$^2$, and a light portion potential (Vl) was measured. As a result, the light portion potential (Vl) was −180 V.

Examples 2 to 15

Electrophotographic photosensitive members were each produced in the same manner as in Example 1 except that the electron transport material (1-1)-1 of Example 1 was changed to an electron transport material shown in Table 18 and the electrophotographic photosensitive members were evaluated similarly. The results are shown in Table 18.

Examples 16 to 19

Electrophotographic photosensitive members were each produced in the same manner as in Example 1 except that the resin (D1) of Example 1 was changed to a resin shown in Table 18 and the electrophotographic photosensitive members were evaluated similarly. The results are shown in Table 18.

Example 20

An electrophotographic photosensitive member was produced in the same manner as in Example 1 except that the undercoat layer was formed as follows and the electrophotographic photosensitive member was evaluated similarly. The results are shown in Table 18.

5.2 Parts of an electron transport material (1-1)-10, 5.6 parts of the cross-linking agent (B1, protective group (H1)=5.1:2.2 (mass ratio)), 0.9 part of the resin (D1), and 0.05 part of dioctyltin laurate were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.25 μm.

The content of the electron transport material with respect to the total mass of the composition containing the electron transport material, the cross-linking agent, and the resin was 44 mass %.

Example 21

An electrophotographic photosensitive member was produced in the same manner as in Example 1 except that the undercoat layer was formed as follows and the electrophotographic photosensitive member was evaluated similarly. The results are shown in Table 18.

5.9 Parts of the electron transport material (1-1)-1, 5.4 parts of the isocyanate compound (B1, protective group (H1)=5.1:2.2 (mass ratio)), 0.5 part of the resin (D1), and 0.03 part of dioctyltin laurate were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.25 μm.

The content of the electron transport material with respect to the total mass of the composition containing the electron transport material, the cross-linking agent, and the resin was 50 mass %.

Example 22

An electrophotographic photosensitive member was produced in the same manner as in Example 1 except that the undercoat layer was formed as follows and the electrophotographic photosensitive member was evaluated similarly. The results are shown in Table 18.

6.7 Parts of the electron transport material (1-1)-1, 4.3 parts of the isocyanate compound (B1, protective group (H1)=5.1:2.2 (mass ratio)), 0.3 part of the resin (D1), and 0.03 part of dioctyltin laurate were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.25 μm.

The content of the electron transport material with respect to the total mass of the composition containing the electron transport material, the cross-linking agent, and the resin was 59 mass %.

Example 23

An electrophotographic photosensitive member was produced in the same manner as in Example 1 except that the undercoat layer was formed as follows and the electrophotographic photosensitive member was evaluated similarly. The results are shown in Table 18.

6.8 Parts of an electron transport material (1-1)-4, 1.4 parts of an amino compound (C1-3) as a cross-linking agent, 1.8 parts of the resin (D1), and 0.1 part of dodecylbenzenesulfonic acid serving as a catalyst were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.50 μm.

The content of the electron transport material with respect to the total mass of the composition containing the electron transport material, the cross-linking agent, and the resin was 68 mass %.

Examples 24 to 36

Electrophotographic photosensitive members were each produced in the same manner as in Example 23 except that the electron transport material (1-1)-4 of Example 23 was changed to an electron transport material shown in Table 18 and the electrophotographic photosensitive members were evaluated similarly. The results are shown in Table 18.

Examples 37 to 40

Electrophotographic photosensitive members were each produced in the same manner as in Example 23 except that the resin (D1) of Example 1 was changed to a resin shown in Table 18 and the electrophotographic photosensitive members were evaluated similarly. The results are shown in Table 18.

Example 41

An electrophotographic photosensitive member was produced in the same manner as in Example 23 except that the undercoat layer was formed as follows and the electrophotographic photosensitive member was evaluated similarly. The results are shown in Table 18.

7.3 Parts of the electron transport material (1-1)-4, 1.3 parts of the amino compound (C1-3), 1.4 parts of the resin (D1), and 0.1 part of dodecylbenzenesulfonic acid serving as a catalyst were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.50 μm.

The content of the electron transport material with respect to the total mass of the composition containing the electron transport material, the cross-linking agent, and the resin was 73 mass %.

Example 42

An electrophotographic photosensitive member was produced in the same manner as in Example 23 except that the undercoat layer was formed as follows and the electrophotographic photosensitive member was evaluated similarly. The results are shown in Table 18.

7.8 Parts of the electron transport material (1-1)-4, 1.2 parts of the amino compound (C1-3), 1.0 part of the resin (D1), and 0.1 part of dodecylbenzenesulfonic acid serving as a catalyst were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.50 μm.

The content of the electron transport material with respect to the total mass of the composition containing the electron transport material, the cross-linking agent, and the resin was 78 mass %.

Example 43

An electrophotographic photosensitive member was produced in the same manner as in Example 23 except that the undercoat layer was formed as follows and the electrophotographic photosensitive member was evaluated similarly. The results are shown in Table 18.

8.3 Parts of the electron transport material (1-1)-4, 1.0 part of the amino compound (C1-3), 0.5 part of the resin (D1), and 0.1 part of dodecylbenzenesulfonic acid serving as a catalyst were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.50 μm.

The content of the electron transport material with respect to the total mass of the composition containing the electron transport material, the cross-linking agent, and the resin was 85 mass %.

Example 44

An electrophotographic photosensitive member was produced in the same manner as in Example 23 except that the undercoat layer was formed as follows and the electrophotographic photosensitive member was evaluated similarly. The results are shown in Table 18.

8.8 Parts of the electron transport material (1-1)-4, 1.0 part of the amino compound (C1-3), 0.2 part of the resin (D1), and 0.1 part of dodecylbenzenesulfonic acid serving as a catalyst were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.50 μm.

The content of the electron transport material with respect to the total mass of the composition containing the electron transport material, the cross-linking agent, and the resin was 88 mass %.

Examples 45 to 49

Electrophotographic photosensitive members were each produced in the same manner as in Example 1 except that the cross-linking agent (B1, protective group (H1)) of Example 1 was changed to a cross-linking agent shown in Table 18 and the electrophotographic photosensitive members were evaluated similarly. The results are shown in Table 18.

Examples 50 to 54

Electrophotographic photosensitive members were each produced in the same manner as in Example 23 except that the cross-linking agent (C1-3) of Example 23 was changed to a cross-linking agent shown in Table 18 and the electrophotographic photosensitive members were evaluated similarly. The results are shown in Table 18.

Examples 55 to 59

Electrophotographic photosensitive members were each produced in the same manner as in Example 23 except that the thickness of the undercoat layer of Example 23 was changed from 1.50 μm to 0.63 μm (Example 55), 0.77 μm (Example 56), 2.00 μm (Example 57), 3.00 μm (Example 58), and 3.50 μm (Example 59) and the electrophotographic photosensitive members were evaluated similarly. The results are shown in Table 18.

Example 60

An electrophotographic photosensitive member was produced in the same manner as in Example 1 except that the charge generating layer was formed as follows and the electrophotographic photosensitive member was evaluated similarly. The results are shown in Table 18.

An oxytitanium phthalocyanine crystal having peaks at Bragg angles)(2θ±0.2° in CuKα X-ray diffraction of 9.0°, 14.2°, 23.9°, and 27.1° was prepared. 10 Parts of the oxytitanium phthalocyanine crystal and polyvinyl butyral (trade name: S-LEC BX-1, manufactured by Sekisui Chemical Co., Ltd.) were dissolved in a mixed solvent of cyclohexanone and water (97:3) to prepare 166 parts of a 5 mass % solution. The solution and 150 parts of the mixed solvent of cyclohexanone and water (97:3) were each dispersed in a sand mill device for 4 hours through use of 400 parts of glass beads each having a diameter of 1 mmϕ. Then, 210 parts of the mixed solvent of cyclohexanone and water (97:3) and 260 parts of cyclohexanone were added to the resultant to prepare an application liquid for a charge generating layer. The application liquid for a charge generating layer was applied onto the undercoat layer by immersion to obtain a coating film. The coating film thus obtained was dried at 80° C. for 10 minutes to form a charge generating layer having a thickness of 0.20 μm.

Example 61

An electrophotographic photosensitive member was produced in the same manner as in Example 1 except that the charge generating layer was formed as follows and the electrophotographic photosensitive member was evaluated similarly. The results are shown in Table 18.

20 Parts of a bisazo pigment represented by the formula (14) and 10 parts of a polyvinyl butyral resin (trade name: S-LEC BX-1, manufactured by Sekisui Chemical Co., Ltd.) were mixed and dispersed together with 150 parts of tetrahydrofuran to prepare an application liquid for a charge generating layer. The application liquid for a charge generating layer was applied onto the undercoat layer by a dip coating method, and the resultant was dried by heating at 110° C. for 30 minutes to form a charge generating layer having a thickness of 0.30 μm.

Example 62

An electrophotographic photosensitive member was produced in the same manner as in Example 1 except that the compound (hole transporting material) represented by the formula (12-1) of Example 1 was changed to a benzidine compound (hole transporting material) represented by the formula (12-2) and the electrophotographic photosensitive member was evaluated similarly. The results are shown in Table 18.

(12-2)

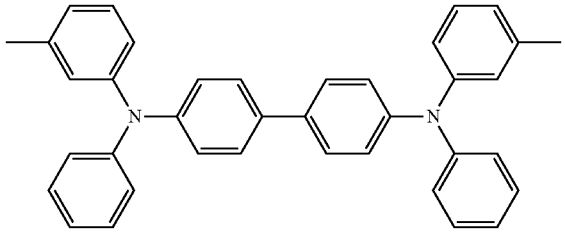

Example 63

An electrophotographic photosensitive member was produced in the same manner as in Example 1 except that the compound (hole transporting material) represented by the formula (12-1) of Example 1 was changed to a styryl compound (hole transporting material) represented by the formula (12-3) and the electrophotographic photosensitive member was evaluated similarly. The results are shown in Table 18.

(12-3)

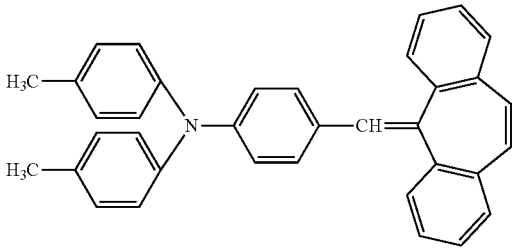

(14)

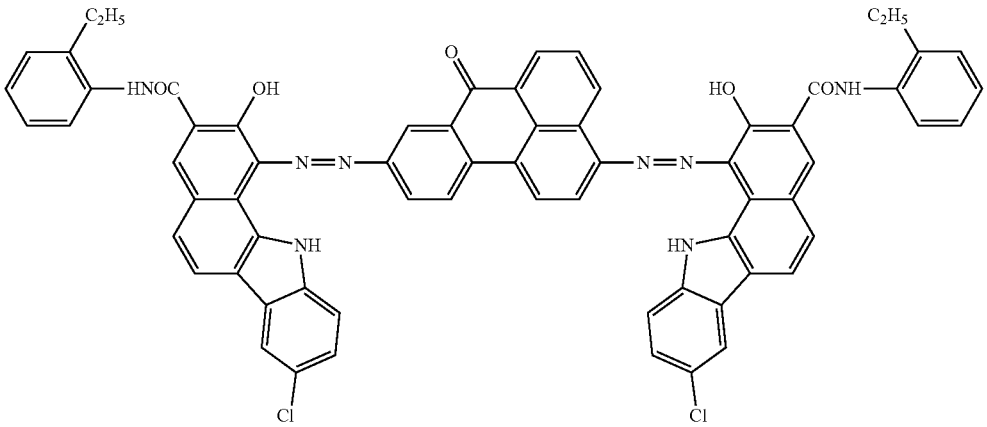

TABLE 18

| | Electron transport material | Cross-linking agent | Resin | Ratio of electron transport material | UC thickness (μm) | CT thickness (μm) | Expression (2) | Expression (3) | Vd (−V) | Vl (−V) | Black dot |
|---|---|---|---|---|---|---|---|---|---|---|---|
| Example 1 | (1-1)-1 | B1:H1 | D1 | 52% | 1.25 | 7 | 0.6 | 5.8 | 670 | 180 | Absent |
| Example 2 | (1-1)-2 | ↑ | ↑ | ↑ | ↑ | ↑ | 0.6 | 3.5 | 674 | 160 | ↑ |
| Example 3 | (1-1)-3 | ↑ | ↑ | ↑ | ↑ | ↑ | 0.4 | 8.0 | 672 | 182 | ↑ |
| Example 4 | (1-2)-4 | ↑ | ↑ | ↑ | ↑ | ↑ | 0.7 | 3.1 | 675 | 161 | ↑ |
| Example 5 | (1-2)-5 | ↑ | ↑ | ↑ | ↑ | ↑ | 0.4 | 2.8 | 676 | 169 | ↑ |
| Example 6 | (1-3)-1 | ↑ | ↑ | ↑ | ↑ | ↑ | 0.6 | 3.7 | 671 | 164 | ↑ |
| Example 7 | (1-3)-3 | ↑ | ↑ | ↑ | ↑ | ↑ | 0.3 | 9.0 | 670 | 173 | ↑ |
| Example 8 | (1-4)-1 | ↑ | ↑ | ↑ | ↑ | ↑ | 0.7 | 2.0 | 674 | 168 | ↑ |
| Example 9 | (1-4)-5 | ↑ | ↑ | ↑ | ↑ | ↑ | 0.9 | 1.0 | 678 | 173 | ↑ |
| Example 10 | (1-5)-3 | ↑ | ↑ | ↑ | ↑ | ↑ | 0.3 | 4.9 | 674 | 172 | ↑ |
| Example 11 | (1-5)-4 | ↑ | ↑ | ↑ | ↑ | ↑ | 0.7 | 9.0 | 671 | 180 | ↑ |
| Example 12 | (1-6)-2 | ↑ | ↑ | ↑ | ↑ | ↑ | 1.2 | 8.0 | 677 | 178 | ↑ |
| Example 13 | (1-7)-3 | ↑ | ↑ | ↑ | ↑ | ↑ | 0.8 | 8.3 | 677 | 172 | ↑ |
| Example 14 | (1-8)-4 | ↑ | ↑ | ↑ | ↑ | ↑ | 0.7 | 2.5 | 676 | 169 | ↑ |
| Example 15 | (1-9)-1 | ↑ | ↑ | ↑ | ↑ | ↑ | 1.3 | 5.5 | 673 | 165 | ↑ |
| Example 16 | (1-1)-1 | ↑ | D3 | ↑ | ↑ | ↑ | 0.6 | 1.5 | 676 | 177 | ↑ |
| Example 17 | ↑ | ↑ | D5 | ↑ | ↑ | ↑ | 0.9 | 8.5 | 671 | 178 | ↑ |
| Example 18 | ↑ | ↑ | D19 | ↑ | ↑ | ↑ | 0.8 | 5.5 | 671 | 176 | ↑ |
| Example 19 | ↑ | ↑ | D20 | ↑ | ↑ | ↑ | 0.5 | 4.0 | 675 | 163 | ↑ |
| Example 20 | (1-1)-10 | ↑ | D1 | 44% | ↑ | ↑ | 0.3 | 9.5 | 685 | 195 | ↑ |
| Example 21 | (1-1)-1 | ↑ | ↑ | 50% | ↑ | ↑ | 0.6 | 6.8 | 674 | 185 | ↑ |
| Example 22 | ↑ | ↑ | ↑ | 59% | ↑ | ↑ | 0.6 | 3.8 | 673 | 173 | ↑ |
| Example 23 | (1-1)-4 | C1-3 | ↑ | 68% | 1.50 | ↑ | 0.8 | 1.2 | 679 | 160 | ↑ |
| Example 24 | (1-1)-9 | ↑ | ↑ | ↑ | ↑ | ↑ | 0.7 | 0.7 | 677 | 163 | ↑ |
| Example 25 | (1-2)-1 | ↑ | ↑ | ↑ | ↑ | ↑ | 0.5 | 0.9 | 674 | 167 | ↑ |
| Example 26 | (1-2)-3 | ↑ | ↑ | ↑ | ↑ | ↑ | 1.0 | 1.2 | 678 | 166 | ↑ |
| Example 27 | (1-3)-4 | ↑ | ↑ | ↑ | ↑ | ↑ | 0.9 | 3.6 | 674 | 162 | ↑ |
| Example 28 | (1-3)-5 | ↑ | ↑ | ↑ | ↑ | ↑ | 0.7 | 2.0 | 675 | 161 | ↑ |
| Example 29 | (1-4)-2 | ↑ | ↑ | ↑ | ↑ | ↑ | 0.6 | 3.0 | 676 | 174 | ↑ |
| Example 30 | (1-4)-3 | ↑ | ↑ | ↑ | ↑ | ↑ | 0.8 | 2.5 | 670 | 172 | ↑ |
| Example 31 | (1-5)-1 | ↑ | ↑ | ↑ | ↑ | ↑ | 1.1 | 4.2 | 672 | 176 | ↑ |
| Example 32 | (1-5)-5 | ↑ | ↑ | ↑ | ↑ | ↑ | 0.6 | 4.5 | 678 | 168 | ↑ |
| Example 33 | (1-6)-1 | ↑ | ↑ | ↑ | ↑ | ↑ | 0.7 | 3.5 | 671 | 168 | ↑ |
| Example 34 | (1-7)-2 | ↑ | ↑ | ↑ | ↑ | ↑ | 0.8 | 2.1 | 675 | 176 | ↑ |
| Example 35 | (1-8)-3 | ↑ | ↑ | ↑ | ↑ | ↑ | 0.4 | 5.8 | 676 | 161 | ↑ |
| Example 36 | (1-9)-5 | ↑ | ↑ | ↑ | ↑ | ↑ | 0.9 | 1.6 | 677 | 171 | ↑ |
| Example 37 | (1-1)-4 | ↑ | D2 | ↑ | ↑ | ↑ | 0.5 | 3.2 | 672 | 165 | ↑ |
| Example 38 | ↑ | ↑ | D4 | ↑ | ↑ | ↑ | 0.7 | 1.4 | 674 | 168 | ↑ |
| Example 39 | ↑ | ↑ | D6 | ↑ | ↑ | ↑ | 0.8 | 4.6 | 679 | 166 | ↑ |
| Example 40 | ↑ | ↑ | D23 | ↑ | ↑ | ↑ | 0.6 | 7.0 | 677 | 166 | ↑ |
| Example 41 | ↑ | ↑ | D1 | 73% | ↑ | ↑ | 0.8 | 0.7 | 676 | 155 | ↑ |
| Example 42 | ↑ | ↑ | ↑ | 78% | ↑ | ↑ | 0.9 | 0.5 | 673 | 151 | ↑ |
| Example 43 | ↑ | ↑ | ↑ | 85% | ↑ | ↑ | 1.1 | 1.0 | 678 | 163 | ↑ |
| Example 44 | ↑ | ↑ | ↑ | 88% | ↑ | ↑ | 1.5 | 10.0 | 650 | 185 | ↑ |
| Example 45 | (1-1)-1 | B1:H2 | ↑ | 52% | 1.25 | ↑ | 0.9 | 5.0 | 674 | 177 | ↑ |
| Example 46 | ↑ | B1:H3 | ↑ | ↑ | ↑ | ↑ | 0.9 | 6.0 | 672 | 161 | ↑ |
| Example 47 | ↑ | B4:H1 | ↑ | ↑ | ↑ | ↑ | 1.5 | 2.0 | 673 | 175 | ↑ |
| Example 48 | ↑ | B7:H1 | ↑ | ↑ | ↑ | ↑ | 1.1 | 6.0 | 678 | 173 | ↑ |
| Example 49 | ↑ | B12:H1 | ↑ | ↑ | ↑ | ↑ | 1.3 | 3.0 | 679 | 167 | ↑ |
| Example 50 | (1-1)-4 | C1-1 | ↑ | 68% | 1.50 | ↑ | 1.3 | 1.0 | 672 | 174 | ↑ |
| Example 51 | ↑ | C1-7 | ↑ | ↑ | ↑ | ↑ | 1.0 | 2.0 | 674 | 170 | ↑ |
| Example 52 | ↑ | C1-9 | ↑ | ↑ | ↑ | ↑ | 1.3 | 7.0 | 676 | 174 | ↑ |
| Example 53 | ↑ | C2-1 | ↑ | ↑ | ↑ | ↑ | 1.5 | 6.0 | 676 | 175 | ↑ |
| Example 54 | ↑ | C3-3 | ↑ | ↑ | ↑ | ↑ | 1.0 | 9.0 | 674 | 176 | ↑ |
| Example 55 | ↑ | C1-3 | ↑ | ↑ | 0.63 | ↑ | 1.9 | 0.6 | 640 | 189 | ↑ |
| Example 56 | ↑ | ↑ | ↑ | ↑ | 0.77 | ↑ | 1.2 | 0.7 | 672 | 169 | ↑ |
| Example 57 | ↑ | ↑ | ↑ | ↑ | 2.00 | ↑ | 1.0 | 1.5 | 676 | 161 | ↑ |
| Example 58 | ↑ | ↑ | ↑ | ↑ | 3.00 | ↑ | 0.3 | 3.4 | 671 | 179 | ↑ |
| Example 59 | ↑ | ↑ | ↑ | ↑ | 3.50 | ↑ | 0.2 | 6.5 | 680 | 205 | ↑ |
| Example 60 | (1-1)-1 | B1:H1 | D1 | 52% | 1.25 | 7 | 0.7 | 3.3 | 670 | 180 | ↑ |
| Example 61 | ↑ | ↑ | ↑ | ↑ | ↑ | ↑ | 0.5 | 3.4 | 675 | 175 | ↑ |
| Example 62 | ↑ | ↑ | ↑ | ↑ | ↑ | ↑ | 0.6 | 3.4 | 675 | 173 | ↑ |
| Example 63 | ↑ | ↑ | ↑ | ↑ | ↑ | ↑ | 0.6 | 3.4 | 675 | 173 | ↑ |

Comparative Example 1

An electrophotographic photosensitive member was produced in the same manner as in Example 1 except that the electron transport material (1-1)-1 of Example 1 was changed to an electron transport material represented by the formula (15) and the electrophotographic photosensitive member was evaluated similarly. The results are shown in Table 19.

(15)

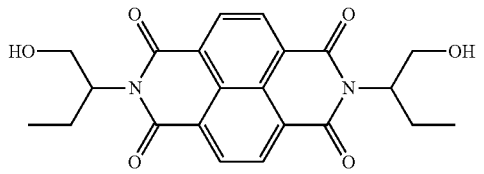

Comparative Example 2

An electrophotographic photosensitive member was produced in the same manner as in Comparative Example 1 except that the thickness of the undercoat layer of Comparative Example 1 was changed from 1.25 μm to 0.58 μm and the electrophotographic photosensitive member was evaluated similarly. The results are shown in Table 19.

Comparative Example 3

An electrophotographic photosensitive member was produced in the same manner as in Comparative Example 1 except that the undercoat layer was formed as follows and the electrophotographic photosensitive member was evaluated similarly. The results are shown in Table 19.

4.0 Parts of the electron transport material represented by the formula (15), 7.3 parts of the isocyanate compound (B1, protective group (H1)=5.1:2.2 (mass ratio)), 0.9 part of the resin (D1), and 0.05 part of dioctyltin laurate were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 0.58 μm.

The content of the electron transport material with respect to the total mass of the composition containing the electron transport material, the cross-linking agent, and the resin was 33 mass %.

Comparative Example 4

An electrophotographic photosensitive member was produced in the same manner as in Comparative Example 1 except that the undercoat layer was formed as follows and the electrophotographic photosensitive member was evaluated similarly. The results are shown in Table 19.

3.6 Parts of an electron transport material (1-6)-3, 7.5 parts of the isocyanate compound (B1, protective group (H1)=5.1:2.2 (mass ratio)), 1.1 parts of the resin (D1), and 0.05 part of dioctyltin laurate were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 0.58 μm.

The content of the electron transport material with respect to the total mass of the composition containing the electron transport material, the cross-linking agent, and the resin was 30 mass %.

Comparative Example 5

An electrophotographic photosensitive member was produced in the same manner as in Comparative Example 1 except that the undercoat layer was formed as follows and the electrophotographic photosensitive member was evaluated similarly. The results are shown in Table 19.

9.0 parts of the electron transport material (1-6)-3, 0.7 part of the isocyanate compound (B1, protective group (H1)=5.1:2.2 (mass ratio)), 0.3 part of the resin (D1), and 0.05 part of dioctyltin laurate were dissolved in a mixed solvent of 100 parts of dimethylacetamide and 100 parts of methyl ethyl ketone to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.25 μm.

The content of the electron transport material with respect to the total mass of the composition containing the electron transport material, the cross-linking agent, and the resin was 90 mass %.

Comparative Example 6

An electrophotographic photosensitive member was produced in the same manner as in Example 1 except that the undercoat layer was formed as follows and the electrophotographic photosensitive member was evaluated similarly. The results are shown in Table 19.

10.0 Parts of the electron transport material (1-1)-3 and 12.0 parts of a polycarbonate resin serving as a binder resin (Iupilon 2400, manufactured by Mitsubishi Gas Chemical Company Inc.) were dissolved in 80 parts of tetrahydrofuran (THF) to prepare an application liquid for an undercoat layer. The application liquid for an undercoat layer was applied onto the electroconductive layer by immersion to obtain a coating film. The coating film thus obtained was heated at 160° C. for 40 minutes to be polymerized, to thereby form an undercoat layer having a thickness of 1.25 μm.

The content of the electron transport material with respect to the total mass of the composition containing the electron transport material, the cross-linking agent, and the resin was 45 mass %.

Comparative Example 7

An electrophotographic photosensitive member was produced in the same manner as in Example 9 except that the resin (D1) of Example 9 was not added to the undercoat layer and the electrophotographic photosensitive member was evaluated similarly. The results are shown in Table 19.

TABLE 19

| | Electron transport material | Cross-linking agent | Resin | Ratio of electron transport material | UC thickness (μm) | CT thickness (μm) | Expression (2) | Expression (3) | Vd (−V) | Vl (−V) | Black dot |
|---|---|---|---|---|---|---|---|---|---|---|---|
| Comparative Example 1 | Formula (15) | B1:H1 | D1 | 52% | 1.25 | 7 | 1.8 | 16 | 670 | 280 | Absent |
| Comparative Example 2 | ↑ | ↑ | ↑ | ↑ | 0.58 | 7 | 5.2 | 55 | 650 | 245 | Absent |
| Comparative Example 3 | ↑ | ↑ | ↑ | 33% | 0.58 | 7 | 0.1 | 210 | 680 | 480 | Absent |
| Comparative Example 4 | (1-6)-3 | ↑ | ↑ | 30% | 0.58 | 7 | 0.1 | 80 | 685 | 380 | Absent |
| Comparative Example 5 | ↑ | ↑ | ↑ | 90% | 1.25 | 7 | Unmeasurable | Unmeasurable | 640 | 228 | Occurred |
| Comparative Example 6 | (1-1)-3 | Absent | Polycarbonate | 45% | 1.25 | 7 | Unmeasurable | Unmeasurable | 630 | 255 | Occurred |
| Comparative Example 7 | (1-4)-5 | B1:H1 | Absent | 54% | 1.25 | 7 | 2.8 | 20 | 660 | 230 | Occurred |

Example 64

An electrophotographic photosensitive member was produced in the same manner as in Example 23 except that the thickness of the undercoat layer of Example 23 was changed from 1.50 μm to 2.50 μm and the thickness of the hole transporting layer was changed from 7 μm to 3 μm.

The sensitivity of the electrophotographic photosensitive member was evaluated in the same manner as in Example 23 except that the light E was changed from 0.40 μJ/cm$^2$ to 0.62 μJ/cm$^2$ to measure the light portion potential (Vl). The results are shown in Table 20.

Comparative Example 8

An electrophotographic photosensitive member was produced in the same manner as in Example 64 except that the electron transport material of Example 64 was changed to the electron transport material represented by the formula (15) used in Comparative Example 1 and the electrophotographic photosensitive member was evaluated similarly. The results are shown in Table 20.

Example 65

An electrophotographic photosensitive member was produced in the same manner as in Example 1 except that the thickness of the hole transporting layer of Example 1 was changed from 7 μm to 5 μm.

The sensitivity of the electrophotographic photosensitive member was evaluated in the same manner as in Example 1 except that the light E was changed from 0.40 μJ/cm$^2$ to 0.50 μJ/cm$^2$ to measure the light portion potential (Vl) in order to be matched with the Vl potential of Example 1. The results are shown in Table 20.

Comparative Example 9

An electrophotographic photosensitive member was produced in the same manner as in Example 65 except that the electron transport material of Example 65 was changed to the electron transport material represented by the formula (15) used in Comparative Example 1 and the electrophotographic photosensitive member was evaluated similarly. The results are shown in Table 20.

Example 66

An electrophotographic photosensitive member was produced in the same manner as in Example 1 except that the thickness of the hole transporting layer of Example 1 was changed from 7 μm to 10 μm.

The sensitivity of the electrophotographic photosensitive member was evaluated in the same manner as in Example 1 except that the light E was changed from 0.40 μJ/cm$^2$ to 0.34 μJ/cm$^2$ to measure the light portion potential (Vl) in order to be matched with the Vl potential of Example 1. The results are shown in Table 20.

Example 67

An electrophotographic photosensitive member was produced in the same manner as in Example 1 except that the thickness of the hole transporting layer of Example 1 was changed from 7 μm to 15 μm.

The sensitivity of the electrophotographic photosensitive member was evaluated in the same manner as in Example 1 except that the light E was changed from 0.40 μJ/cm$^2$ to 0.20 μJ/cm$^2$ to measure the light portion potential (Vl) in order to be matched with the Vl potential of Example 23. The results are shown in Table 20.

TABLE 20

| | Electron transport material | Cross-linking agent | Resin | Ratio of electron transport material | UC thickness (μm) | CT thickness (μm) | Expression (2) | Expression (3) | Vd (−V) | Vl (−V) | Black dot |
|---|---|---|---|---|---|---|---|---|---|---|---|
| Example 64 | (1-1)-4 | C1-3 | D1 | 68% | 2.50 | 3 | 0.4 | 2.5 | 675 | 180 | Absent |
| Comparative Example 8 | Formula (15) | ↑ | ↑ | ↑ | 2.50 | 3 | 1.5 | 25 | 665 | 360 | ↑ |
| Example 65 | (1-1)-1 | B1:H1 | D1 | 52% | 1.25 | 5 | 0.6 | 5.8 | 670 | 180 | ↑ |
| Comparative Example 9 | Formula (15) | ↑ | ↑ | ↑ | 1.25 | 5 | 1.8 | 16 | 670 | 300 | ↑ |

TABLE 20-continued

| | Electron transport material | Cross-linking agent | Resin | Ratio of electron transport material | UC thickness (μm) | CT thickness (μm) | Expression (2) | Expression (3) | Vd (−V) | Vl (−V) | Black dot |
|---|---|---|---|---|---|---|---|---|---|---|---|
| Example 66 | (1-1)-1 | ↑ | ↑ | ↑ | 1.25 | 10 | 0.6 | 5.8 | 673 | 180 | ↑ |
| Example 67 | (1-1)-1 | ↑ | ↑ | ↑ | 1.25 | 15 | 0.6 | 5.8 | 677 | 180 | ↑ |

Examples 68 and 69

Electrophotographic photosensitive members were each produced in the same manner as in Example 1 except that the electron transport material (1-1)-1 of Example 1 was changed to an electron transport material shown in Table 21 and the electrophotographic photosensitive members were evaluated similarly. The results are shown in Table 21.

Examples 70 and 71

Electrophotographic photosensitive members were each produced in the same manner as in Example 23 except that the electron transport material (1-1)-4 of Example 23 was changed to an electron transport material shown in Table 21 and the electrophotographic photosensitive members were evaluated similarly. The results are shown in Table 21.

TABLE 21

| | Electron transport material | Cross-linking agent | Resin | Ratio of electron transport material | UC thickness (μm) | CT thickness (μm) | Expression (2) | Expression (3) | Vd (−V) | Vl (−V) | Black dot |
|---|---|---|---|---|---|---|---|---|---|---|---|
| Example 68 | (1-10)-2 | B1:H1 | D1 | 52% | 1.25 | 7 | 0.8 | 8.0 | 678 | 178 | Absent |
| Example 69 | (1-1)-11 | B1:H1 | ↑ | 52% | ↑ | ↑ | 0.9 | 9.5 | 670 | 182 | ↑ |
| Example 70 | (1-10)-3 | C1-3 | ↑ | 68% | 1.5 | ↑ | 0.7 | 7.3 | 675 | 170 | ↑ |
| Example 71 | (1-1)-12 | C1-3 | ↑ | 68% | ↑ | ↑ | 1.0 | 2.5 | 673 | 161 | ↑ |

As described above, it is understood from the results of Examples 1 to 71 and Comparative Examples 1 to 9 that, when the electrophotographic photosensitive member including the undercoat layer of the present invention was used, the occurrence of a black dot was suppressed and the sensitivity increased even when the hole transporting layer was thinned.

Example 72

An aluminum cylinder having a length of 260.5 mm and a diameter of 30 mm (JIS-A3003, aluminum alloy) was used as a support (conductive support).

Then, 50 parts of titanium oxide particles (powder resistivity: 120 Ω·cm, coverage ratio of tin oxide: 40%) each covered with oxygen-deficient tin oxide, 40 parts of a phenol resin (Plyophen J-325, manufactured by DIC Corporation, resin solid content: 60%), and 55 parts of methoxypropanol were loaded into a sand mill using glass beads each having a diameter of 1 mm and subjected to dispersion treatment for 3 hours to prepare an application liquid for an electroconductive layer.

The average particle diameter of the titanium oxide particles each covered with oxygen-deficient tin oxide in the application liquid for an electroconductive layer was measured by a centrifugal sedimentation method at a number of revolutions of 5,000 rpm using tetrahydrofuran as a dispersion medium with a particle size distribution analyzer (trade name: CAPA 700, manufactured by Horiba, Ltd.). As a result, the average particle diameter was 0.30 μm.

The application liquid for an electroconductive layer was applied onto the support by immersion to form a coating film. The coating film thus obtained was dried and thermally cured at 160° C. for 30 minutes to form an electroconductive layer having a thickness of 18 μm.

Next, 4 parts of Exemplified Compound (E101) serving as the compound represented by the formula (11), 1.5 parts of a polyvinyl butyral resin (BX-1, manufactured by Sekisui Chemical Co., Ltd.), and 0.0005 part of dioctyltin laurate serving as a catalyst were dissolved in a mixed solvent of 100 parts of dimethylacetamide and 100 parts of tetrahydrofuran. To this solution, a blocked isocyanate resin (BL3175, manufactured by Sumika Bayer Urethane Co., Ltd.) corresponding to 8 parts of a solid content was added to prepare an application liquid for an undercoat layer.

The application liquid for an undercoat layer was applied onto the electroconductive layer by immersion to obtain a coating film. The coating film thus obtained was heated at 160° C. for 40 minutes to be cured, to thereby form an undercoat layer having a thickness of 2.0 μm.

Next, a hydroxygallium phthalocyanine crystal (charge generating material) of a crystal form having peaks at Bragg angles)(2θ±0.2° in CuKα characteristic X-ray diffraction of 7.5°, 9.9°, 12.5°, 16.3°, 18.6°, 25.1°, and 28.3° was prepared. 10 Parts of the hydroxygallium phthalocyanine crystal, 5 parts of a polyvinyl butyral resin (trade name: S-LEC BX-1, manufactured by Sekisui Chemical Co., Ltd.), and 250 parts of cyclohexanone were loaded into a sand mill using glass beads each having a diameter of 1 mm, and the mixture was subjected to dispersion treatment for 2 hours. Next, 250 parts of ethyl acetate was added to the resultant to prepare an application liquid for a charge generating layer.

The application liquid for a charge generating layer was applied onto the undercoat layer by immersion to form a coating film, and the resultant coating film was dried at 95° C. for 10 minutes to form a charge generating layer having a thickness of 0.15 μm.

Next, 8 parts of a compound (hole transporting material) represented by the following formula (12-1) and parts of polyarylate having a structural unit represented by the following formula (16) and having a weight-average molecular weight (Mw) of 100,000 were dissolved in a mixed solvent of 40 parts of dimethoxymethane and 60 parts of chlorobenzene to prepare an application liquid for a hole transporting layer.

The application liquid for a hole transporting layer was applied onto the charge generating layer by immersion to form a coating film, and the resultant coating film was dried at 120° C. for 40 minutes to form a hole transporting layer having a thickness of 15 μm.

(12-1)

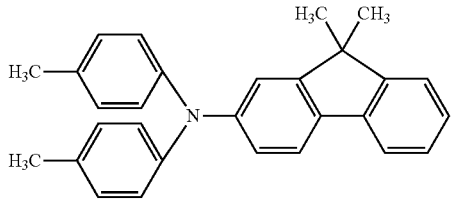

(16)

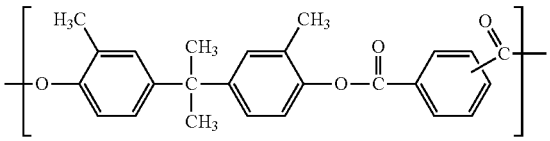

Thus, an electrophotographic photosensitive member including, on the support, the electroconductive layer, the undercoat layer, the charge generating layer, and the hole transporting layer was produced.

The electrophotographic photosensitive member thus produced was mounted onto a reconstructed machine (primary charging: roller contact DC charging, process speed: 120 mm/sec, laser exposure) of a laser beam printer (trade name: LBP-2510, manufactured by Canon Inc.) under an environment having a temperature of 23° C. and a humidity of 50% RH. Then, the initial potential of a surface and the potential of a surface after output of 15,000 sheets of images, and the output images were evaluated. Details about the foregoing are as described below.

(Measurement of Potential of Surface)

The process cartridge for a cyan color of the laser beam printer was reconstructed and a potential probe (model 6000B-8: manufactured by TREK JAPAN) was mounted at a development position. Then, a potential at the central portion of the electrophotographic photosensitive member was measured with a surface potentiometer (model 344: manufactured by TREK JAPAN). During the measurement of the potential of a surface of the photosensitive drum, the light amount of image exposure was set so that an initial dark portion potential (Vd) became −600 V and an initial light portion potential (Vl) became −150 V.

Subsequently, the electrophotographic photosensitive member produced in each of Examples was mounted onto the process cartridge for a cyan color of the laser beam printer, and the process cartridge was mounted onto a cyan process cartridge station, followed by the output of an image. First, one solid white image, five images for ghost evaluation, one solid black image, and five images for ghost evaluation were continuously output in the stated order.

Figure 9:
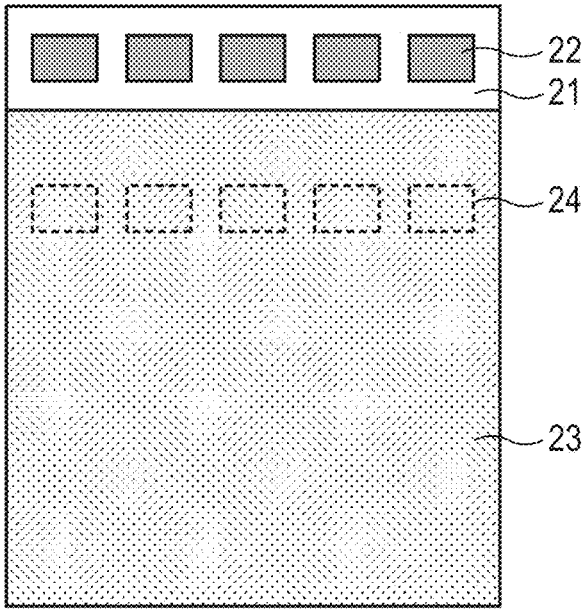
FIG. 9 is a diagram for illustrating an image for ghost evaluation (printing for ghost evaluation).
Figure 10:
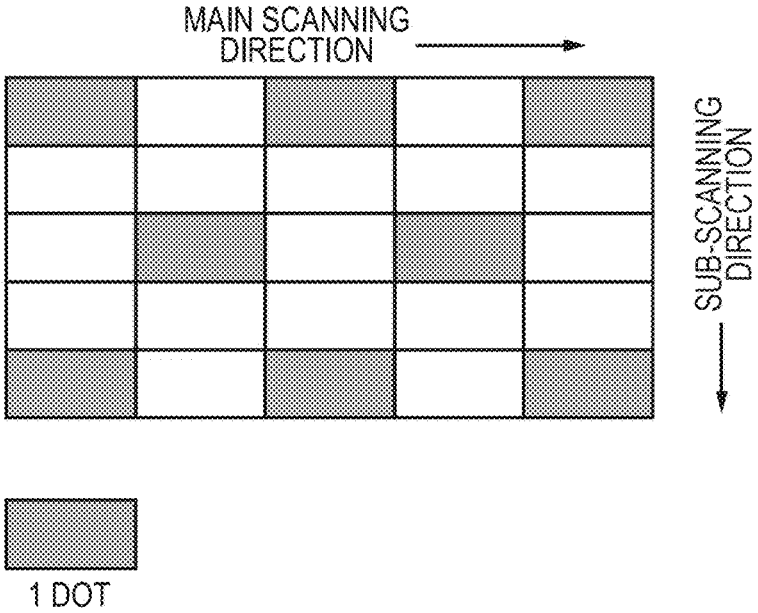
FIG. 10 is a diagram for illustrating a one-dot knight-jump pattern image.

Each image for ghost evaluation is obtained by: outputting a quadrangular solid image (22) in a white image (21) at the leading end of an image as illustrated in FIG. 9; and then producing a "halftone image of a one-dot knight-jump pattern" illustrated in FIG. 10. It should be noted that a ghost portion (23) in FIG. 9 is a portion where a ghost (24) resulting from the solid image (22) may appear.

Evaluation for a positive ghost was performed by measuring a difference between the image density of the halftone image of a one-dot knight-jump pattern and the image density of the ghost portion. The density difference was measured at ten sites in one image for ghost evaluation with a spectral densitometer (trade name: X-Rite 504/508, manufactured by X-Rite). The operation was performed for all of the ten images for ghost evaluation, and the average of a total of 100 measured values was calculated. The result is shown in Table 22. As the density difference (Macbeth density difference) enlarges, the positive ghost occurs more strongly. The fact that the density difference (Macbeth density difference) reduces means that the positive ghost is suppressed.

Example 73

An electrophotographic photosensitive member was produced in the same manner as in Example 72 except that 2 parts of Exemplified Compound (E101) and 2 parts of Exemplified Compound (E106) were used as the compound represented by the formula (11) and the electrophotographic photosensitive member was evaluated for a ghost similarly. The results are shown in Table 22.

Examples 74 to 121

Electrophotographic photosensitive members were each produced in the same manner as in Example 72 except that the kinds and the numbers of parts by mass of the compound represented by the formula (11), the cross-linking agent, and the resin were changed as shown in Table 22 and the electrophotographic photosensitive members were evaluated for a ghost similarly. The results are shown in Table 22.

Examples 122 to 125

Application liquids for an undercoat layer were each prepared in the same manner as in Example 72 except that: the compound represented by the formula (11) was changed as shown in Table 22; an acrylic cross-linking agent (A-TMPT, manufactured by Shin-Nakamura Chemical Co., Ltd.) represented by the formula (17) were used in place of the isocyanate compound without using a resin; and azoisobutyronitrile (AIBN) was used in place of dioctyltin laurate serving as a catalyst. Then, electrophotographic photosensitive members were produced in the same manner as in Example 72 except that coating films of the application liquids for an undercoat layer were formed, and the coating films were heated under a nitrogen stream, and the electrophotographic photosensitive members were evaluated for a ghost similarly. The results are shown in Table 22.

(17)

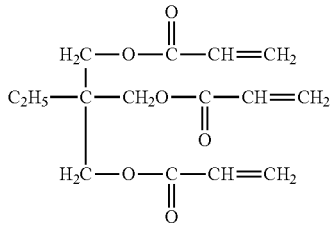

Example 126

An electrophotographic photosensitive member was produced in the same manner as in Example 72 except that the compound represented by the formula (12-1) was changed to a compound represented by the formula (12-4) and the electrophotographic photosensitive member was evaluated for a ghost similarly. The results are shown in Table 22.

(12-4)

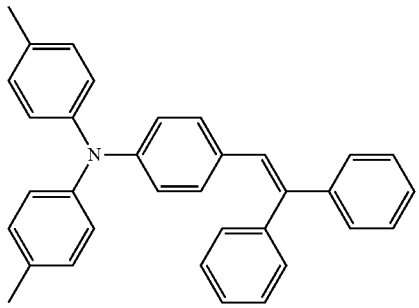

Example 127

An electrophotographic photosensitive member was produced in the same manner as in Example 72 except that the amine compound represented by the formula (12-1) was changed to a compound represented by the formula (12-2) and the electrophotographic photosensitive member was evaluated for a ghost similarly. The results are shown in Table 22.

(12-2)

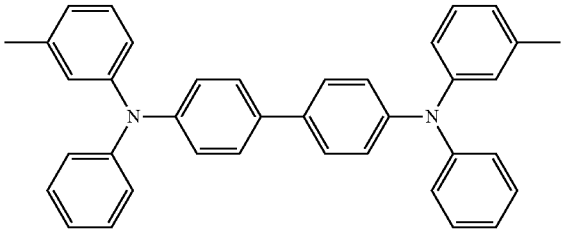

Example 128

An electrophotographic photosensitive member was produced in the same manner as in Example 72 except that a support was obtained by subjecting an aluminum cylinder to liquid honing treatment under the following conditions without forming the electroconductive layer. The results are shown in Table 22.

<Liquid Honing Conditions>

Abrasive grains=zirconia beads each having a particle diameter of from 70 μm to 125 μm (trade name: Zirblast B120, manufactured by Materials Science, Inc.)

Suspending medium=water

Abrasive/suspending medium=1/9 (volume ratio)

The surface roughness of the cylinder after the honing was measured through use of a surface roughness measuring instrument (Surfcorder SE3500, manufactured by Kosaka Laboratory Ltd.) according to JIS B 0601 (1994). As a result, the maximum height (RmaxD) was 2.09 μm, the ten-point average roughness (Rz) was 1.48 μm, and the arithmetic average roughness (Ra) was 0.21 μm.

Examples 129 to 134

Electrophotographic photosensitive members were each produced in the same manner as in Example 72, 76, 78, 87, 90, or 95 except that the thickness of the hole transporting layer of Example 72, 76, 78, 87, 90, or 95 was changed from 15 μm to 20 μm and the electrophotographic photosensitive members were evaluated for a ghost similarly. The results are shown in Table 22.

Comparative Example 11

An electrophotographic photosensitive member was produced in the same manner as in Example 1 except that the application liquid for an undercoat layer described below was used and the electrophotographic photosensitive member was evaluated for a ghost similarly. An application liquid for an undercoat layer was prepared through use of 4 parts by mass of the following compound (18) disclosed in Japanese Patent Application Laid-Open No. 2010-145506, 4.8 parts by mass of a polycarbonate Z-type resin (Iupilon 2400, Z-type polycarbonate, manufactured by Mitsubishi Gas Chemical Company Inc.), 100 parts by mass of dimethylacetamide, and 100 parts by mass of tetrahydrofuran. The results are shown in Table 22.

(18)

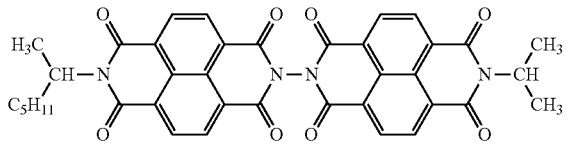

Comparative Example 12

An electrophotographic photosensitive member was produced in the same manner as in Example 72 except that the compound (18) described in Comparative Example 11 was used in place of the compound represented by the formula (11) and the electrophotographic photosensitive member was evaluated for a ghost similarly. The results are shown in Table 22.

Comparative Example 13

An electrophotographic photosensitive member was produced in the same manner as in Example 72 except that the following application liquid for an undercoat layer was used and the electrophotographic photosensitive member was evaluated for a ghost similarly. The results are shown in Table 22.

10 Parts of a compound represented by the formula (19) and 5 parts of a phenol resin (PL-4804, manufactured by Gun Ei Chemical Industry Co., Ltd.) were dissolved in a mixed solvent of 200 parts of dimethylformamide and 150 parts of benzyl alcohol to prepare an application liquid for an undercoat layer.

(19)

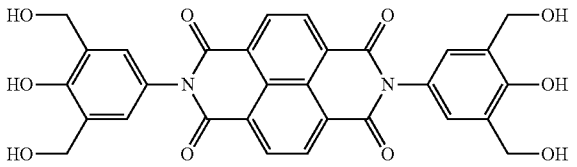

Comparative Example 14

A photosensitive member was produced in the same manner as in Example 122 except that a compound (20) disclosed in Japanese Patent Application Laid-Open No. 2003-330209 was used in place of the compound represented by the formula (11) and the photosensitive member was evaluated for a ghost similarly. The results are shown in Table 22.

(20)

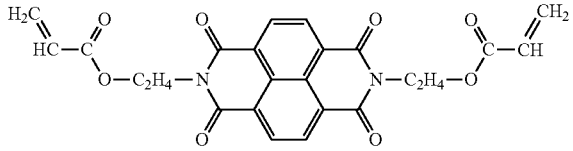

TABLE 22

| Example No | Compound No | Parts by mass | Number of polymerizable functional groups $R^7$, $R^8$ | Y | Cross-linking agent | Parts by mass (solid content) | Resin | Parts by mass (solid content) | Macbeth density (initial) | Macbeth density (difference) |
|---|---|---|---|---|---|---|---|---|---|---|
| 72 | E101 | 4 | 0 | 2 | Cross-linking agent 1 | 8 | Resin 1 | 1.5 | 0.020 | 0.004 |
| 73 | E101/E106 | 2/2 | 0 | 2 | Cross-linking agent 1 | 8 | Resin 1 | 1.5 | 0.023 | 0.005 |
| 74 | E106 | 4 | 0 | 2 | Cross-linking agent 1 | 8 | Resin 1 | 1.5 | 0.024 | 0.006 |
| 75 | E108 | 4 | 0 | 2 | Cross-linking agent 1 | 10 | Resin 2 | 1.5 | 0.022 | 0.004 |
| 76 | E109 | 4 | 0 | 2 | Cross-linking agent 1 | 8 | Resin 1 | 1.5 | 0.025 | 0.003 |
| 77 | E111 | 4 | 0 | 2 | Cross-linking agent 2 | 6 | Resin 2 | 1.5 | 0.026 | 0.006 |
| 78 | E117 | 4 | 0 | 2 | Cross-linking agent 1 | 8 | Resin 3 | 1.5 | 0.027 | 0.008 |
| 79 | E127 | 4 | 0 | 2 | Cross-linking agent 1 | 8 | Resin 1 | 1.5 | 0.027 | 0.009 |
| 80 | E134 | 4 | 0 | 2 | Cross-linking agent 1 | 10 | Resin 1 | 1.5 | 0.028 | 0.009 |
| 81 | E139 | 4 | 0 | 2 | Cross-linking agent 2 | 6 | Resin 1 | 1.5 | 0.032 | 0.011 |
| 82 | E144 | 4 | 0 | 2 | Cross-linking agent 1 | 8 | Resin 1 | 1.5 | 0.028 | 0.009 |
| 83 | E145 | 4 | 0 | 2 | Cross-linking agent 1 | 8 | Resin 1 | 1.5 | 0.030 | 0.011 |
| 84 | E146 | 4 | 0 | 2 | Cross-linking agent 1 | 8 | Resin 1 | 1.5 | 0.031 | 0.011 |
| 85 | E147 | 4 | 0 | 2 | Cross-linking agent 1 | 8 | Resin 1 | 1.5 | 0.021 | 0.007 |
| 86 | E201 | 4 | 2 | 2 | Cross-linking agent 1 | 16 | Resin 1 | 1.5 | 0.034 | 0.012 |
| 87 | E206 | 4 | 2 | 2 | Cross-linking agent 2 | 12 | Resin 1 | 1.5 | 0.038 | 0.016 |
| 88 | E211 | 4 | 4 | 2 | Cross-linking agent 1 | 30 | Resin 1 | 1.5 | 0.039 | 0.016 |
| 89 | E301 | 4 | 2 | 1 | Cross-linking agent 1 | 12 | Resin 1 | 1.5 | 0.040 | 0.017 |
| 90 | E307 | 4 | 2 | 1 | Cross-linking agent 2 | 18 | Resin 1 | 1.5 | 0.044 | 0.018 |
| 91 | E312 | 4 | 2 | 1 | Cross-linking agent 2 | 9 | Resin 1 | 1.5 | 0.048 | 0.023 |
| 92 | E313 | 4 | 2 | 1 | Cross-linking agent 1 | 15 | Resin 1 | 1.5 | 0.046 | 0.022 |
| 93 | E402 | 4 | 0 | 1 | Cross-linking agent 1 | 4 | Resin 1 | 1.5 | 0.049 | 0.024 |
| 94 | E403 | 4 | 0 | 1 | Cross-linking agent 1 | 6 | Resin 2 | 1.5 | 0.052 | 0.026 |
| 95 | E409 | 4 | 0 | 1 | Cross-linking agent 1 | 4 | Resin 1 | 1.5 | 0.049 | 0.024 |
| 96 | E104 | 4 | 0 | 2 | Cross-linking agent 3 | 8 | Resin 1 | 1.5 | 0.023 | 0.005 |
| 97 | E105 | 4 | 0 | 2 | Cross-linking agent 3 | 8 | Resin 3 | 1.5 | 0.021 | 0.003 |
| 98 | E110 | 4 | 0 | 2 | Cross-linking agent 3 | 10 | Resin 1 | 1.5 | 0.026 | 0.007 |
| 99 | E113 | 4 | 0 | 2 | Cross-linking agent 4 | 6 | Resin 3 | 1.5 | 0.025 | 0.007 |
| 100 | E131 | 4 | 0 | 2 | Cross-linking agent 3 | 8 | Resin 1 | 1.5 | 0.032 | 0.011 |
| 101 | E135 | 4 | 0 | 2 | Cross-linking agent 3 | 8 | Resin 2 | 1.5 | 0.030 | 0.009 |
| 102 | E203 | 4 | 2 | 2 | Cross-linking agent 3 | 16 | Resin 1 | 1.5 | 0.036 | 0.013 |
| 103 | E212 | 4 | 2 | 2 | Cross-linking agent 3 | 20 | Resin 1 | 1.5 | 0.035 | 0.016 |
| 104 | E305 | 4 | 4 | 1 | Cross-linking agent 3 | 25 | Resin 1 | 1.5 | 0.041 | 0.018 |
| 105 | E308 | 4 | 2 | 1 | Cross-linking agent 3 | 12 | Resin 1 | 1.5 | 0.045 | 0.019 |
| 106 | E311 | 4 | 2 | 1 | Cross-linking agent 3 | 9 | Resin 1 | 1.5 | 0.047 | 0.020 |
| 107 | E314 | 4 | 2 | 1 | Cross-linking agent 3 | 12 | Resin 1 | 1.5 | 0.046 | 0.020 |
| 108 | E320 | 4 | 2 | 1 | Cross-linking agent 3 | 15 | Resin 1 | 1.5 | 0.048 | 0.021 |
| 109 | E401 | 4 | 0 | 1 | Cross-linking agent 3 | 4 | Resin 1 | 1.5 | 0.049 | 0.026 |
| 110 | E404 | 4 | 0 | 1 | Cross-linking agent 3 | 4 | Resin 3 | 1.5 | 0.050 | 0.025 |
| 111 | E405 | 4 | 0 | 1 | Cross-linking agent 3 | 4 | Resin 1 | 1.5 | 0.051 | 0.025 |
| 112 | E407 | 4 | 0 | 1 | Cross-linking agent 3 | 6 | Resin 1 | 1.5 | 0.050 | 0.024 |
| 113 | E412 | 4 | 0 | 1 | Cross-linking agent 3 | 4 | Resin 2 | 1.5 | 0.052 | 0.026 |
| 114 | E415 | 4 | 0 | 1 | Cross-linking agent 3 | 4 | Resin 1 | 1.5 | 0.052 | 0.026 |
| 115 | E417 | 4 | 0 | 1 | Cross-linking agent 3 | 2 | Resin 1 | 1.5 | 0.052 | 0.025 |
| 116 | E420 | 4 | 0 | 1 | Cross-linking agent 3 | 4 | Resin 1 | 1.5 | 0.051 | 0.024 |
| 117 | E102 | 4 | 0 | 2 | Cross-linking agent 1 | 8 | Resin 1 | 1.5 | 0.023 | 0.005 |
| 118 | E315 | 4 | 2 | 1 | Cross-linking agent 3 | 12 | Resin 1 | 1.5 | 0.042 | 0.018 |
| 119 | E103 | 4 | 0 | 2 | Cross-linking agent 1 | 8 | Resin 1 | 1.5 | 0.028 | 0.010 |
| 120 | E316 | 4 | 2 | 1 | Cross-linking agent 3 | 12 | Resin 1 | 1.5 | 0.046 | 0.022 |
| 121 | E317 | 4 | 2 | 1 | Cross-linking agent 1 | 12 | Resin 1 | 1.5 | 0.048 | 0.020 |
| 122 | E114 | 4 | 0 | 2 | Cross-linking agent 5 | 2 | — | — | 0.022 | 0.011 |
| 123 | E115 | 4 | 0 | 2 | Cross-linking agent 5 | 3 | — | — | 0.029 | 0.006 |
| 124 | E116 | 4 | 0 | 2 | Cross-linking agent 5 | 3 | — | — | 0.028 | 0.005 |

TABLE 22-continued

| Example No | Compound No | Parts by mass | Number of polymerizable functional groups $R^7$, $R^8$ | Y | Cross-linking agent | Parts by mass (solid content) | Resin | Parts by mass (solid content) | Macbeth density (initial) | Macbeth density (difference) |
|---|---|---|---|---|---|---|---|---|---|---|
| 125 | E136 | 4 | 0 | 2 | Cross-linking agent 5 | 2 | — | — | 0.025 | 0.003 |
| 126 | E101 | 4 | 0 | 2 | Cross-linking agent 1 | 8 | Resin 1 | 1.5 | 0.022 | 0.006 |
| 127 | E101 | 4 | 0 | 2 | Cross-linking agent 1 | 8 | Resin 1 | 1.5 | 0.026 | 0.003 |
| 128 | E101 | 4 | 0 | 2 | Cross-linking agent 1 | 8 | Resin 1 | 1.5 | 0.022 | 0.005 |
| 129 | E101 | 4 | 0 | 2 | Cross-linking agent 1 | 8 | Resin 1 | 1.5 | 0.021 | 0.005 |
| 130 | E109 | 4 | 0 | 2 | Cross-linking agent 1 | 8 | Resin 1 | 1.5 | 0.025 | 0.005 |
| 131 | E117 | 4 | 0 | 2 | Cross-linking agent 1 | 8 | Resin 3 | 1.5 | 0.027 | 0.010 |
| 132 | E206 | 4 | 2 | 2 | Cross-linking agent 2 | 12 | Resin 1 | 1.5 | 0.04 | 0.017 |
| 133 | E307 | 4 | 2 | 1 | Cross-linking agent 2 | 18 | Resin 1 | 1.5 | 0.044 | 0.022 |
| 134 | E409 | 4 | 0 | 1 | Cross-linking agent 1 | 4 | Resin 1 | 1.5 | 0.051 | 0.025 |
| Comparative Example 11 | Compound (18) | 4 | — | — | — | — | Z400 | 4.8 | 0.140 | 0.121 |
| Comparative Example 12 | Compound (18) | 4 | — | — | Cross-linking agent 1 | 8 | Resin 1 | 1.5 | 0.116 | 0.090 |
| Comparative Example 13 | Compound (19) | 10 | — | — | — | — | PL-4804 | 5.0 | 0.063 | 0.058 |
| Comparative Example 14 | Compound (20) | 4 | — | — | Cross-linking agent 5 | 2 | — | — | 0.081 | 0.076 |

In Table 22, the cross-linking agent 1 is an isocyanate-based cross-linking agent (trade name: DESMODUR BL3575, manufactured by Sumika Bayer (solid content: 75%)), the cross-linking agent 2 is an isocyanate-based cross-linking agent (trade name: DESMODUR BL3175, manufactured by Sumika Bayer (solid content: 75%)), the cross-linking agent 3 is a butylated melamine-based cross-linking agent (trade name: SUPER BECKAMINE J821-60, manufactured by DIC Corporation (solid content: 60%)), the cross-linking agent is a butylated urea-based cross-linking agent (trade name: BECKAMINE P138, manufactured by DIC Corporation (solid content: 60%)), and the cross-linking agent 5 is an acrylic cross-linking agent (A-TMPT: manufactured by Shin-Nakamura Chemical Co., Ltd.).

In Table 22, the resin 1 (resin having a polymerizable functional group) is a polyvinyl acetal resin having a number of moles of a hydroxyl group per 1 g of 3.3 mmol and a molecular weight of $1\times10^5$, the resin 2 is a polyvinyl acetal resin having a number of moles of a hydroxyl group per 1 g of 3.3 mmol and a molecular weight of $2\times10^4$, and the resin 3 is a polyvinyl acetal resin having a number of moles of a hydroxyl group per 1 g of 2.5 mmol and a molecular weight of $3.4\times10^5$.

As described above, it is understood from the results of Examples 72 to 134 and Comparative Examples 11 to 14 that a positive ghost was able to be suppressed by using the electrophotographic photosensitive member including the undercoat layer of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-217358, filed Oct. 24, 2014, Japanese Patent Application No. 2015-069755, filed Mar. 30, 2015, and Japanese Patent Application No. 2015-200570, filed Oct. 8, 2015, which are hereby incorporated by references herein in their entirety.

What is claimed is:

1. An electrophotographic photosensitive member, comprising:

a laminated body and a hole transporting layer on the laminated body, the laminated body comprising:

a support;

an undercoat layer having a thickness of d1 (μm), on the support; and a charge generating layer having a thickness of d2 (μm), on the undercoat layer, wherein the hole transporting layer has a thickness of 15 μm or less, the undercoat layer comprises a polymerized product of a composition including an electron transport material represented by formula (1), a cross-linking agent, and a thermoplastic resin having a polymerizable functional group:

$$Z^1—X—Z^2 \quad (1)$$

in which $Z^1$ and $Z^2$ each represent a group having an electron transport property;

X represents a linking group, and the linking group is a substituted or unsubstituted alkylene group, a substituted or unsubstituted arylene group, a substituted or unsubstituted heterocyclic group, or a group derived by substituting one of methylene groups in a main chain of the substituted or unsubstituted alkylene group with $R^1$, the $R^1$ representing an oxygen atom, a sulfur atom, $SO_2$, $NR^2$, CO, or a substituted or unsubstituted arylene group, the $R^2$ representing a hydrogen atom, an alkyl group, or an aryl group; and at least one of $Z^1$, $Z^2$, and X has a polymerizable functional group, and the polymerizable functional group is a hydroxyl group, a thiol group, an amino group, a carboxyl group, or a methoxy group;

when the charge generating layer of the laminated body is charged by corona charging so that a dark potential of a surface of the charge generating layer after 1.0 second from the corona charging being defined as Vd1, Vd1 satisfies expression (4)

$$Vd1=-100\times(d1+d2) \quad (4), \text{ and}$$

a dark potential of the surface of the charge generating layer after 0.80 second from the corona charging is defined as Vd2, Vd1 and Vd2 satisfies expression (2)

$$0.20 \leq |Vd2 - Vd1| \leq 2.0 \quad (2), \text{ and}$$

when the surface of the charge generating layer which has a potential of Vd1 (V) is exposed to a laser light having a wavelength of 780 nm for 1 microsecond and a light intensity so that the potential of the surface of the charge generating layer decays by 20% with respect to Vd1 (V) after 0.04 second from the exposure to the laser light, and a transit time (ms) determined based on a time change rate of the potential of the surface of the charge generating layer after the exposure to the laser light is defined as τ, τ, satisfies expression (3):

$$\tau \leq 10 \quad (3).$$

2. An electrophotographic photosensitive member according to claim 1, wherein the hole transporting layer has a thickness of 3 to 10 μm.

3. An electrophotographic photosensitive member according to claim 1, wherein a content of the electron transport material represented by the formula (1) is 50 to 85 mass % with respect to a total mass of the composition.

4. An electrophotographic photosensitive member according to claim 1, wherein the thickness d1 of the undercoat layer is 0.7 to 3.0 μm.

5. An electrophotographic photosensitive member according to claim 1, wherein the cross-linking agent has 2 to 6 isocyanate groups, 2 to 6 blocked isocyanate groups, or 2 to 6 groups each represented by $—CH_2—OR^6$ where $R^6$ represents an alkyl group.

6. An electrophotographic photosensitive member according to claim 1, wherein $0.01 \leq \tau \leq 2$.

7. An electrophotographic photosensitive member according to claim 1, wherein the electron transport material represented by formula (1) comprises a compound represented by formula (11):

(11)

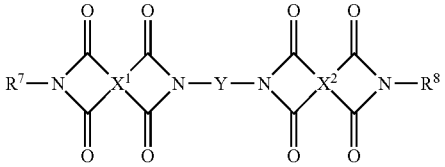

in which $X^1$ and $X^2$ each independently represent a residue obtained by removing four carboxyl groups from a substituted or unsubstituted aromatic tetracarboxylic acid, and when the residue has a substituent, the substituent is a halogen atom, a cyano group, a nitro group, a substituted or unsubstituted alkyl group, or a substituted or unsubstituted aryl group;

Y represents a substituted or unsubstituted alkylene group having a polymerizable functional group or a substituted or unsubstituted arylene group having a polymerizable functional group;

$R^7$ and $R^8$ each independently represent a substituted or unsubstituted alkyl group, a group derived by substituting one of methylene groups of the substituted or unsubstituted alkyl group with an oxygen atom, a group derived by substituting one of the methylene groups of the substituted or unsubstituted alkyl group with a sulfur atom, a group derived by substituting one of the methylene groups of the substituted or unsubstituted alkyl group with $NR^9$, a substituted or unsubstituted aryl group, a substituted or unsubstituted heterocyclic group, or an alkoxycarbonyl group, and $R^7$ and $R^8$ may each independently have a polymerizable functional group; and the polymerizable functional group is a hydroxyl group, a thiol group, an amino group, a carboxyl group, or a methoxy group, provided that the oxygen atom, the sulfur atom, and the $NR^9$ are free from being directly bonded to nitrogen atoms to which $R^7$ and $R^8$ are bonded.

8. An electrophotographic photosensitive member according to claim 1, wherein the charge generating layer comprises at least one kind of charge generating material selected from the group consisting of a phthalocyanine pigment and an azo pigment.

9. An electrophotographic photosensitive member according to claim 1, wherein the hole transporting layer comprises at least one kind of hole transporting material selected from the group consisting of a triarylamine compound, a benzidine compound, and a styryl compound.

10. An electrophotographic photosensitive member, comprising:

a support;

an undercoat layer on the support; and a photosensitive layer on the undercoat layer, wherein the undercoat layer comprises a polymerized product of one of the following (i) and (ii):

(i) a polymerized product of a compound represented by formula (11); and (ii) a polymerized product of a composition containing the compound represented by formula (11) and a cross-linking agent:

(11)

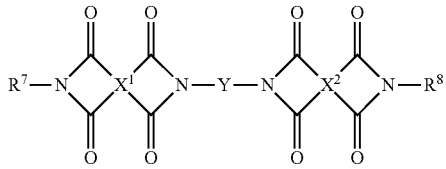

in which $X^1$ and $X^2$ each independently represent a residue obtained by removing four carboxyl groups from a substituted or unsubstituted aromatic tetracarboxylic acid, and when the residue has a substituent, the substituent comprises is a halogen atom, a cyano group, a nitro group, a substituted or unsubstituted alkyl group, or a substituted or unsubstituted aryl group;

Y represents a substituted or unsubstituted alkylene group having a polymerizable functional group or a substituted or unsubstituted arylene group having a polymerizable functional group; and $R^7$ and $R^8$ each independently represent a substituted or unsubstituted alkyl group, a group derived by substituting one of methylene groups of the substituted or unsubstituted alkyl group with an oxygen atom, a group derived by substituting one of the methylene groups of the substituted or unsubstituted alkyl group with a sulfur atom, a group derived by substituting one of the methylene groups of the substituted or unsubstituted alkyl group with $NR^9$, a substituted or unsubstituted aryl group, a substituted or unsubstituted heterocyclic group, or an alkoxycarbonyl group, and $R^7$ and $R^8$ are free of a polymerizable functional group, provided that the oxygen atom, the sulfur atom, and the $NR^9$ are free from being directly bonded to nitrogen atoms to which $R^7$ and $R^8$ are bonded.

11. An electrophotographic photosensitive member according to claim 10, wherein in $R^7$ and $R^8$ a substituent of the substituted alkyl group is an aryl group, a carbonyl group, an alkoxycarbonyl group, or a halogen atom, and a substituent of the substituted aryl group and a substituent of the substituted heterocyclic group are each a halogen atom, a nitro group, a cyano group, an alkyl group, an alkoxycarbonyl group, an alkoxy group, or a halogenated alkyl group.

12. An electrophotographic photosensitive member according to claim 10, wherein the polymerizable functional group is at least one kind selected from the group consisting of a hydroxyl group, a carboxyl group, an amino group, and a thiol group.

13. An electrophotographic photosensitive member according to claim 10, wherein the polymerizable functional group is an unsaturated hydrocarbon group.

14. An electrophotographic photosensitive member according to claim 13, wherein the unsaturated hydrocarbon group is at least one kind selected from the group consisting of an acryloyloxy group and a methacryloyloxy group.

15. An electrophotographic photosensitive member according to claim 10, wherein the compound represented by formula (11) has two or more polymerizable functional groups.

16. An electrophotographic photosensitive member according to claim 10, wherein Y of the compound represented by formula (11) has two polymerizable functional groups.

17. An electrophotographic photosensitive member according to claim 10, wherein, in Y of the compound represented by formula (11), the polymerizable functional group is a hydroxyl group.

18. An electrophotographic photosensitive member according to claim 10, wherein $X^1$ and $X^2$ of the compound represented by formula (11) each represent any one selected from the following group

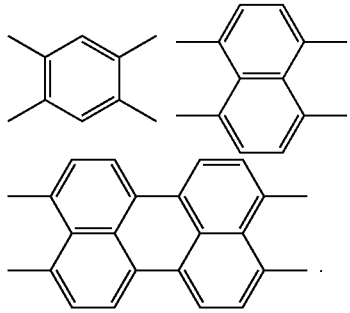

19. An electrophotographic photosensitive member according to claim 10, wherein the photosensitive layer comprises a charge generating layer and a hole transporting layer on the charge generating layer; and the hole transporting layer has a thickness of more than 15 μm.

20. An electrophotographic photosensitive member according to claim 10, wherein a mass ratio between the compound represented by the formula (11) and the cross-linking agent in the composition is 100:50 to 100:500.

21. A process cartridge, comprising:

an electrophotographic photosensitive member; and at least one unit selected from the group consisting of a charging unit, a developing unit, and a cleaning unit, the process cartridge integrally supporting the electrophotographic photosensitive member and the at least one unit, the process cartridge being removably mounted onto an electrophotographic apparatus, wherein the electrophotographic photosensitive member comprises a laminated body and a hole transporting layer on the laminated body, the laminated body comprises:

a support;

an undercoat layer having a thickness of d1 (μm), on the support; and a charge generating layer having a thickness of d2 (μm), on the undercoat layer, wherein the hole transporting layer has a thickness of 15 μm or less;

the undercoat layer comprises a polymerized product of a composition including an electron transport material represented by formula (1), a cross-linking agent, and a thermoplastic resin having a polymerizable functional group:

$$Z^1—X—Z^2 \quad (1)$$

in which $Z^1$ and $Z^2$ each represent a group having an electron transport property;

X represents a linking group, and the linking group is a substituted or unsubstituted alkylene group, a substituted or unsubstituted arylene group, a substituted or unsubstituted heterocyclic group, or a group derived by substituting one of methylene groups in a main chain of the substituted or unsubstituted alkylene group with $R^1$, the $R^1$ representing an oxygen atom, a sulfur atom, $SO_2$, $NR^2$, CO, or a substituted or unsubstituted arylene group, the $R^2$ representing a hydrogen atom, an alkyl group, or an aryl group; and at least one of $Z^1$, $Z^2$, and X has a polymerizable functional group, and the polymerizable functional group is a hydroxyl group, a thiol group, an amino group, a carboxyl group, or a methoxy group;

when the charge generating layer of the laminated body is charged by corona charging so that a dark potential of a surface of the charge generating layer after 1.0 second from the corona charging being defined as Vd1, Vd1 satisfies expression (4)

$$Vd1=-100\times(d1+d2) \quad (4), \text{ and}$$

a dark potential of the surface of the charge generating layer after 0.80 second from the corona charging is defined as Vd2, Vd1 and Vd2 satisfies expression (2)

$$0.20\leq|Vd2-Vd1|\leq2.0 \quad (2), \text{ and}$$

when the surface of the charge generating layer which has a potential of Vd1 (V) is exposed to a laser light having a wavelength of 780 nm for 1 microsecond and a light intensity so that the potential of the surface of the charge generating layer decays by 20% with respect to Vd1 (V) after 0.04 second from the exposure to the laser light, and a transit time (ms) determined based on a time change rate of the potential of the surface of the charge generating layer after the exposure to the laser light is defined as τ, τ, satisfies expression (3):

$$\tau\leq10 \quad (3).$$

22. An electrophotographic apparatus, comprising:
an electrophotographic photosensitive member;
an exposing unit;
a charging unit;
a developing unit; and
a transferring unit, wherein
the electrophotographic photosensitive member comprises:
a laminated body and a hole transporting layer on the laminated body, the laminated body comprising:
a support;
an undercoat layer having a thickness of d1 (μm), on the support; and
a charge generating layer having a thickness of d2 (μm), on the undercoat layer, wherein
the hole transporting layer has a thickness of 15 μm or less;
the undercoat layer comprises a polymerized product of a composition including an electron transport material represented by formula (1), a cross-linking agent, and a thermoplastic resin having a polymerizable functional group:

$$Z^1—X—Z^2 \quad (1)$$

in which $Z^1$ and $Z^2$ each represent a group having an electron transport property;
X represents a linking group, and the linking group is a substituted or unsubstituted alkylene group, a substituted or unsubstituted arylene group, a substituted or unsubstituted heterocyclic group, or a group derived by substituting one of methylene groups in a main chain of the substituted or unsubstituted alkylene group with $R^1$, the $R^1$ representing an oxygen atom, a sulfur atom, $SO_2$, $NR^2$, CO, or a substituted or unsubstituted arylene group, the $R^2$ representing a hydrogen atom, an alkyl group, or an aryl group; and
at least one of $Z^1$, $Z^2$, and X has a polymerizable functional group, and the polymerizable functional group is a hydroxyl group, a thiol group, an amino group, a carboxyl group, or a methoxy group;
when the charge generating layer of the laminated body is charged by corona charging so that a dark potential of a surface of the charge generating layer after 1.0 second from the corona charging being defined as Vd1, Vd1 satisfies expression (4)

$$Vd1=-100\times(d1+d2) \quad (4), \text{ and}$$

a dark potential of the surface of the charge generating layer after 0.80 second from the corona charging is defined as Vd2, Vd1 and Vd2 satisfies expression (2)

$$0.20\leq|Vd2-Vd1|\leq2.0 \quad (2), \text{ and}$$

when the surface of the charge generating layer which has a potential of Vd1 (V) is exposed to a laser light having a wavelength of 780 nm for 1 microsecond and a light intensity so that the potential of the surface of the charge generating layer decays by 20% with respect to Vd1 (V) after 0.04 second from the exposure to the laser light, and a transit time (ms) determined based on a time change rate of the potential of the surface of the charge generating layer after the exposure to the laser light is defined as τ, τ, satisfies expression (3):

$$\tau\leq10 \quad (3).$$

23. A process cartridge, comprising:
an electrophotographic photosensitive member; and
at least one unit selected from the group consisting of a charging unit, a developing unit, and a cleaning unit,
the process cartridge integrally supporting the electrophotographic photosensitive member and the at least one unit, and
the process cartridge being removably mounted onto an electrophotographic apparatus, wherein
the electrophotographic photosensitive member comprises:
a support;
an undercoat layer on the support; and
a photosensitive layer on the undercoat layer,
wherein the undercoat layer comprises a polymerized product of one of the following (i) and (ii):
(i) a polymerized product of a compound represented by the following formula (11); and
(ii) a polymerized product of a composition containing the compound represented by formula (11) and a cross-linking agent:

(11)

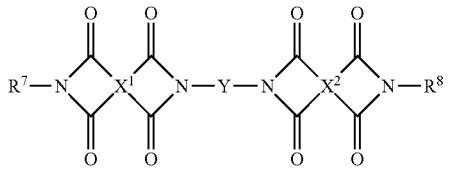

in which $X^1$ and $X^2$ each independently represent a residue obtained by removing four carboxyl groups from a substituted or unsubstituted aromatic tetracarboxylic acid, and when the residue has a substituent, the substituent comprises is a halogen atom, a cyano group, a nitro group, a substituted or unsubstituted alkyl group, or a substituted or unsubstituted aryl group;
Y represents a substituted or unsubstituted alkylene group having a polymerizable functional group or a substituted or unsubstituted arylene group having a polymerizable functional group; and
$R^7$ and $R^8$ each independently represent a substituted or unsubstituted alkyl group, a group derived by substituting one of methylene groups of the substituted or unsubstituted alkyl group with an oxygen atom, a group derived by substituting one of the methylene groups of the substituted or unsubstituted alkyl group with a sulfur atom, a group derived by substituting one of the methylene groups of the substituted or unsubstituted alkyl group with $NR^9$, a substituted or unsubstituted aryl group, a substituted or unsubstituted heterocyclic group, or an alkoxycarbonyl group, and $R^7$ and $R^8$ are free of a polymerizable functional group,
provided that the oxygen atom, the sulfur atom, and the $NR^9$ are free from being directly bonded to nitrogen atoms to which $R^7$ and $R^8$ are bonded.

24. An electrophotographic apparatus, comprising:
an electrophotographic photosensitive member;
an exposing unit;
a charging unit;
a developing unit; and
a transferring unit, wherein
the electrophotographic photosensitive member comprises:

a support;

an undercoat layer on the support; and a photosensitive layer on the undercoat layer, the undercoat layer comprising a polymerized product of one of the following (i) and (ii):

(i) a polymerized product of a compound represented by formula (11); and (ii) a polymerized product of a composition containing the compound represented by formula (11) and a cross-linking agent:

(11)

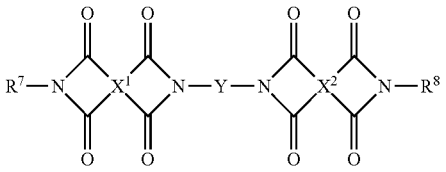

in which $X^1$ and $X^2$ each independently represent a residue obtained by removing four carboxyl groups from a substituted or unsubstituted aromatic tetracarboxylic acid, and when the residue has a substituent, the substituent comprises is a halogen atom, a cyano group, a nitro group, a substituted or unsubstituted alkyl group, or a substituted or unsubstituted aryl group;

Y represents a substituted or unsubstituted alkylene group having a polymerizable functional group or a substituted or unsubstituted arylene group having a polymerizable functional group; and $R^7$ and $R^8$ each independently represent a substituted or unsubstituted alkyl group, a group derived by substituting one of methylene groups of the substituted or unsubstituted alkyl group with an oxygen atom, a group derived by substituting one of the methylene groups of the substituted or unsubstituted alkyl group with a sulfur atom, a group derived by substituting one of the methylene groups of the substituted or unsubstituted alkyl group with $NR^9$, a substituted or unsubstituted aryl group, a substituted or unsubstituted heterocyclic group, or an alkoxycarbonyl group, and $R^7$ and $R^8$ are free of polymerizable functional group, provided that the oxygen atom, the sulfur atom, and the $NR^9$ are free from being directly bonded to nitrogen atoms to which $R^7$ and $R^8$ are bonded.

* * * * *